US012638201B2

(12) United States Patent
Buda

(10) Patent No.: US 12,638,201 B2
(45) **Date of Patent: *May 26, 2026**

(54) MONITORING HVAC AND R PERFORMANCE DEGRADATION USING RELATIVE COP

(71) Applicant: Schneider Electric USA, Inc., Andover, MA (US)

(72) Inventor: Paul R. Buda, Raleigh, NC (US)

(73) Assignee: Schneider Electric USA, Inc., Boston, MA (US)

( * ) Notice: Subject to any disclaimer, the term of this patent is extended or adjusted under 35 U.S.C. 154(b) by 404 days.

This patent is subject to a terminal disclaimer.

(21) Appl. No.: 18/105,767

(22) Filed: Feb. 3, 2023

(65) Prior Publication Data

US 2023/0243536 A1 Aug. 3, 2023

Related U.S. Application Data

(63) Continuation-in-part of application No. 17/463,476, filed on Aug. 31, 2021, now Pat. No. 11,808,468.

(51) Int. Cl.
*F24F 11/38* (2018.01)
*F24F 11/39* (2018.01)
(Continued)

(52) U.S. Cl.
CPC ..... *F24F 11/38* (2018.01); *F24F 11/39* (2018.01); *F24F 11/46* (2018.01); *F24F 11/58* (2018.01);
(Continued)

(58) Field of Classification Search
CPC .. F24F 11/38; F24F 11/39; F24F 11/46; F24F 11/58; F24F 11/64; F24F 2140/20;
(Continued)

(56) References Cited

U.S. PATENT DOCUMENTS 9,574,810 B1 * 2/2017 West ..... F25B 49/02
11,125,457 B1 * 9/2021 Alfano ..... F24F 11/36
(Continued)

FOREIGN PATENT DOCUMENTS

CN 102353403 A 2/2012
CN 112484232 A 3/2021
(Continued)

OTHER PUBLICATIONS

Search Report and Written Opinion for Int'l App. No. PCT/US2024/014456 dated Jun. 3, 2024, 15 pages.
(Continued)

*Primary Examiner* — Santosh R Poudel
(74) *Attorney, Agent, or Firm* — Patterson + Sheridan, LLP

(57) ABSTRACT

Systems and methods for monitoring an HVAC&R system employ a monitoring agent that uses observations of evaporator and condenser intake temperatures, evaporator discharge temperature, and a compressor input power parameter to learn operating characteristics of the HVAC&R system in newly maintained condition. Thereafter, the agent continuously or regularly computes a relative coefficient of performance (COP) for the system under subsequent observed ambient conditions, and relates the present instantaneous efficiency of the HVAC&R system under the observed ambient conditions to the instantaneous efficiency when the system was in newly maintained condition. The relative COP can be used to detect system degradation and quantify the energy usage and cost attributable to the degradation. The agent can take appropriate actions to prevent/minimize damage based on the degree of degradation detected, including shutting off power to the HVAC&R system. The monitoring agent can also be extended to other types of systems besides HVAC&R system.

22 Claims, 27 Drawing Sheets

(51) Int. Cl.

| | |
|---|---|
| ***F24F 11/46*** | (2018.01) |
| ***F24F 11/58*** | (2018.01) |
| ***F24F 11/64*** | (2018.01) |
| *F24F 140/20* | (2018.01) |
| *F24F 140/60* | (2018.01) |

(52) U.S. Cl.
CPC ..... *F24F 11/64* (2018.01); *F24F 2140/20* (2018.01); *F24F 2140/60* (2018.01)

(58) Field of Classification Search
CPC ... F24F 2140/60; F24F 11/49; F25B 2500/19; F25B 2600/024; F25B 2700/151; F25B 2700/21161; F25B 2700/21171; F25B 49/005; F25B 49/02; F25B 49/025
See application file for complete search history.

(56) References Cited

U.S. PATENT DOCUMENTS

| | | | | |
|---|---|---|---|---|
| 2003/0055603 | A1* | 3/2003 | Rossi | F24F 11/30 702/185 |
| 2011/0144807 | A1* | 6/2011 | Buda | F25B 49/005 700/275 |
| 2014/0139336 | A1* | 5/2014 | Kleppe | G08B 17/10 340/540 |
| 2016/0217674 | A1* | 7/2016 | Stewart | F24F 11/38 |
| 2016/0333243 | A1* | 11/2016 | Fukushima | C09K 5/044 |
| 2017/0241657 | A1 | 8/2017 | Salisbury et al. | |
| 2019/0257568 | A1 | 8/2019 | Buda et al. | |
| 2019/0258237 | A1* | 8/2019 | Buda | F24F 11/49 |
| 2019/0309972 | A1* | 10/2019 | Roen | C02F 1/008 |
| 2020/0400325 | A1 | 12/2020 | Yano | |
| 2021/0298557 | A1* | 9/2021 | Budampati | G01M 3/04 |
| 2022/0049883 | A1* | 2/2022 | Alfano | F25B 45/00 |

FOREIGN PATENT DOCUMENTS

| | | | | |
|---|---|---|---|---|
| CN | 113847705 | A * | 12/2021 | F24F 11/38 |
| WO | 2017085525 | A1 | 5/2017 | |

OTHER PUBLICATIONS

Extended European Search Report for EP Application No. 22187628.7 dated May 22, 2023.

* cited by examiner

MONITORING HVAC AND R PERFORMANCE DEGRADATION USING RELATIVE COP

CROSS-REFERENCE TO RELATED APPLICATIONS

This application for patent is a continuation-in-part of U.S. Non-Provisional application Ser. No. 17/463,476, entitled "Continuous Learning Compressor Input Power Predictor," filed Aug. 31, 2021, which is incorporated herein by reference. This application is also related in subject matter to and incorporates herein by reference commonly-assigned application Ser. No. 18/105,773, entitled "Monitoring HVAC&R Performance Degradation Using Relative COP from Joint Power and Temperature Relations," filed concurrently herewith, and commonly-assigned application Ser. No. 18/105,776, entitled "HVAC&R Performance Degradation Monitor and Relation Builder," filed concurrently herewith.

TECHNICAL FIELD

The disclosed embodiments relate generally to heating, ventilating, and air conditioning and refrigeration (HVAC&R) systems and, more particularly, to systems and methods of using a relative coefficient of performance (COP) relation to detect potential problems early in such HVAC&R systems.

BACKGROUND

HVAC&R systems, which may include residential and commercial heat pumps, air conditioning, and refrigeration systems, employ a vapor-compression cycle (VCC) to transfer heat between a low temperature fluid and a high temperature fluid. In many VCC based systems referred to as direct-exchange systems, the "fluid" is the air in a conditioned space or an external ambient environment. In other VCC based systems, including indirect-exchange systems such as chillers, geothermal heat pumps and the like, the fluid to and from which heat is exchanged may be a liquid such as water or an anti-freeze.

VCC based systems are generally known in the art and employ a refrigerant as a medium to facilitate heat transfer. The systems are mechanically "closed" in that the refrigerant is contained within the mechanical confines of the system and there is a mechanical buffer where the heat is to be exchanged between the refrigerant and the external fluid(s). In these systems, the refrigerant circulates within the system, passing through a compressor, a condenser, and an evaporator. At the evaporator, heat is absorbed by the refrigerant from the space to be cooled in the case of an air conditioner or refrigerator, and absorbed from the external ambient or other heat source in the case of a heat pump. At the condenser, heat is rejected to the external ambient in the case of an air conditioner or refrigerator, or to the space to be conditioned in the case of a heat pump.

Existing VCC based systems, however, do not have sufficient ability to monitor and detect potential problems and performance degradations early. The lack of early problem detection is due in part to the inability of existing VCC based systems to do so quickly and reliably. Typically, detection of performance degradations in VCC based systems required acquiring and processing an enormous amount of data over an extended period of time in order to provide a sufficient level of reliability. The large amount of data and processing required has proven over the years to be overly complex and hence impractical to implement for most VCC based systems.

A need therefore exists for a way to monitor and detect potential problems and performance degradations early in VCC based systems in an efficient manner while also providing a sufficient level of reliability and accuracy.

SUMMARY

The embodiments disclosed herein relate to improved systems and methods for monitoring an HVAC&R system employing a vapor-compression cycle. One embodiment described herein provides a monitoring application or agent that uses observations of evaporator and condenser intake temperatures, evaporator discharge temperature, and a compressor input power parameter to learn operating characteristics of the HVAC&R system in newly maintained condition. Thereafter, the agent continuously or regularly computes a relative coefficient of performance, or relative COP, for the system under subsequent observed ambient conditions, and relates the present instantaneous efficiency of the HVAC&R system under the observed ambient conditions to the instantaneous efficiency when the system was in newly maintained condition. The relative COP can be used to detect system degradation and quantify the energy usage and cost attributable to the degradation. Such a monitoring application or agent can also be extended to other types of systems besides HVAC&R system.

In general, in one aspect, the embodiments disclosed herein relate to a monitoring system for an HVAC&R system. The monitoring system comprises, among other things, a data acquisition processor operable to acquire observations about the HVAC&R system, the observations including fluid temperature measurements for a condenser and fluid temperature measurements for an evaporator, the observations further including compressor input power parameter measurements corresponding to the fluid temperature measurements. The monitoring system additionally comprises a compressor input power parameter (CIPP) processor operable to learn a CIPP relation between fluid temperature measurements for an evaporator intake temperature and a condenser intake temperature and the compressor input power parameter measurements, the CIPP processor configured to compute a predicted value for a compressor input power parameter using the CIPP relation. The monitoring system also comprises an evaporator temperature drop (ETD) processor operable to learn an ETD relation between the fluid temperature measurements for the evaporator intake temperature, the condenser intake temperature, and an evaporator temperature drop, the ETD processor configured to compute a predicted value for an evaporator temperature drop using the ETD relation. The monitoring system further comprises a relative coefficient of performance (COP) processor operable to compute a relative coefficient of performance for the HVAC&R system based on the predicted value for the compressor input power parameter and the predicted value for the evaporator temperature drop. The monitoring system still further comprises degradation detection processor operable to receive the relative coefficient of performance from the relative COP processor and declare that performance degradation is present for the HVAC&R system in response to the relative coefficient of performance exceeding one or more predefined thresholds.

In general, in another aspect, the embodiments disclosed herein relate to a method of monitoring an HVAC&R system. The method comprises, among other things, acquiring, at a data acquisition processor, observations about the HVAC&R system, the observations including fluid temperature measurements for a condenser and fluid temperature measurements for an evaporator, the observations further including compressor input power parameter measurements corresponding to the fluid temperature measurements. The method additionally comprises learning, at a compressor input power parameter (CIPP) processor, a CIPP relation between fluid temperature measurements for an evaporator intake temperature and a condenser intake temperature and the compressor input power parameter measurements, and computing, at the CIPP processor, a predicted value for a compressor input power parameter using the CIPP relation. The method further comprises learning, at an evaporator discharge temperature (ETD) processor, an ETD relation between the fluid temperature measurements for the evaporator intake temperature, the condenser intake temperature, and an evaporator temperature drop, and computing, at the ETD processor, a predicted value for an evaporator temperature drop using the ETD relation. The method further comprises computing, at a relative coefficient of performance (COP) processor, a relative coefficient of performance for the HVAC&R system based on the predicted value for the compressor input power parameter and the predicted value for the evaporator temperature drop. The method still further comprises receiving, at a degradation detection processor, the relative coefficient of performance from the COP processor, and declaring, at the degradation detection processor, that performance degradation is present for the HVAC&R system in response to the relative coefficient of performance exceeding one or more predefined thresholds.

In accordance with any one or more of the foregoing embodiments, the degradation detection processor is further operable to compute a cost factor attributable to the performance degradation using the relative coefficient of performance.

In accordance with any one or more of the foregoing embodiments, the degradation detection processor is further operable to shut off power to the HVAC&R system in response to the relative coefficient of performance exceeding the one or more predefined thresholds.

In accordance with any one or more of the foregoing embodiments, the degradation detection processor is further operable to determine that air flow occlusion is present in the HVAC&R system and issue a signal indicative of the air flow occlusion in response to the relative coefficient of performance exceeding the predefined threshold.

In accordance with any one or more of the foregoing embodiments, the degradation detection processor is further operable to issue a signal indicative of a dirty air filter when air flow occlusion is present in the HVAC&R system.

In accordance with any one or more of the foregoing embodiments, the relative COP processor computes the relative coefficient of performance at least by (i) computing a first ratio comprising the predicted value for the compressor input power parameter over a measured value of the compressor input power parameter, (ii) computing a second ratio comprising a measurement derived value for the evaporator temperature drop over the predicted value for the evaporator temperature drop, and (iii) multiplying the first ratio by the second ratio to determine the relative coefficient of performance.

In accordance with any one or more of the foregoing embodiments, the observations acquired by the data acquisition processor are stored, at the CIPP processor, via one or more temperature maps, each temperature map containing a plurality of cells, each cell corresponding to a condenser intake temperature and an evaporator intake temperature, each cell including summary statistics for measured values for the compressor input power parameter.

In accordance with any one or more of the foregoing embodiments, the observations acquired by the data acquisition processor are stored, at the ETD relation processor, via one or more temperature maps, each temperature map containing a plurality of cells, each cell corresponding to a condenser intake temperature and an evaporator intake temperature, each cell including summary statistics for measurement derived values of the evaporator temperature drop.

In accordance with any one or more of the foregoing embodiments, the data acquisition processor, the CIPP processor, the ETD processor, the relative COP processor, and the degradation detection processor reside within an agent of the monitoring system, the agent executed on one or more of the following: a cloud-based network, a fog-based network, and locally to the HVAC&R system.

In accordance with any one or more of the foregoing embodiments, a vapor-compression cycle (VCC) state generator operates to augment the observations acquired by the data acquisition processor with system state information indicating (i) an ON/OFF state of the HVAC&R system, (ii) a suitability of the observations for learning and predicting compressor input power parameters, and (iii) a suitability of the observations for learning and predicting evaporator temperature drop.

In accordance with any one or more of the foregoing embodiments, the CIPP processor and the ETD processor learn the CIPP relation and the ETD relation, respectively, using a machine learning based learning process.

In general, in one aspect, the embodiments disclosed herein relate to a monitoring system for an HVAC&R system. The monitoring system comprises, among other things, a data acquisition processor operable to acquire observations about the system, the observations including specified system temperature measurements and input power measurements corresponding to the specified temperature measurements. The monitoring system additionally comprises an input power parameter relation processor operable to learn a power parameter relation between the specified system temperature measurements and the input power parameter measurements, the power parameter relation processor configured to compute a predicted value for an input power parameter using the power parameter relation. The monitoring system also comprises a temperature parameter relation processor operable to learn a temperature parameter relation between the specified system temperature measurements, the temperature parameter relation processor configured to compute a predicted value for a specified system temperature using the temperature parameter relation. The monitoring system further comprises a relative coefficient of performance processor operable to compute a relative coefficient of performance for the system based on the predicted value for the input power parameter and the predicted value for the specified system temperature. The monitoring system still further a degradation detection processor operable to receive the relative coefficient of performance from the relative coefficient of performance processor, the degradation detection processor further operable to declare that performance degradation is present for the system in response to the relative coefficient of performance exceeding one or more predefined thresholds.

In general, in yet another aspect, the disclosed embodiments are directed to a non-transitory computer-readable medium containing program logic that, when executed by operation of one or more computer processors, causes the one or more processors to perform a method according to any of the embodiments described herein.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

Figure 1:
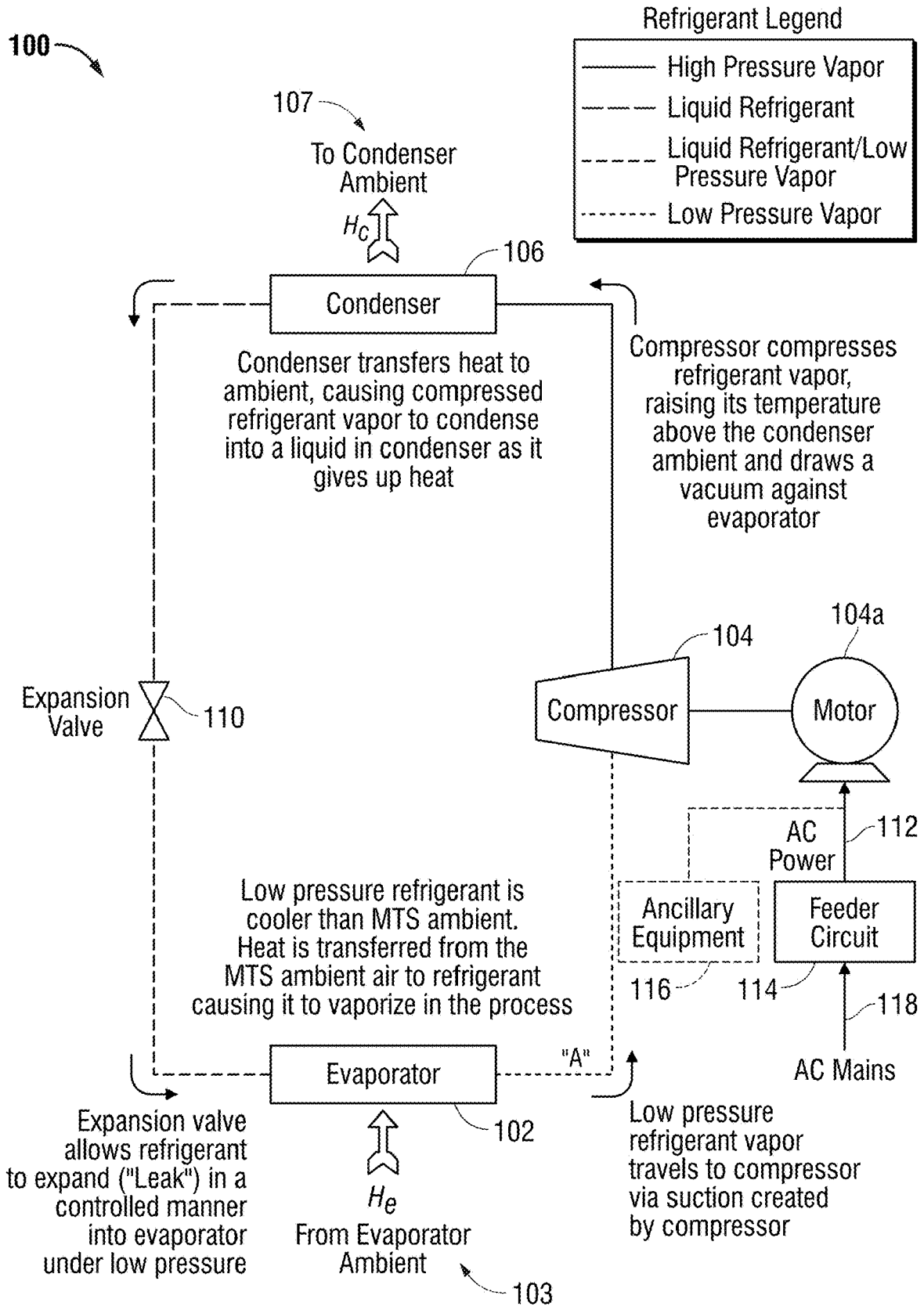
FIG. 1 illustrates a known HVAC&R system employing a vapor compression cycle (VCC)

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Various embodiments disclosed herein relate to systems and methods and computer or processor-executable instructions for monitoring and detecting potential problems early in a VCC based HVAC&R system. As mentioned above, the HVAC&R monitoring systems and methods employ a monitoring application or agent that uses continuous machine learning and one or more temperature maps to learn a relation between a measured compressor input power parameter (sometimes referred to as "power parameter"), i.e., a fixed, measurable, positive definite function of the power consumed by a compressor, resulting from the application of one or more system compressors and measured condenser and evaporator intake fluid temperatures, and a relation between a temperature parameter, such as a measured evaporator intake or discharge temperature or the corresponding measured (or measurement derived) evaporator temperature drop, and the measured condenser and evaporator intake fluid temperatures. These relations are learned based on observations (i.e., measurements) of the intake fluid temperatures, evaporator discharge temperature and a compressor input power parameter for each operating compressor and evaporator temperature drop when the HVAC&R system is new or in a "newly maintained" condition. The monitoring agent can then use the learned relations to predict, based on subsequent observations of the HVAC&R system, the expected compressor input power parameter and evaporator temperature drop values representing the HVAC&R system in the "newly maintained" condition. The agent can thereafter compare the predicted compressor input power parameter and evaporator temperature drop values with observed compressor input power parameter and evaporator temperature drop values to detect performance degradation early and infer possible causes of the degradation and issue an appropriate alert signal.

The agent can thereafter use the predicted compressor input power parameter and evaporator temperature drop values and actual, measured compressor input power parameter and temperature drop values for each operating compressor to determine a relative coefficient of performance, or relative COP (rCOP), for each compressor within the HVAC&R system.

In practical terms, the relative COP is a ratio of a coefficient of performance (COP) computed from measurements over an expected or reference COP, such that if the HVAC&R system is working properly, then the relative COP should be unity, or 100%. In some embodiments, this relative COP can be computed by computing a ratio of a predicted compressor input power parameter value over a measured compressor input power parameter value, multiplied by a ratio of a measured evaporator discharge temperature drop (ETD) over a predicted evaporator temperature drop, defined as the numerical difference between the evaporator intake temperature and the evaporator discharge temperature, for a given, measured set of condenser and evaporator intake fluid temperatures.

Another aspect of the embodiments herein is a novel relation learner, which learns the relations required to compute the normalized residuals and relative COP described above using a novel temperature map, a relation builder, a neighborhood extractor and a parameterized predictor. The relation learner has the ability to learn to predict the value of properties needed for computing the normalized residuals and the relative COP of the invention but can also learn in the presence of degradation and furthermore can determine when a prediction is likely to be accurate and when it is not.

In general, embodiments of the present disclosure can detect system degradation based on one or more of: a 2-dimensional temperature map based prediction of a power parameter (via normalized residuals), a 2-dimensional temperature map based prediction of an evaporator temperature drop (via normalized residuals), a relative COP based on ratios involving either of the above 2-dimensional power parameter or evaporator temperature drop predictions, a 3-dimensional temperature map based prediction of power parameter (via normalized residuals), 3-dimensional temperature map based prediction of evaporator temperature drop (via normalized residual), a relative COP based on a ratio involving the above 3-dimensional power parameter prediction, a relative COP based on a ratio involving the above 3-dimensional evaporator temperature drop prediction, or a relative COP based on ratios involving both of the above 3-dimensional power parameter and evaporator temperature drop predictions.

Following now is a discussion on exemplary implementations of predicted compressor input power parameter values using a relation learned over time from observations of measured compressor input power parameter values and certain measured temperatures, and exemplary implementations of predicted evaporator temperature drop values, also using a relation learned over time from observations of measured or computed values of evaporator temperature drop and certain measured temperatures. The particular temperatures that are measured may be the same for both learned relations. Both relations are learned via the novel relation learner mentioned earlier. The use of these predicted values may be combined with corresponding observed values to produce sequences of metrics that are useful for detecting performance degradation early in an HVAC&R system. A discussion also follows on determination and use of a relative COP to detect performance degradation early, as well as a metric to quantify the costs associated the performance degradation, in the HVAC&R system. Use of these metrics individually and in combination to infer possible causes of the degradation and issue an appropriate alert signal when observed will also be discussed.

As alluded to above, the ability of the disclosed systems and methods to detect problems early arises from certain intuition by the present inventor based on observations that given a set of measurable external conditions of temperature, evaporator fan speed (and condenser fan speed in some cases), and a known combination of compressor state (i.e., which compressors are on and off at the time in a multi-compressor system), the power consumed by a refrigerant compressor employed and the corresponding temperature drop in a vapor compression cycle are both time invariant and repeatable in steady state so long as the physical condition of the system does not change. More specifically, once the HVAC&R system has run long enough that the internal refrigerant states have stabilized, there is and should be a knowable relation between compressor input power parameters, such as real power, current, volt-amperes, and the like, and certain observed temperatures, assuming other aspects of the system remain constant. This time-invariant relation between a compressor input power parameter and condenser and evaporator intake temperatures representing the behavior of the HVAC&R system when in newly maintained condition can be learned by the relation learner of the embodiments herein and the resulting learned relation is referred to as a compressor input power parameter (CIPP) relation, or simply "CIPP relation" herein.

Additionally, once the HVAC&R system has run long enough that both the internal refrigerant states per above and the temperatures of the physical heat transfer mechanisms, such as fan coils and the like, have stabilized, there is and should be a knowable relation between (a) the measured fluid temperature drop across the evaporator, or equivalently, the temperature drop across the evaporator, computed as the difference between the measured fluid intake temperature and measured fluid discharge temperature of the evaporator, and (b) certain observed temperatures, assuming other aspects of the system remain constant. This time-invariant relation between the temperature drop across the evaporator and condenser and evaporator intake temperatures representing the behavior of the HVAC&R system when in newly maintained condition can be learned by the relation learner of the embodiments herein, and the resulting learned relation is referred to as an evaporator temperature drop relation, or simply "ETD relation" herein.

These learned CIPP and ETD relations can be employed individually and in combination to detect system degradation in a number of diverse applications, such as air conditioners, heat pumps, refrigerators and other related systems and can also be used to infer possible conditions causing the degradation and issue an appropriate alert signal. Note that in a heat pump system intended to transfer heat from an external ambient source of heat to a fluid such as air or water, the evaporator temperature drop as defined above will be a negative quantity.

Referring now to FIG. 1, a flow diagram for a basic HVAC&R system 100 is shown employing a vapor compression cycle. The CIPP relation mentioned above can be illustrated by examining the VCC based system 100 in FIG. 1. This system 100 represents most of the HVAC&R systems deployed today, so the discussion herein largely focuses on monitoring and detecting problems early in this system. Those having ordinary skill in the art will appreciate that the principles and teachings herein are equally applicable to other types of HVAC&R systems and equipment available to commercial and industrial users. Indeed, the principles and teachings discussed are generally applicable to any deterministic system or equipment in which one parametric outcome or value will reliably result for a given parameter of interest, and thus can be rapidly learned and predicted using the techniques described herein, given another parameter, or set of parameters (and the values thereof). Such deterministic systems and equipment are numerous and varied and involve many types of parameters, for example, flow control parameters (e.g., flow rate, viscosity, etc.), power control parameters (e.g., voltage, current, etc.), motion control parameters (e.g., speed, height, etc.) and the like.

Operation of the HVAC&R system 100 is well known in the art and will be described only generally here. Beginning at point "A" in the figure, refrigerant in the form of low-pressure vapor is drawn via suction from an evaporator 102, which is essentially a heat exchanger that absorbs heat from a fluid (i.e., air) at the evaporator ambient 103 and transfers it to the refrigerant flowing within the evaporator to a compressor 104. The compressor 104 receives the low-pressure vapor, compresses it into a high-pressure vapor, and sends it toward a condenser 106, raising the temperature of the refrigerant to a temperature higher than that of the fluid (i.e., air in the case of a direct exchange system for example) of the condenser ambient 107 in the process.

At that condenser 106, condenser coils (not expressly shown) allow the heat in the higher temperature vapor refrigerant to transfer to the lower temperature condenser ambient fluid, as indicated by arrow $H_c$. This heat transfer causes the high-pressure vapor refrigerant in the condenser coils to condense into a liquid. From the condenser 106, the liquid refrigerant (still under high pressure) enters an expansion valve 110 that atomizes the refrigerant and releases (i.e., sprays) it as an aerosol into the evaporator 102. The temperature of the liquid refrigerant drops significantly as it moves from the inlet side of the expansion valve 110 where it is under high pressure to the outlet side of the expansion valve 110 where it is under relatively low pressure.

At the evaporator 102, the reduced temperature refrigerant cools the evaporator coils (not expressly shown) to well below the temperature of the evaporator ambient fluid in a normally operating system, absorbing heat in the process and causing the refrigerant to evaporate into a vapor. Heat from the evaporator ambient fluid flows is subsequently absorbed by the evaporator coils (not expressly shown) in the process, as indicated by arrow $H_e$. The low-pressure vapor in the evaporator is then pulled via suction into the compressor 104 at A, and the cycle repeats.

In FIG. 1, the compressor 104 is driven by a compressor motor 104*a*, the power for which is provided by an AC power source, such as AC power line 112. The AC power line 112 provides power from an AC mains 118 that is typically fed through a branch feeder circuit 114. The branch feeder circuit 114 serves to isolate and provide short circuit and overcurrent protection for the HVAC&R system 100. Many branch feeder circuits have current or power measurement capability either built into their circuit breakers or otherwise embedded that can provide a signal indicative of the input power being used by the loads. Examples include the NQ and NF series of panelboards with integrated energy meters from Schneider Electric USA, Inc. In some installations, the HVAC&R system 100 may also include ancillary equipment (shown in dashed lines), such as fans and other ancillary electrical loads, electrical disconnect boxes, and the like, generally indicated at 116, which also receive power from the feeder circuit 114. The ancillary equipment 116 are often found inside a physical housing also housing the compressors of the system 100 and may be in series or parallel with the motor 104*a*.

As will be explained in the following description, one way to detect system degradation is by monitoring the input power consumed by the compressor motor 104*a* over the feeder circuit 114 and AC power line 112 and comparing that compressor input power to the compressor input power predicted by the CIPP relation mentioned above. In general, if the comparison indicates the observed compressor input power is different from (i.e., greater or less than) the compressor input power predicted by the CIPP relation by more than a predefined threshold amount (e.g., 5%, 10%, 15%, etc.), then that may be an indication of degraded performance.

The terms "evaporator ambient" and "condenser ambient" as used herein refer to the ambient environment surrounding the evaporator and condenser functions, respectively. When the system 100 is operating in air conditioning mode or as a refrigerator, the evaporator ambient is the space to be cooled or "air conditioned" and is normally a building or room but may also be the internal space or food storage area of a refrigerator or freezer. In this mode, the condenser ambient is usually the outdoor environment in the case of an air conditioner and some refrigeration systems and may be the room ambient external to the equipment in the case of refrigeration. In other words, a direct exchange air conditioner or refrigerator absorbs heat from the air of a conditioned space and rejects the heat to the outdoor or external environment. When the system 100 is operating as a heat pump in heating mode, the roles of the physical condenser 106 and physical evaporator 104 are reversed so that the physical condenser 106 functions to absorb heat from the nominally cooler outdoor environment and the physical evaporator 102 functions to deliver heat to the building or room being heated.

The HVAC&R system 100 of FIG. 1 is a "direct exchange" system in which heat is transferred directly to and from the air of the evaporator and condenser ambient environment by the evaporator 102 and condenser 106. However, the embodiments disclosed herein are also applicable to non-direct exchange systems, including "indirect exchange" systems, such as a chiller operating as an air conditioner, or a geothermal heat pump. In a chiller, the evaporator cools a fluid, such as cooling water, that is then transported throughout a building to independently cool the spaces therein through heat exchangers located remotely from the chiller. In some systems, heat is rejected from the condenser into a liquid fluid such as water or an anti-freeze solution, which is then transferred to a cooler ambient, via for instance a cooling tower. Thus, the disclosed embodiments may be used with systems that transfer heat directly to and from the air of the intended spaces as in a conventional direct exchange system, or indirect exchange systems that transfer heat to or from a liquid fluid, such as water, which is then used to cool or heat the intended spaces.

In the description that follows, the term "fluid temperature," when used to describe the intake or exhaust temperature of an evaporator or condenser (or the function thereof), will be understood to be air in the case of a direct exchange system and a liquid or fluid in the case of indirect exchange systems such as chillers. Mixed mode systems, such as a geothermal heat pump that uses water or anti-freeze to exchange heat with the ground and air to exchange heat inside the building, are also within the scope of the disclosed embodiments.

Figure 2:
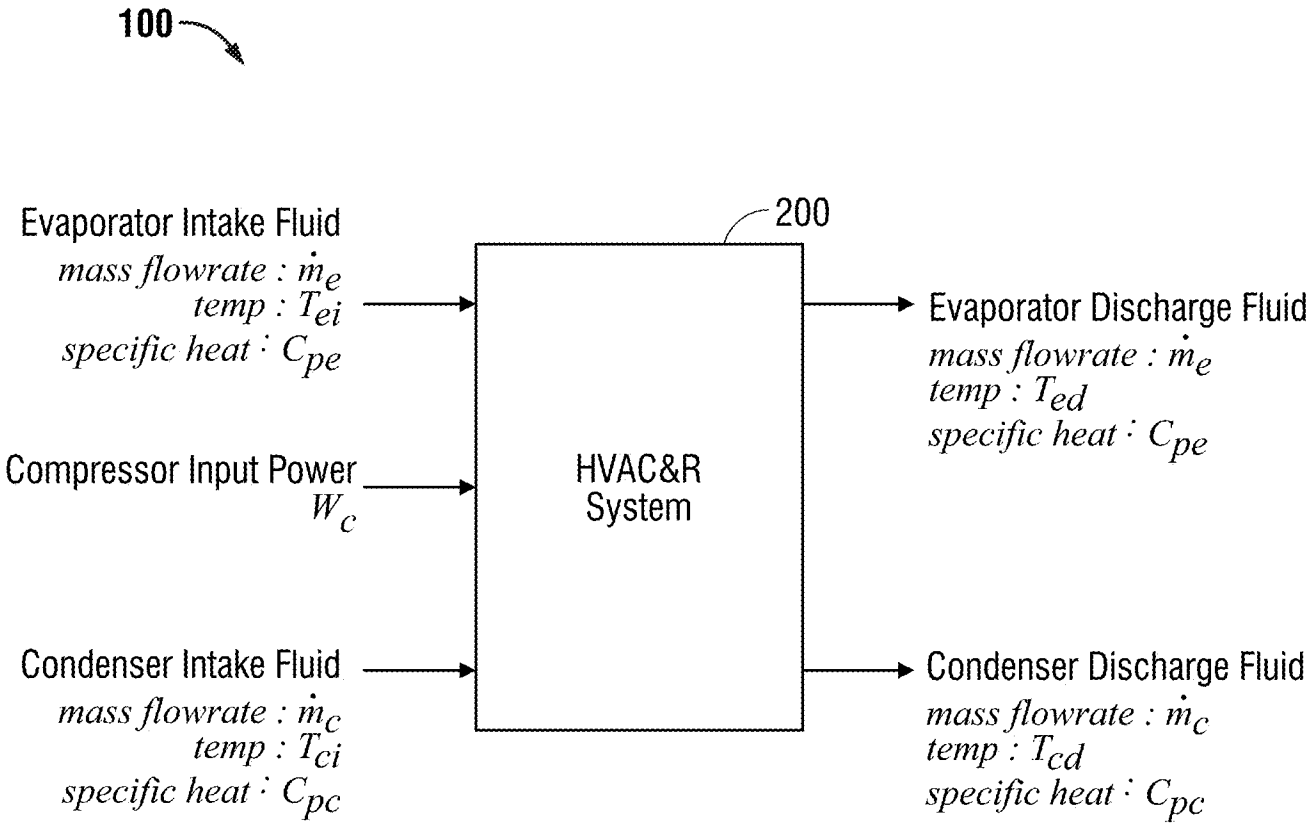
FIG. 2 illustrates a simplified view of the exemplary HVAC&R system as a "black box" according to aspects of the disclosed embodiments.

FIG. 2 shows a simplified view of the HVAC&R system 100 in the form of a so-called "black box" 200 having certain inputs and outputs. Treating the HVAC&R system 100 in this way allows the system to be analyzed in terms of its external inputs and outputs (i.e., its transfer characteristics), without disturbing the internals of the HVAC&R system which makes the invention disclosed herein ideal for retrofit applications to existing systems. The inputs to the system 100 when treated as a black box 200 include the condenser intake fluid, which has a specific heat $C_{pc}$, with a mass flow rate $\dot{m}_c$, and operating at a temperature $T_{ci}$, the evaporator intake fluid, which has a specific heat $C_{pe}$, with a mass flow rate $\dot{m}_e$, and operating at a temperature $T_{ei}$, and the compressor input power, $W_c$, with measurable power parameter P. The outputs from the black box 200 include the condenser discharge fluid, which has a specific heat $C_{pc}$, with a mass flow rate $\dot{m}_c$, and operating at a temperature $T_{cd}$, and the evaporator discharge fluid, which has a specific heat $C_{pe}$, with a mass flow rate $\dot{m}_e$, and operating at a temperature $T_{ed}$.

As an additional simplification, it can be assumed that the specific heat of the fluids moving across the condenser and evaporator, $C_{pc}$ and $C_{pe}$, respectively, do not change over time. This generally holds true for a first order approximation. Further, the mass flow rate across the condenser and evaporator, $\dot{m}_c$ and $\dot{m}_e$, are constant for the system 100 operating in steady state. This is the case in the simplest systems in which one or more single speed fans are employed in normal operation to move fluid past the condenser and evaporator assemblies (single speed fans run continuously and do not cycle on and off with temperature or pressure to maintain head pressure).

That the condenser intake and discharge fluids have the same specific heat and mass flow rate derive from the fact that: 1) they are the identical fluids, and 2) the physical system viewed in this way has no fluid storage capability and therefore the net mass flow must be zero. This is also the case for the evaporator fluids.

The above assumptions are the basis for the design of most HVAC&R systems operating in steady state in which temperature is regulated by cycling the compressor on and off as needed to maintain temperature within a selected range. This represents most of the HVAC&R systems currently in use, including most residential split systems and packaged systems, and simple refrigerators. For such HVAC&R systems, it has been found that the condenser intake fluid temperature $T_{ci}$, evaporator intake fluid temperature $T_{ei}$, and the compressor input power parameter P are sufficient to establish a first time-invariant relation that can be used to detect system degradation when the vapor compression cycle is operating in steady state. As well, it has been found that the condenser intake temperature, $T_{ci}$, evaporator intake temperature, $T_{ei}$ and the evaporator discharge temperature, $T_{ed}$, are sufficient to establish a second, time-invariant relation that can be used to detect system degradation that can be used to detect system degradation when the vapor compression cycle is operating in steady state.

As well, increased refrigerant temperature in the condenser or evaporator functions generally results in increased refrigerant pressure within the refrigerant loop, and more compressor power is needed to maintain pressure and move the refrigerant through the system. The power required to move the refrigerant through the system is also dependent upon the amount of refrigerant in the loop, as is the evaporator temperature drop.

Referring to the simplified view of the HVAC&R system 100 as a black box 200 discussed in FIG. 2, consider the condition where the system experiences fluids at a specific pair of condenser and evaporator intake fluid temperatures ($T_{ei}$, $T_{ci}$), called a temperature tuple (i.e., an ordered list of elements). Consider also that the system is in a "newly maintained" condition and that the mass flow rates across the condenser and evaporator coils are also fixed and nominal. The term "newly maintained" condition as used herein refers to the condition of the HVAC&R system immediately after it has been properly serviced, where the intent of the service is to render the system in the best possible condition (i.e., as close to factory specifications as is practical for the age of the system). As described above, for the system 100 operating in this state, both the compressor power consumed and evaporator temperature drop should be repeatable, meaning that any time the system 100 experiences this same set of conditions, the power consumed by the compressor and the evaporator temperature drop should be identical once refrigerant states have stabilized. At the same temperature tuple ($T_{ei}$, $T_{ci}$), any condition that causes a reduction in the rate at which heat is extracted from the condenser coil will increase the temperature of the refrigerant in the condenser, causing the pressure in the condenser to increase, and causing more power to be consumed by the compressor than would be otherwise. These conditions include things that would reduce mass flow rate, such as a failed condenser fan, obstructions in the condenser, including extreme condenser fouling, and surface effects such as condenser fouling, even if ultimately the mass flow rate is not reduced. Thus, if the compressor power for a given set of intake temperatures ($T_{ei}$, $T_{ci}$) is higher than expected, then: 1) something is not right with the system and its efficiency is likely degraded, and 2) a possible cause of the problem is something in the condenser subsystem.

In a similar manner, for the intake fluid temperature tuple ($T_{ei}$, $T_{ci}$), any condition that causes the rate of heat absorption in the evaporator to decrease will cause the average internal temperature of the fluid in the evaporator to decrease, causing pressures to lower, and resulting in reduced compressor power. This includes such phenomena as a fouled evaporator, either via accumulation of dirt or frost, which reduces the rate of heat transfer from the evaporator coil to the evaporator fluid, or anything that causes a reduction in evaporator fluid mass flow, which can include the above, but also includes dirty filters, broken evaporator fan belts and other phenomenon. Thus, again, if the compressor power for a given set of intake temperatures ($T_{ei}$, $T_{ci}$) is lower than expected, then: 1) something is not right with the system and its efficiency is likely degraded, and 2) a possible cause of the problem is something in the evaporator subsystem.

For a fixed pair of condenser and evaporator intake mass flow rates and temperatures equal, the power required to move the refrigerant through the system is a positive definite function of the total amount of refrigerant moved through the system. Importantly, a refrigerant leak, which is quite common in HVAC&R systems and affects both system efficiency and the environment via ozone depletion, appears as a general reduction in compressor power, independent of the intake temperatures.

Thus, for the basic HVAC&R system 100 described above, information regarding the overall health of the system can be obtained from a simple black box model in which a CIPP relation is learned based on the intake fluid temperatures ($T_{ei}$, $T_{ci}$) and a compressor input power parameter P when the system is in "newly maintained" condition. Once this learned CIPP relation is established, it may be used to predict potential performance degradations and problems based on subsequent observations (i.e., measurements) of certain compressor input power parameters. The observed compressor input power parameters may include, for example, the real power, current (e.g., one phase of a 2-phase current), volt-amperes, and the like.

Additional or alternative information regarding the overall health of the system can also be obtained from a simple black box model in which an ETD relation is learned based on the intake fluid temperatures ($T_{ei}$, $T_{ci}$) in which the evaporator temperature drop is computed as the difference between the observed evaporator intake temperature $T_{ei}$ and the observed evaporator discharge temperature $T_{ed}$ when the system is in "newly maintained" condition. Once this learned ETD relation is established, it may be used to predict potential performance degradations and problems based on computation of evaporator temperature drop from subsequent observations of evaporator intake and discharge temperature.

Figure 3:
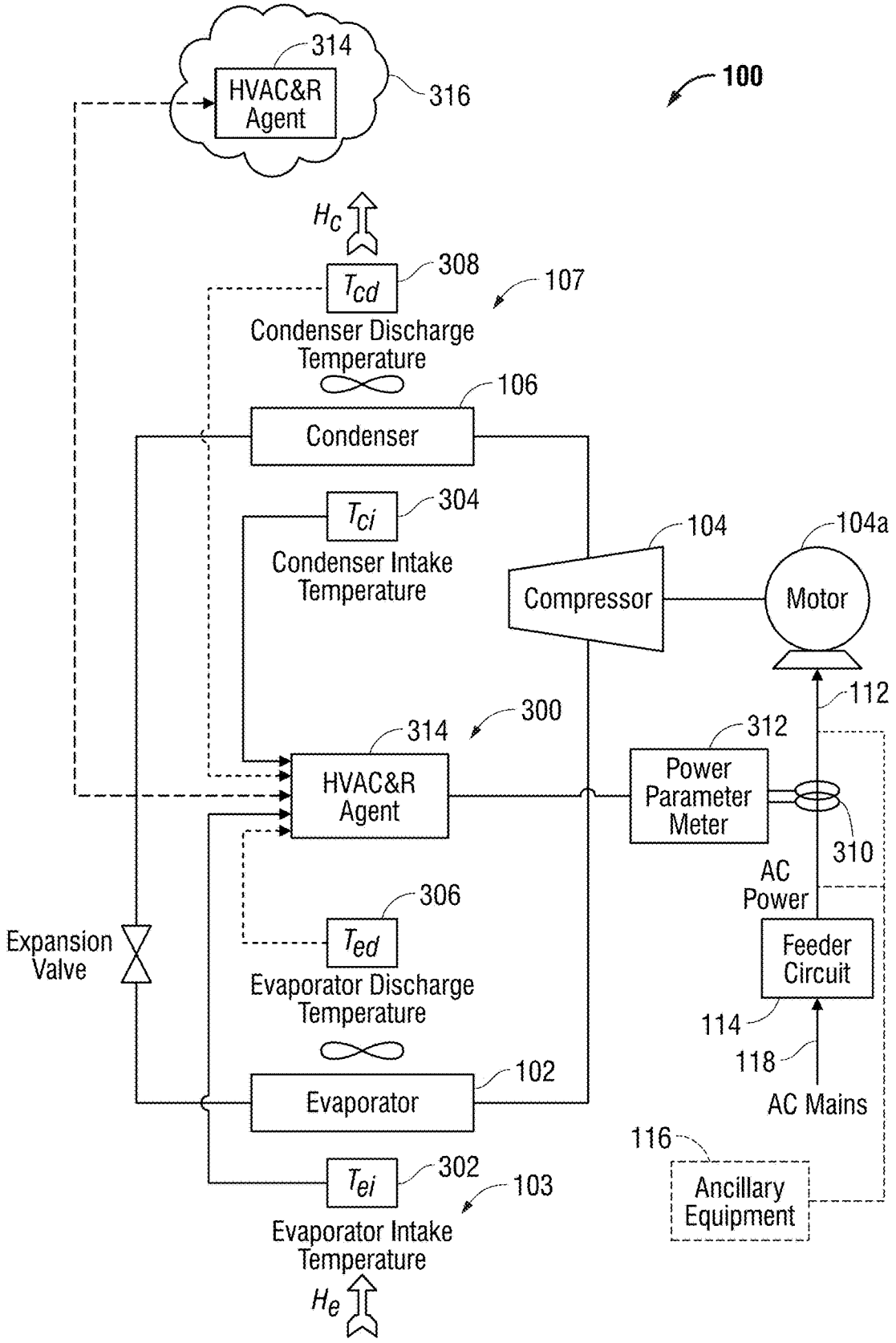
FIG. 3 illustrates an exemplary HVAC&R system equipped with a monitoring and early problem detection system according to aspects of the disclosed embodiments.

Referring next to FIG. 3, an HVAC&R monitoring and early problem detection system 300 has now been installed on the HVAC&R system 100 in accordance with embodiments of the present disclosure. The monitoring and early problem detection system 300 is designed to learn and use the CIPP relation and ETD relation discussed above to monitor for performance degradation in the HVAC&R system 100. To this end, the system 100 is equipped with a plurality of temperature sensors, such as sensors 302, 304, 306, and 308, mounted at selected points on the system. These temperature sensors 302, 304, 306, and 308 acquire selected temperatures measurements that may be used by the monitoring and early problem detection system 300: (i) a condenser intake fluid temperature $T_{ci}$; (ii) a condenser discharge fluid temperature $T_{cd}$; (iii) an evaporator intake fluid temperature $T_{ei}$, generally referred to as the "return" temperature in commercial and residential direct exchange air conditioning; and (iv) an evaporator discharge fluid temperature $T_{ed}$, generally referred to as the "supply" temperature in commercial and residential direct exchange air conditioning systems.

Although four temperature measurements were mentioned, the CIPP aspect of the monitoring and early problem detection system 300 can operate using only two of the four temperature measurements: either the intake or discharge fluid temperature of the evaporator ($T_{ei}$ or $T_{ed}$), and either the intake or discharge fluid temperature of the condenser ($T_{ci}$ or $T_{cd}$), depending on the implementation. For example, in one embodiment, the monitoring and early problem detection system 300 may use the fluid temperature $T_{ei}$ at the intake of the evaporator 102 and the fluid temperature $T_{ci}$ at the intake of the condenser 106, and these temperature measurements are preferable when readily accessible as they are not directly influenced by the operation of the HVAC&R system. Accordingly, in one embodiment, a temperature sensor 302 is mounted at or near the intake of the evaporator 102 to measure the evaporator intake fluid temperature $T_{ei}$, and a second temperature sensor 304 is mounted at or near the intake of the condenser 106 to measure the condenser intake fluid temperature $T_{ei}$. Alternatively, the condenser discharge fluid temperature $T_{cd}$ may be substituted for $T_{ci}$ or the evaporator discharge fluid temperature $T_{ed}$ may substituted for $T_{ei}$ in some embodiments. In such embodiments, a third temperature sensor 306 may also optionally be mounted at the discharge of the evaporator 102 to measure the evaporator discharge fluid temperature $T_{ed}$, or a fourth temperature sensor 308 may also optionally be mounted at the discharge of the condenser 106 to measure the condenser discharge fluid temperature $T_{cd}$. These temperature sensors 302, 304, 306, and 308 may be any suitable temperature sensors known to those skilled in the art, including voltage-based temperature sensors that employ thermocouples or thermistor devices.

In addition to the intake fluid temperature measurements, measurements of a compressor input power parameter are also obtained for the monitoring and early problem detection system 300. Examples of compressor input power parameter measurements that may be obtained include measurements of current, real power, reactive power, and apparent power, and also voltage in some implementations. As discussed further below, the compressor input power parameter that is usually measured is current, due to the relatively low cost of current measurement equipment compared to power meters and the like. And as a practical matter, for measurements of real power, most power meters and other power measurement devices already need to acquire current measurements. Thus, compressor input current is almost always one of the compressor input power parameters measured.

To implement the ETD aspect of the monitoring and early problem detection system 300, both the evaporator intake temperature $T_{ei}$ and the evaporator discharge temperature $T_{ed}$ are commonly used to establish the evaporator temperature drop. As in the case of the CIPP aspect, a condenser temperature (either $T_{ci}$ or $T_{ed}$, with $T_{ci}$ preferred as it is not directly influenced by operation of the HVAC&R system) is needed to fully establish the ETD relation. Accordingly, three temperature measurements are used to implement the ETD aspect of the monitoring and early problem detection system 300.

In a typical residential installation, the compressor 104 (and motor 104*a*) is fed via AC power line 112, from branch feeder circuit 114 fed by AC mains 118. In some systems, AC power line 112 may be a 3-wire single-phase power line having a mid-point neutral. Other configurations are also possible, including two-wire AC systems and 3-phase AC configurations. Thereafter, one or more current detection devices 310, such as one or more toroidal-type current transformers, may be mounted on the wires of the compressor power line 112. The outputs of the one or more current transformers 310 are then provided to a power parameter meter 312, which may be any commercially available power meter or a meter that can measure currents, such as RMS current, flowing through the power line 112. Some models of the power parameter meter 312 may also incorporate measurements of line voltage, such as models that measure real power and apparent power (Volt-Amps), in single or polyphase form. An example of a commercial power meter that may be used as the power parameter meter 312 is any of the PM8xx series power meter manufactured by Schneider Electric with associated circuitry to measure real power. In systems where the line voltage is maintained constant, or at least repeatable with respect to the configuration of compressor(s) 104 in the system, a simple clamp-on current transformer that can measure the current of one leg of the compressor 104 may also be sufficient.

For embodiments where the CIPP relation is being used to estimate the compressor input current, the equipment may include one or more current transformers and other current-measuring devices. Current-measuring devices are available that can provide an indication of the RMS current flowing through the power line 112 over a specified current range. In these embodiments, the RMS current delivered to the compressor 104 alone may suffice as the compressor input power parameter measurements. An example of current-measuring device suitable for some HVAC&R applications is a Veris H923 split-core current sensor from Veris Industries that can provide a 0-10 Volt signal in response to a 0-10 Amp RMS current. Other similar current-measuring devices or systems may be employed, appropriate to the expected levels of current in the system.

In some embodiments, instead of (or in addition to) compressor input power parameter measurements, the process of learning the CIPP relation described herein may be performed using an indication of the power being consumed by the HVAC&R system 100 as a whole, via the branch feeder circuit 114, sourced by an AC Mains 118. As noted earlier, many branch feeder circuits have current or power measurement capability built in to their circuit breakers or otherwise embedded that can provide a signal indicative of the input power being used by the system. Some ancillary equipment 116, such as electrical disconnect boxes and the like, include similar current or power measurement capability. Thus, although the present disclosure describes the CIPP relation learning process mainly with respect to compressor input power parameter measurements, those having ordinary skill in the art will appreciate that a relation may also be learned in a similar manner using the alternative (or additional) input power indicators mentioned above.

The measured current or other compressor input power parameter measurements may then be used along with either the intake or discharge fluid temperature of the evaporator ($T_{ei}$ or $T_{ed}$), and either the intake or discharge fluid temperature of the condenser ($T_{ci}$ or $T_{cd}$), to establish the CIPP relation. In some embodiments, and by way of an example only, the particular fluid temperature measurements used may be measurements of the evaporator intake fluid temperature $T_{ei}$ and the condenser intake fluid temperature $T_{ci}$. This is the arrangement depicted in FIG. 3. In other implementations, the fluid temperature measurements used may be measurements of the evaporator discharge fluid temperature $T_{ed}$ and the condenser discharge fluid temperature $T_{cd}$. In still other implementations, a combination of condenser intake and evaporator discharge temperatures may be used, or a combination of condenser discharge and evaporator intake temperatures may be used.

Two fluid temperature measurements (one from either the sensors 302 or 304, and one from either the sensors 306 or 308) along with the compressor input power parameter measurements (from the power parameter meter 312) may then be provided to an HVAC&R monitoring application or agent 314 for determining an expected compressor input power based on the CIPP relation. The HVAC&R monitoring agent 314 may then compare the expected compressor input power to an observed (i.e., measured) compressor input power to detect potential system degradation and problems. The fluid temperature and compressor input power measurements may be provided to the monitoring agent 314 over any suitable signal connection, including wired (e.g., Ethernet, etc.), wireless (e.g., Wi-Fi, Bluetooth, etc.), and other connections. For example, the measurements from the sensors 302, 304, 306, and/or 308 may be provided to the monitoring agent 314 as part of the Internet of Things (IoT).

In some embodiments, the monitoring agent 314 may be implemented as a cloud-based solution or a fog-based solution where a portion or all of the monitoring agent 314 resides or is hosted on a network 316. The network 316 may be a remote network such as a cloud network, or it may be a local network 316 such as fog network. Such a monitoring agent 314 (or portions thereof) may also be integrated into a so-called "smart" thermostat for an air conditioning system or an HVAC&R controller. The "smart" thermostat or HVAC&R controller may include any programmable device that is capable of being configured to input a plurality of data signals (e.g., analog, digital, etc.), execute an algorithm or software routine based on those data signals, and output one or more data signals (e.g., analog, digital, etc.). Other examples of commercially available devices that may be adapted for use with the monitoring agent 314 include commercially available programmable logic controllers (PLC) and building management systems (BMS), both manufactured by Schneider Electric.

Figure 4A:
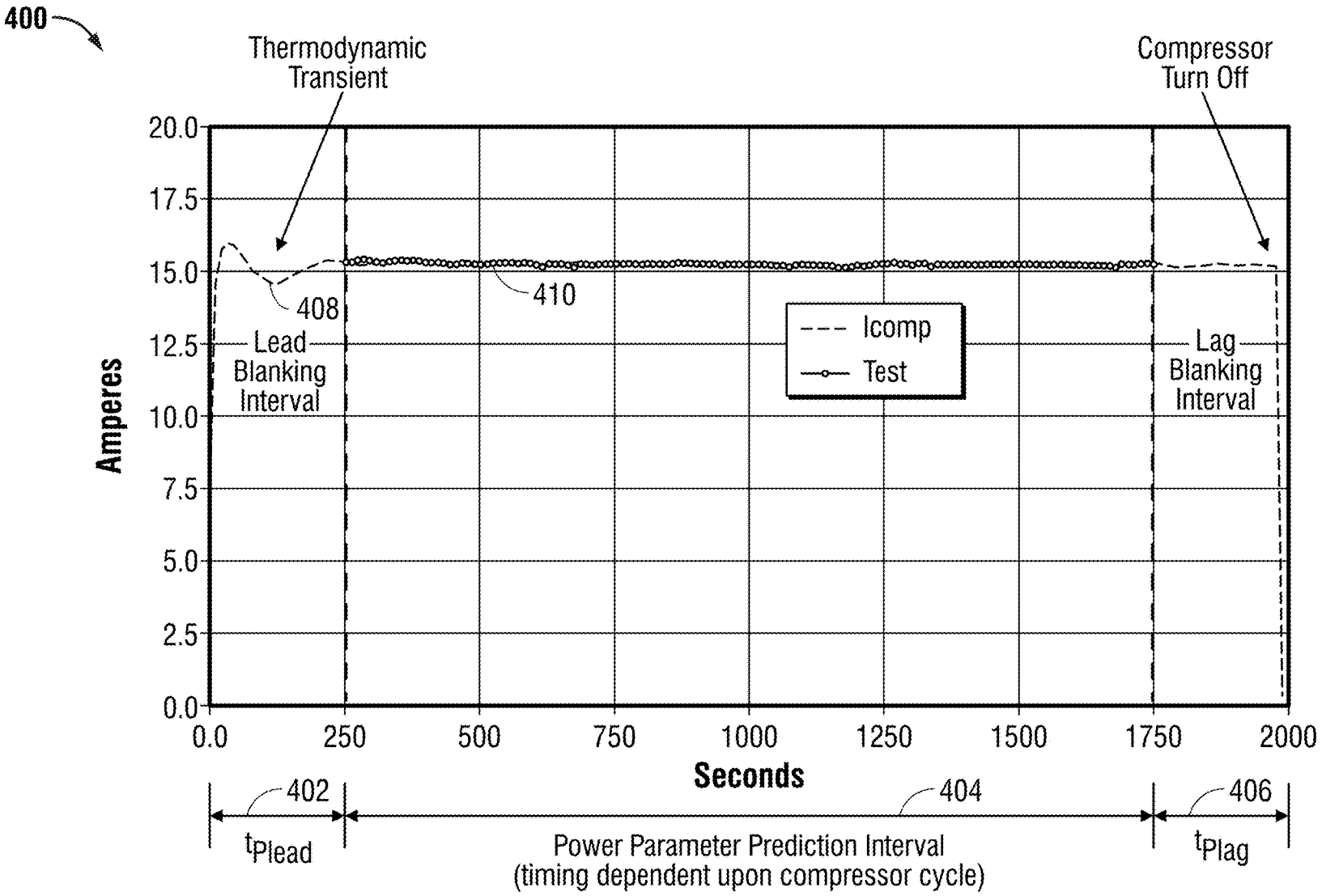
FIGS. 4A and 4B illustrate graphs showing steady state operation of the HVAC&R system according to aspects of the disclosed embodiments.

In HVAC&R systems like the one depicted in FIG. 3, it has been observed that once a system has changed compressor state, either by turning the compressor "ON" in a single compressor system or, more generally, changing the combination of compressor ON/OFF states in a multi-compressor system, accurate predictions of compressor input power parameter are obtained by waiting until the system has been operational long enough that refrigerant states have stabilized in the system, referred to herein as having achieved a "steady state" of refrigerant operation. FIG. 4A illustrates what is meant by "refrigerant steady state" operation of the VCC cycle with respect to the compressor input power parameter, dividing a single VCC cycle into three intervals of operation. Similarly, FIG. 4 B shows a "steady state" of refrigerant operation for the VCC cycle with respect to the temperature drop across the evaporator, again dividing a single VCC cycle into three intervals of operation.

In FIG. 4A, a graph 400 of current (Amperes) versus time (seconds), labeled "Icomp" is shown for a typical "On" cycle of a single compressor system like the system 100 described above. The graph 400 also shows the predicted compressor input current, labeled "Iest," using the CIPP relation learned for this system over this compressor cycle. From the graph, three different intervals of operation can be identified over the compressor cycle, including a power parameter lead blanking interval 402 indicated by a parameter $t_{Plead}$, a power parameter prediction interval 404, where the power parameter value should be predictable from the learned compressor input power parameter relation described above, and a lag blanking interval 406, indicated by a parameter $t_{Plag}$. As a practical matter, only observations in the power parameter prediction interval 404 are useful for training the agent to learn the CIPP relation and to predict equipment condition using this relation. Observations over this power parameter prediction interval are the "refrigerant steady state" observations referred to previously.

The power parameter lead blanking interval 402 refers to the interval immediately after a compressor has been turned on. In a single compressor system, when the compressor has been off and subsequently turned on, there is a transient period that follows where the compressor current, indicated by line 408, is a function not only of the temperatures and mass flow rates, but also of the elapsed time since the compressor turned on. In a multiple compressor system, this transient period occurs any time the combination of compressor On/Off states change. This transient period is in large part system dependent. While the transient behavior may be repeatable, it is usually not predictable using the time invariant CIPP relation. The power parameter lead blanking interval 402 is best needed to ensure observations made during this interval are discarded. In general, the power parameter lead blanking interval 402 should be set long enough to allow the refrigerant loop to reach a "steady state" operation, which can vary depending upon the size and type of system. For instance, in a residential refrigerator, the lead blanking interval may be set to as little as 20-30 seconds and the entire compressor cycle may only last a minute or two, whereas in a large rooftop unit, lead blanking intervals 402 on the order of 5-10 minutes may be required and the compressor may run for hours or even over the course of a day. In some large chillers, blanking intervals as long as 30 minutes and longer are appropriate and the chiller may run for days uninterrupted. In FIG. 4A, this interval is 250 seconds as shown.

The power parameter prediction interval 404 refers to an interval where the agent has declared that the HVAC&R system has reached a steady state for the purposes of power parameter prediction. Observations made during the power parameter prediction interval 404 can be used to inform the CIPP relation and the subsequently learned CIPP relation can be applied to predict the power parameter, indicated by line 410, that should support the temperatures and mass flow rates of the condenser and evaporator fluids. In the simplest of HVAC&R systems, the condenser and evaporator intake temperatures are sufficient to accurately predict the compressor input power parameter, provided nothing has physically changed in the system. As can be seen from FIG. 4A, the predicted current (Iest) 410, valid over the power parameter prediction interval 404, very accurately tracks the measured current 408 when the system is operating properly. The power parameter dynamic prediction interval 404 lasts until just before the compressor again changes to the off state. The power parameter lag blanking interval 406, shown greatly exaggerated in FIG. 4, refers to an interval when the compressor again changes to the "Off" state and is included primarily to facilitate the needs of a sampled data system as will be amplified upon subsequently.

Figure 4B:
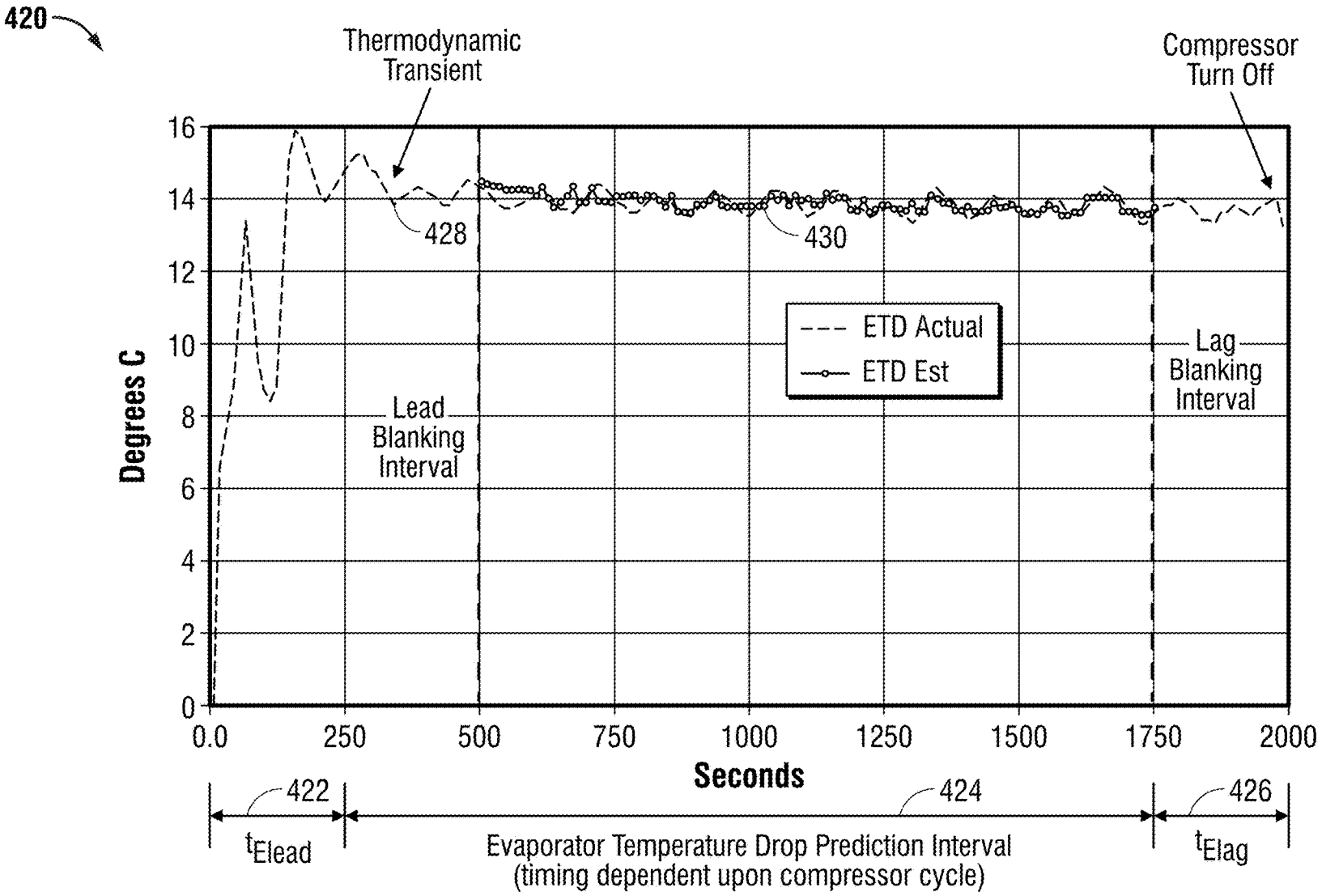

FIG. 4B shows a similar graph 420 for evaporator temperature drop (degrees C.) versus time (seconds) for the same compressor "On" cycle shown in FIG. 4A. The measured evaporator temperature drop is labeled "ETD Actual" (428) and the estimated evaporator temperature drop is labeled "ETD Est" (430) in FIG. 4B. From the graph, three different intervals of operation can be identified over the same compressor cycle as that of FIG. 4A, including an evaporator temperature drop lead blanking interval 422 indicated by a parameter $t_{Elead}$, an evaporator temperature drop prediction interval 424, where the evaporator temperature drop value should be predictable from the learned evaporator temperature drop relation described above, and an evaporator temperature drop lag blanking interval 426, indicated by a parameter $t_{Elag}$. As a practical matter, only observations in the evaporator temperature drop prediction interval 424 are useful for training the agent to learn the ETD relation and to predict equipment condition using this relation. Observations over this evaporator temperature drop prediction interval are referred to as "thermal steady state" observations.

The evaporator temperature drop lead blanking interval 422 refers to the interval immediately after a compressor has been turned on, and may be different in time than the power parameter lead blanking interval 402 of FIG. 4A. This transient period 422 is in large part system dependent. While the transient behavior may be repeatable, it is not predictable using the time invariant ETD relation. The evaporator temperature drop lead blanking interval 422 is best needed to ensure observations made during this interval are discarded. In general, the evaporator temperature drop lead blanking interval 422 should be set long enough not only to allow the refrigerant loop to reach "refrigerant steady state" operation, but also for the bulk condenser and evaporator coil temperatures to stabilize. As in the discussion of FIG. 4A above, this interval is heavily system dependent and is 500 seconds in FIG. 4B as shown.

The evaporator temperature drop prediction interval 424 refers to an interval where the agent has declared that the HVAC&R system has reached a steady state for the purposes of evaporator temperature drop prediction. Observations made during the evaporator temperature drop prediction interval 424 can be used to inform the EDT relation and the subsequently learned EDT relation can be applied to predict the evaporator temperature drop, indicated by line 430, valid over the evaporator temperature drop prediction interval 424. As above, in the simplest of HVAC&R systems, the condenser and evaporator intake temperatures are sufficient to accurately predict the evaporator temperature drop over the evaporator temperature drop prediction interval 424, provided nothing has physically changed in the system. The evaporator temperature drop prediction interval 424 lasts until just before the compressor again changes to the off state. The evaporator temperature drop lag blanking interval 426, shown greatly exaggerated in FIG. 4B, and indicated by the parameter $t_{Elag}$ refers to an interval when the compressor again changes to the "Off" state and is included primarily to facilitate the needs of a sampled data system as will be amplified upon subsequently.

Figure 5A:
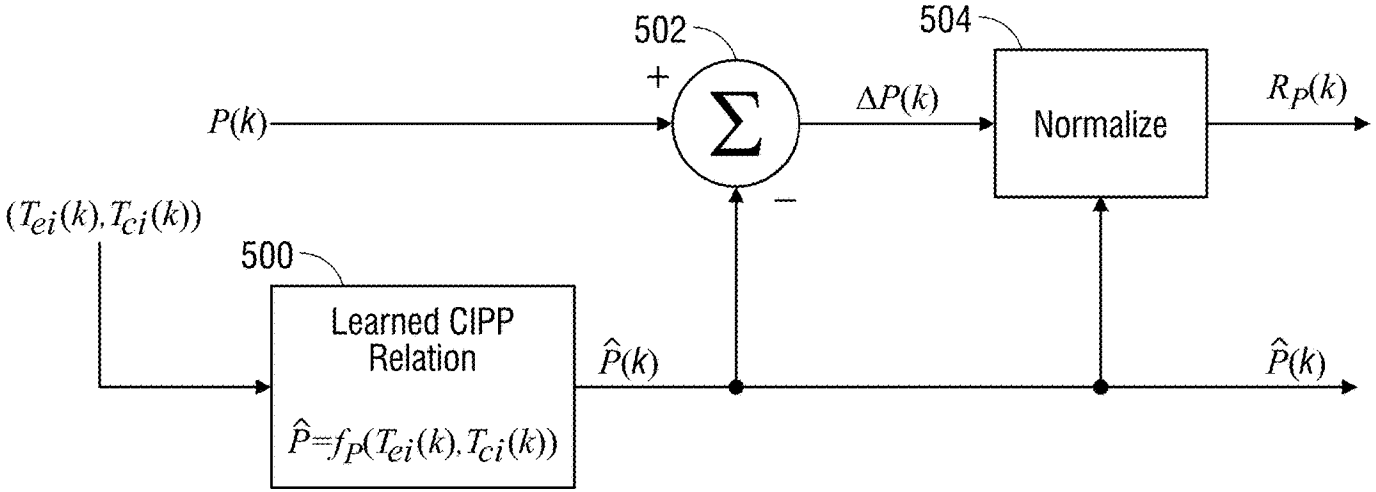
FIGS. 5A and 5B illustrate block diagrams showing how learned relations may be used in a monitoring and early problem detection system according to aspects of the disclosed embodiments.
Figure 5B:
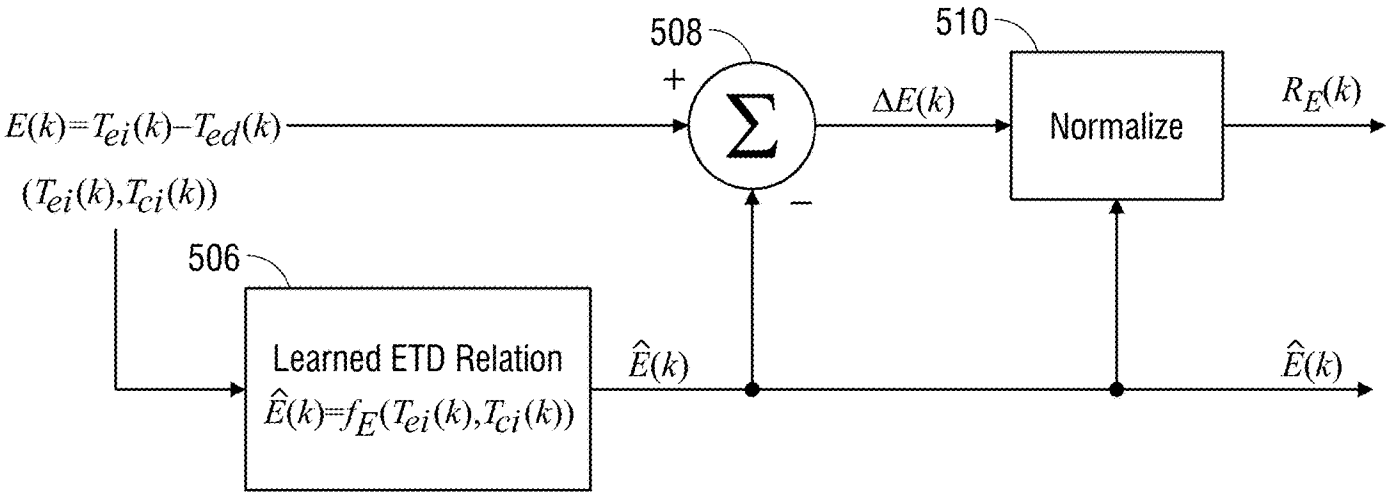

FIGS. 5A and 5B illustrate conceptually how the CIPP and ETD learned relations mentioned earlier may be used by an HVAC&R monitoring agent like the agent 314 according to aspects of the disclosed embodiments. These figures show how the agent 314 may use a previously learned CIPP or ETD relation to produce a time series of normalized residuals that can then be used as a metric to detect potential performance degradations and problems early in the HVAC&R system 100. The term "metric" as used herein may be understood conceptually as a type of "distance" between how a system is presently behaving and how the system should be behaving. A preferred mechanism by which the agent 314 learns the relations (i.e., via a relation learner) will be discussed later herein.

Referring to FIG. 5A, P(k) is the observed compressor input power parameter of the system 100 for the kth observation in a series of observations. In some implementations, observations are also simultaneously made for the evaporator intake fluid temperature $T_{ei}(k)$ and the condenser intake fluid temperature $T_{ci}(k)$. The term "simultaneously" means individual power parameter and temperature measurements are taken quickly in time relative to the thermal time constants of the system 100 which when assembled collectively as an observation may be assumed to represent the "state" of the HVAC&R machine at an instant or over a short window in time. Preferably, the temperature and compressor input power parameter measurements for a given observation are obtained within a time window of several seconds, and preferably by a PLC (programmable logic controller)

based process. Such automated measurement processes can typically obtain measurements at a rate that is more than sufficiently high for the monitoring purposes herein. The HVAC&R system 100 should also be in the refrigerant steady state, i.e., using only refrigerant steady state observations per above, meaning the system has been operating for a long enough time that the refrigerant in the system is in the proper physical state (i.e., liquid or vapor) throughout the system, and heat transfer is proceeding at a substantially constant rate (e.g., within 1%-2%) in both the condenser and the evaporator, that is, within the power parameter prediction interval 404.

With the above established, the agent 314 can compute a sequence of predicted values of power parameter values $\hat{P}(k)$ and a corresponding normalized residual sequence $R_p(k)$ corresponding to the kth observation falling within the power parameter prediction interval 404. In FIG. 5A, for each observation k within the power parameter prediction interval 404, the evaporator intake fluid temperature and the condenser intake fluid temperature tuple ($T_{ei}(k)$, $T_{ci}(k)$) is applied to a learned CIPP relation block 500 where the agent 314 uses the observation and the previously learned CIPP relation to predict the value of the power parameter $\hat{P}(k)$ representing the system 100 in newly maintained condition. From the learned CIPP relation block 500, the agent 314 generates a predicted value of the compressor input power parameter $\hat{P}(k)$ as a function of the learned CIPP relation, as shown in Equation (1):

$$\hat{P}(k) = f_{\hat{P}}(T_{ei}(k), T_{ci}(k)) \tag{1}$$

The predicted compressor input power parameter $\hat{P}(k)$ and an observed value of the compressor input power parameter, P(k), included in the kth observation, are then combined at a summing node 502. The summing node 502 produces a difference compressor input power parameter value, ΔP(k), according to Equation (2):

$$\Delta P(k) = P(k) - \hat{P}(k) \tag{2}$$

The agent 314 thereafter normalizes the difference compressor input power parameter value ΔP(k) at a normalization block 504 to produce a normalized residual compressor input power parameter, $R_p(k)$, as shown in Equation (3):

$$R_P(k) = \frac{\Delta P(k)}{\hat{P}(k)} \tag{3}$$

As Equation (3) shows, the normalized residual $R_P$ (k) corresponding to the kth observation is the ratio of the difference between the measured and the predicted values of the compressor input power parameter ΔP(k) over the predicted value of the power parameter $\hat{P}(k)$. The normalized residual $R_P(k)$ can then be expressed as a percentage by multiplying by 100 to show the percent difference between the expected value of the compressor input power parameter and the observed value of the compressor input power parameter, according to Equation (4):

$$\%R_P(k) = 100 * R_P(k) \tag{4}$$

In a similar manner, FIG. 5B shows a conceptual block diagram illustrating how the agent 314 may use a learned ETD relation to produce a time series of normalized evaporator temperature drop residuals to detect potential performance degradations and problems early in the HVAC&R system 100, with details of learning the relation to be discussed subsequently. Three temperatures corresponding to the kth observation of the system serve as inputs to this process. Observations are again simultaneously made for the evaporator intake fluid temperature, $T_{ei}(k)$, the evaporator discharge temperature, $T_{ed}(k)$, and the condenser intake fluid temperature $T_{ci}(k)$. Again, the term "simultaneously" means the measurements are taken quickly in time relative to the thermal time constants of the HVAC&R system 100. As above, preferably the temperature measurements for a given observation are obtained within a time window of several seconds, and preferably by a PLC based process.

The HVAC& system 100 should also be in the thermal steady state, i.e., using only thermal steady state observations per above, when learning and using the ETD relation, meaning the system has been operating for a long enough time that, not only is the refrigerant in the system is in the proper physical state (i.e., liquid or vapor) throughout the system, but also that heat transfer is proceeding at a substantially constant rate (e.g., within 1%-2%) in both the condenser and the evaporator. This means that the system should be operating long enough that the external temperatures of the heat exchangers, i.e., the surfaces of those heat exchangers in contact with the external fluids described above have also substantially stabilized, that is, within the evaporator temperature drop prediction interval 424. As a practical matter, it has been observed that the time required to attain a thermal steady state per above may be significantly longer than that to obtain a refrigerant steady state, typically on the order of about 8-15 minutes for a simple, residential air conditioner, for example.

Referring to FIG. 5B, the agent 314 computes an evaporator temperature difference, or equivalently evaporator temperature drop, E(k), for this kth observation defined as the difference between the evaporator intake and discharge temperatures for the observation:

$$E(k) = T_{ei}(k) - T_{ed}(k) \tag{5}$$

The evaporator intake fluid temperature $T_{ei}(k)$ and a condenser intake fluid temperature $T_{ci}(k)$ are provided to a learned ETD relation block 506. This learned ETD relation block 506 uses a learned ETD relation (learned via a relation learner, described subsequently) to predict a corresponding expected evaporator temperature drop, $\hat{E}(k)$, as a function of the evaporator intake fluid temperature and the condenser intake fluid temperature tuple ($T_{ei}(k)$, $T_{ci}(k)$) of the kth observation while the VCC cycle is in a thermal steady state as described above, this prediction representing the expected evaporator temperature drop of the HVAC&R system 100 in newly maintained condition:

$$\hat{E}(k) = f_E(T_{ei}(k), T_{ci}(k)) \tag{6}$$

The predicted evaporator temperature drop $\hat{E}(k)$ and an observed value of the evaporator temperature drop, E(k), computed from the temperature measurements of the kth observation using Equation (5), are then combined at a summing node 508. The summing node 508 produces a difference evaporator temperature drop value, ΔE(k), according to Equation (7):

$$\Delta E(k) = \hat{E}(k) - E(k) \tag{7}$$

A normalized temperature drop residual, $R_E(k)$, is then formed in a normalized block 510, as follows:

$$R_E(k) = \frac{\Delta E(k)}{\hat{E}(k)} \tag{8}$$

The result may again be multiplied by 100% to show the percent difference between the expected evaporator temperature drop and that computed using the observed values of evaporator intake and discharge temperatures:

$$\%R_E(k) = 100 * R_E(k) \tag{9}$$

The normalized residuals in FIGS. 5A and 5B above are empirically observed to have properties beneficial to facilitate continuous learning of the CIPP relation and ETD relation even while the system is experiencing performance degradation. While the power consumed by the compressor and the evaporator temperature drop are sensitive functions of the observed temperature tuple ($T_{ei}$, $T_{ci}$), the normalized residuals of both are approximately or quasi-temperature independent. This means that a normalized residual of either compressor input power parameter or evaporator temperature drop computed at one temperature tuple is observed to have approximately the same value as the corresponding normalized residual value at any other temperature tuple within the usual operating temperature range of the system while the physical condition of the system remains unchanged.

The observed quasi-temperature independence of the normalized residuals sequences $R_P(k)$ and $R_E(k)$ serves two useful purposes in the embodiments herein. First, the temperature-independent normalized residuals $R_P(k)$ and $R_E(k)$ can be used directly as metrics to detect system degradation. If the system is in newly maintained condition and in the absence of measurement error, the measured values of the power parameter and that properly predicted by the learned CIPP relation block 500 should agree and the corresponding normalized residual should be zero. Deviation from newly maintained condition due to degradation can be inferred from a non-zero normalized residual of the compressor input power parameter in some implementations, with the magnitude of the deviation used as an indication of the severity of the degradation, i.e., a metric interpreted as a sort of "distance" from normal operation. The sign of the residual, which indicates whether the measured power parameter value is greater than or less than the predicted value, can be used to infer possible causes of the observed degradation and issue an appropriate alert signal. Because of the quasi-temperature independence of the normalized residual, this "distance" does not vary substantially with the measured intake temperatures, $T_{ei}$ and $T_{ci}$. Deviation of the normalized residual or a sequence of normalized residuals of evaporator temperature drop may be used to indicate system degradation in the same manner. In still other implementations, the normalized residuals of power parameter and evaporator temperature drop may be used in combination as an indicator of system degradation. In yet other implementations, the relative COP of the system to be discussed subsequently may be included in the detection of system degradation and provides another metric indicating the resulting loss of system efficiency. As more information is added to the degradation detection process, the ability of the agent to infer the cost and possible cause of the degradation is improved.

The observation that the normalized residuals computed per above are at least quasi-temperature independent also allows the relation learner to "correct" power parameter measurements and evaporator temperature drop measurements for degradation for purposes of learning a CIPP or ETD relation in a manner to be described subsequently. It should be clear from Equation (5) that the evaporator temperature drop E(k) is uniquely determined from a measurement of $T_{ei}$ and $T_{ed}$, and one could equivalently use a learned relation of $T_{ed}$ in FIG. 5B in place of the learned relation for the evaporator temperature drop, predicting a normalized residual of evaporator temperature drop by subtracting the predicted value of $T_{ed}$ from the measured value of $T_{ei}$. However, while the residual of the evaporator temperature drop is quasi-temperature independent, the residual of the evaporator discharge temperature is not. Using a learned relation of evaporator temperature drop greatly simplifies the process of learning the relation while the system is degrading, an important feature of the present invention. And as will be seen, a relative COP can be directly computed from the predicted evaporator temperature drop. Accordingly, while either relation can be implemented and equivalent results achieved, a learned ETD relation is preferable over a learned $T_{ed}$ relation in the embodiments herein.

Figure 6:
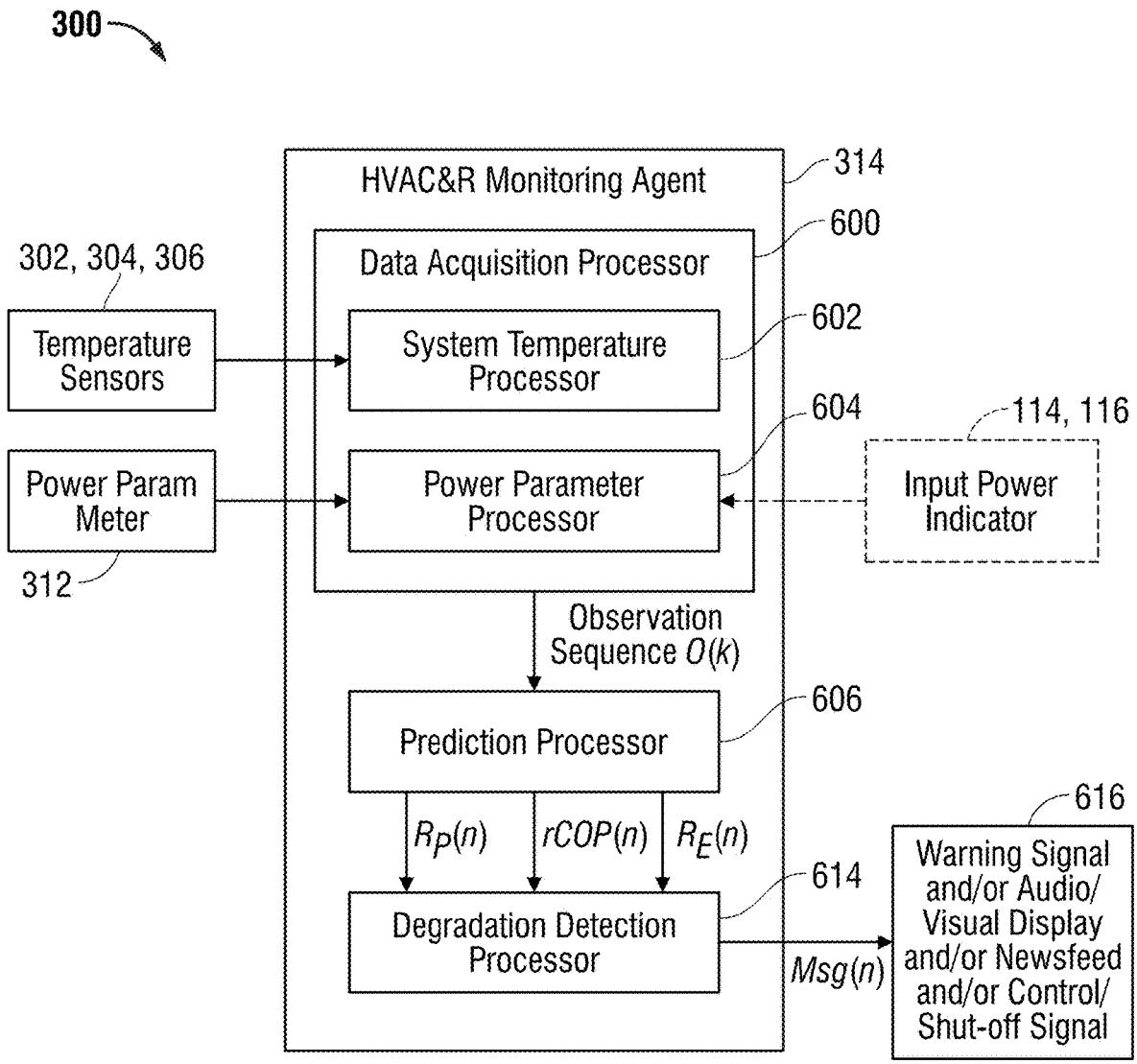
FIG. 6 illustrates an exemplary implementation of a monitoring agent according to aspects of the disclosed embodiments.

FIG. 6 illustrates an exemplary implementation of the HVAC&R monitoring application or agent 314 from FIG. 3. The HVAC&R monitoring application or agent 314 may be composed of several functional components, including a data acquisition processor 600, a prediction processor 606, a degradation detection processor 614, and several sub-components that are discussed in more detail further below. Each of these functional components 600, 606 and 614 (and sub-components) may be either a hardware-based component (e.g., run by an ASIC, FPGA, etc.), a software-based component (e.g., run on a network, etc.), or a combination of both hardware and software (e.g., run by at least one microcontroller with at least one onboard and/or separate storage/memory device storing non-transitory computer-readable instructions, etc.). In addition, while the functional components 600, 606 and 614 (and sub-components) are shown as discrete blocks, any of these blocks may be divided into several constituent blocks, or two or more of these blocks may be combined into a single block, within the scope of the disclosed embodiments. Following is a description of the operation of the various functional components 600, 606 and 614 (and sub-components).

The data acquisition processor 600 operates to acquire and store fluid temperatures and power parameter values continuously and from these values pre-processes and assembles them into time sequences of observations that can be used by the prediction processor 606. These time sequences, called "observations" herein are referred to as observation sequence O(k) in FIG. 6. The prediction processor 606 accepts the sequence of observations and in some implementations can selectively use the observations to learn a CIPP relation and generate a normalized power parameter residual sequence $R_P(n)$, presenting this sequence to degradation detection processor 614 for analysis. The prediction processor 606 can also, in some implementations selectively use the observations to learn an ETD relation and generate a normalized ETD residual sequence $R_E(n)$, presenting this sequence to degradation detection processor 614 for analysis. In systems incorporating both a CIPP relation and ETD relation, the prediction processor 606 can use results from the CIPP relation and ETD relation to selectively generate a sequence of relative COP values, rCOP(n), that can be presented to the degradation detection processor 614 for analysis.

The degradation detection processor 614 operates to interpret the time sequence of normalized residuals and relative COP sequence and generate messages Msg(n) that can issue or be issued as warning signals or messages or audio-visual displays, or send the messages as information via newsfeeds, as generally indicated at 616, to notify of potential problems with the HVAC&R system. In some implementations, the degradation detection processor 614 can also (or alternatively) send the normalized residual sequences $R_P(n)$ and $R_E(n)$ and the relative COP sequence rCOP(n) along with other observational and state information as messages Msg (n) to be interpreted by systems external to the HVAC&R monitoring agent 314 for further analysis.

As discussed, the data acquisition processor 600 operates to acquire and store fluid temperatures and power parameter values continuously and from these values and optionally other inputs, assembles and pre-processes them into a time sequence of observations, indicated by O(k), that can be used by the prediction processor 606. While there are many ways to accomplish the above, as previously mentioned, programmable logic controllers, such as the model M251 manufactured by Schneider Electric, are ideally suited for this task. In the example shown, the data acquisition processor 600 includes a system temperature acquisition processor 602 which operates to acquire and store fluid temperature measurements for the agent 314 continuously or on a regular basis. The data acquisition processor 600 also includes a power parameter acquisition processor 604 which acquires and stores measurements of one or more compressor input power parameters as measured by the power parameter meter 312 (see FIG. 3) continuously or on a regular basis. These one or more compressor input power parameters may include real power, reactive power, apparent power, and current consumed by the compressor 104, and voltage as well in some implementations. Alternatively, as explained above, where the agent 314 is being used to predict compressor input current, measurement of the RMS current delivered to the compressor 104 by itself may suffice.

The temperature measurements and the power parameter measurements are often referred to herein as "observed" temperature and power parameter. In some embodiments, the data acquisition processor 600 collects and assembles sets of measurements of fluid temperatures and power parameters into "observations." Temperatures and power parameters in an observation are represented by a single number representative of the corresponding temperature or power parameter at an instant or over an interval of time. The number representing the corresponding temperature or power parameter may be a single measurement, or may be derived as a function of a plurality of measurements, such as the average of a number of measurements taken over the interval to be represented by the observation. Other functions are, of course, possible using well understood digital signal processing techniques.

Table 1 below shows an exemplary "observation" that may be provided by the data acquisition processor 600 to the prediction processor 606, indicated by O(k) in FIG. 6, where "k" is an index indicating the kth such observation provided in a time sequence.

TABLE 1

| Exemplary Observation Content | | | | |
|---|---|---|---|---|
| Time Stamp (TS) (optional) | $T_{ci}$ | $T_{ei}$ | $T_{ed}$ | Power Parameter P |
| Date/Time represented by observation | Sensor Reading(s) | Sensor Reading(s) | Sensor Reading(s) | Sensor Reading(s) |

In Table 1, the exemplary observation contains $T_{ci}$ data, $T_{ei}$ data, and $T_{ed}$ data that include a condenser intake temperature measurement, evaporator intake temperature measurement and evaporator discharge temperature, respectively, or a signal processed batch of such temperature measurements, representative of the external temperatures of the system at a point in time or over an interval of time. These fluid temperature measurements are acquired from the temperature sensors 302, 304 located at or near the evaporator and condenser intakes, and the temperature sensor 306 located at or near the evaporator discharge as shown in FIG. 3. In some embodiments, the condenser exhaust temperature $T_{cd}$ may be substituted for the condenser intake temperature $T_{ci}$ in the fluid temperature measurements acquired and preprocessed by the system temperature processor 502. Alternatively, room temperature measurements (e.g., from a thermostat) may be used as a proxy for measurements of the evaporator intake fluid temperature $T_{ei}$ rather than directly measuring the evaporator intake fluid temperature in direct exchange air conditioning applications or as a proxy for the condenser intake fluid temperature $T_{ci}$ in heat pump applications and many refrigeration systems. In systems where only the CIPP relation and power parameter residual sequences are implemented and used to detect system degradation, the evaporator discharge temperature is not needed. In refrigeration applications (including freezers), the temperature of the internal compartment directly cooled by the evaporator may be used as a proxy for evaporator intake temperature. Other temperature proxies that track or are suitably responsive to the various intake and discharge temperatures discussed herein may also be used within the scope of the disclosed embodiments. These include measured outdoor temperatures or temperature estimates obtained from weather services or forecasts.

Further, an observation may also contain power parameter data in some embodiments, including a measurement, or function of measurements per above, for one or more power parameters measured by the power parameter meter 312 at the same or near in time to the temperature measurements. An example of a power parameter than can be included as power parameter data in the observation is the compressor input current.

Also shown in Table 1 above is an optional time stamp or tag indicating the date and time instant or interval represented by the measured temperature and power parameter values included in the observation. In some implementations, including a time stamp or tag in an observation or data frame from which the date and time intended to be represented by each measurement in an observation can be inferred can be beneficial to the implementation. The time stamp or tag is particularly useful when individual observations are stored in databases for future retrieval, or when a group or batch of several observations are assembled into a data frame, which may then be transferred across network communication links. For example, data frames of observations may be sent over the Internet to a web service where the agent 314 (or portion thereof) reads the data frames, processes the observations within data frames (using the time tags as needed to maintain order), and provides the result for appropriate action by the HVAC&R monitoring and early problem detection system 300. In other embodiments, such as in building management systems, PLCs, and dedicated controllers, an observation would proceed serially through the system directly without intermediate storage beyond delay lines required to determine steady state operation. In these systems, an observation generally does not need to be associated with a time tag.

It should be understood that since the evaporator intake temperature $T_{ei}$, evaporator discharge temperature, $T_{ed}$ and evaporator temperature drop E are related by Equation (5), alternative and mathematically equivalent representations can be made by substituting the evaporator temperature drop E for either $T_{ei}$ or $T_{ed}$ in Table 1 above. For an observation, given any two of either $T_{ei}$ or $T_{ed}$ and E, the third may be immediately derived as needed using Equation (5). In what follows, the representation of the observation provided in Table 1 is considered exemplary only.

The time sequence of observations, denoted O(k) and comprising the measurements and optional time stamp of Table 1 above is forwarded from the data acquisition processor 600 to the prediction processor 606 either one at a time or in a batch data frame as described above. In accordance with the disclosed embodiments, the prediction processor 606 is operable to derive or learn the CIPP relation and ETD relation from the observations O(k) provided by data acquisition processor 600 and use the relations to create normalized residual sequences for both the power parameter(s) and the evaporator temperature drop and further create a relative COP sequence, each of which can be used by degradation detection processor 614 to monitor the system for performance degradation.

FIGS. 6A-6I show additional details for the exemplary implementation of the HVAC&R monitoring agent 314 from FIG. 6.

Figure 6A:
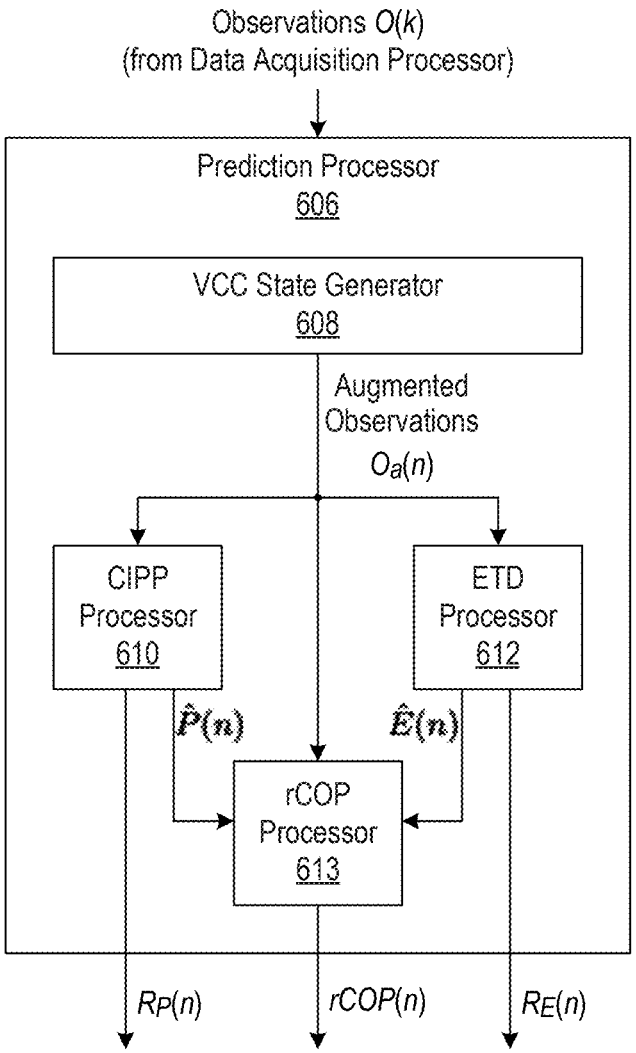
FIG. 6A illustrates an exemplary prediction processor according to aspects of the disclosed embodiments.

Referring to FIG. 6A, an expanded view of the exemplary prediction processor 606 from FIG. 6 is shown illustrating additional details thereof and information flow therein. In some implementations, the prediction processor 606 includes a VCC state generator 608 that receives the sequence of observations O(k) from the data acquisition processor 600 and augments that sequence with state information derived from the sequence O(k) in a manner to be described subsequently. The output of VCC state generator is an augmented sequence $O_a(n)$, with the new index "n" indicating that the VCC state generator 608 has delayed the timing of the raw observation sequence O(k) to accomplish the augmentation.

The state augmented observation sequence $O_a(n)$ furnished by VCC state generator 608 serves as input to a CIPP processor 610 (or other input power parameter relation processor), an ETD processor 612 (or other temperature parameter relation processor), and an rCOP processor 613. The CIPP processor 610 uses the augmented observation sequence $O_a(n)$ to learn the CIPP relation discussed above and outputs a sequence of power parameter predictions $\hat{P}(n)$ (as will be described subsequently) and a sequence of normalized residuals $R_P(n)$ described by Equation (3). The sequence of power parameter values $\hat{P}(n)$ serves as an input to relative COP processor 613. The sequence of normalized residuals $R_P(n)$ is furnished directly to the degradation detection processor 614 as an output of the prediction processor 606.

Similarly, the ETD processor 612 uses the augmented observation sequence $O_a(n)$ to learn the ETD relation discussed above and outputs a sequence of evaporator temperature drop value predictions $\hat{E}(n)$ (as will be described subsequently) and a sequence of normalized residuals $R_E(n)$ described by Equation (8). The sequence of predicted evaporator temperature values $\hat{E}(n)$ serves as an input to the relative COP processor (or rCOP processor) 613. The sequence of normalized residuals of evaporator temperature drop $R_E(n)$ is furnished directly to the degradation detection processor 614 as an output of prediction processor 606.

The relative COP processor 613 accepts and processes the state augmented observations $O_a(n)$ from the VCC state generator 608, the power parameter prediction sequence $\hat{P}(n)$ from the CIPP processor 610, and the evaporator temperature drop prediction sequence $\hat{E}(n)$ from the ETD processor 612, and selectively computes a sequence of relative COP values, rCOP(n) corresponding to $O_a(n)$, which is then furnished to the degradation detection processor 614.

As described above, the VCC state generator 608 derives certain timing information about the state of the VCC cycle in the system and augments the observations therefrom with this information to inform and control downstream processing, such as by the CIPP relation processor 610, the ETD relation processor 612 and the rCOP processor 613. The augmented observations, denoted $O_a(n)$, are delayed relative to the original observations due to the augmentation.

Figure 6B:
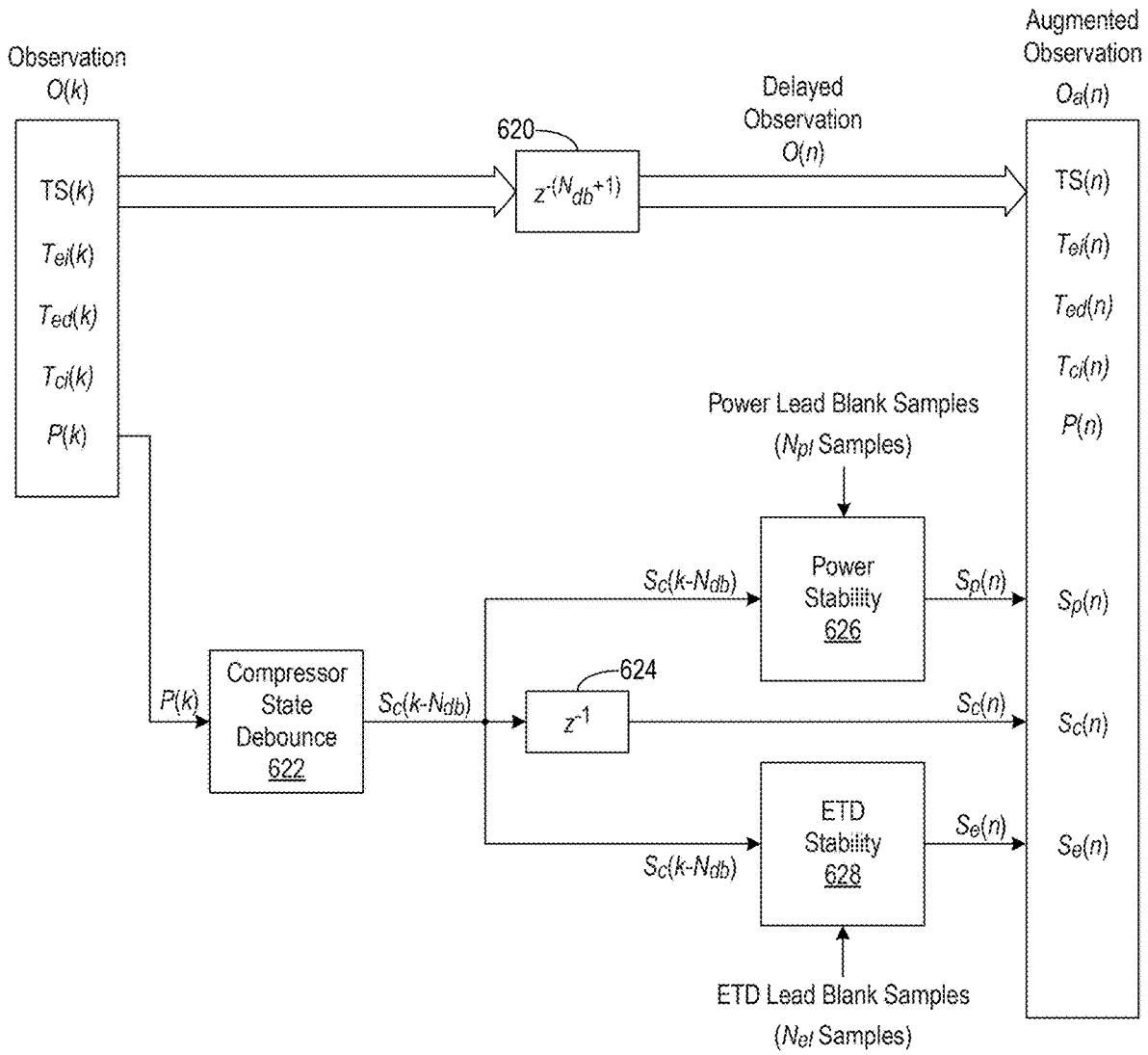
FIG. 6B illustrates a flow diagram for an exemplary VCC state generator according to aspects of the disclosed embodiments.

FIG. 6B is a diagram showing an exemplary flow of information through the VCC state generator 608. In the figure, O(k) denotes the kth raw observation comprising the information from Table 1 above received by the VCC state generator 608 from the data acquisition processor 600. To derive timing information from the sequence of observations O(k) and augment each observation with the appropriate state information requires that the observation sequence be delayed by a specified number of sample periods, $N_{db}+1$, in this implementation, where $N_{db}$ is an integer machine constant referred to as the compressor state debounce count (discussed later herein). The delay is represented here by delay function 620 to indicate the delay in the time sequence of $N_{db}+1$ samples. The resulting delayed observation is denoted O(n), with the new index "n" related to the original index "k" by:

$$n = k - N_{db} - 1 \tag{10}$$

This delayed observation becomes part of an "augmented observation," indicated by $O_a(n)$, along with three new time sequences of information in some embodiments, derived from the sequence O(k). The three new sequences of information augmenting the original but delayed observation are (i) $S_c(n)$, representing ON/OFF state of a simple, single compressor system, or the integer encoded compressor state of a multi-compressor system, (ii) a power state variable $S_p(n)$ indicating the suitability of the delayed observation O(n) for learning and predicting power parameter values and relative COP of compressors deemed "ON" in the associated compressor state $S_c(n)$, and (iii) an evaporator temperature drop state variable $S_e(n)$, indicating the suitability of the delayed observation O(n) for learning and predicting evaporator temperature drop and relative COP for compressors deemed "ON" in the associated compressor state. $S_p(n)$ and $S_e(n)$ signify, when TRUE, that the observation $O_a(n)$ represents operation within the power parameter prediction interval 404 and evaporator temperature drop prediction interval 424 respectively for compressors in the ON state. As these state variables are generated by the VCC state generator 608, the sequences generated are delayed appropriately to be aligned with the delayed observation sequences $O_a(n)$ in a manner to be described subsequently. While there are many ways to implement these state variables, the embodiment herein may be considered preferred, since it readily extends to multiple-compressor systems.

To generate the sequence $S_c(n)$ in the augmented observation $O_a(n)$, a compressor state debounce function 622 determines and encodes the ON/OFF state of each compressor in the system, implicitly using the machine constant $N_{db}$. The output of this debounce function 622 is the sequence $S_c(k-N_{db})$, which is then delayed by one sample in delay function 624 and applied directly to the augmented observation $O_a(n)$ as $S_c(n)$. The sequence $S_c(k-N_{db})$ also serves as input to a power stability function 626 with parametric input $N_{pl}$, and in ETD stability function 628 with parametric input $N_{el}$, resulting in the sequences $S_p(n)$ and $S_e(n)$ of augmented observation $O_a(n)$. It should be noted in this example that for a single compressor system such as that of FIG. 3, the "observations" include a single power parameter. Those having ordinary skill in the art will understand that the principles and teachings herein are also applicable to systems in which multiple power parameters are acquired for multiple compressors.

Figure 6C:
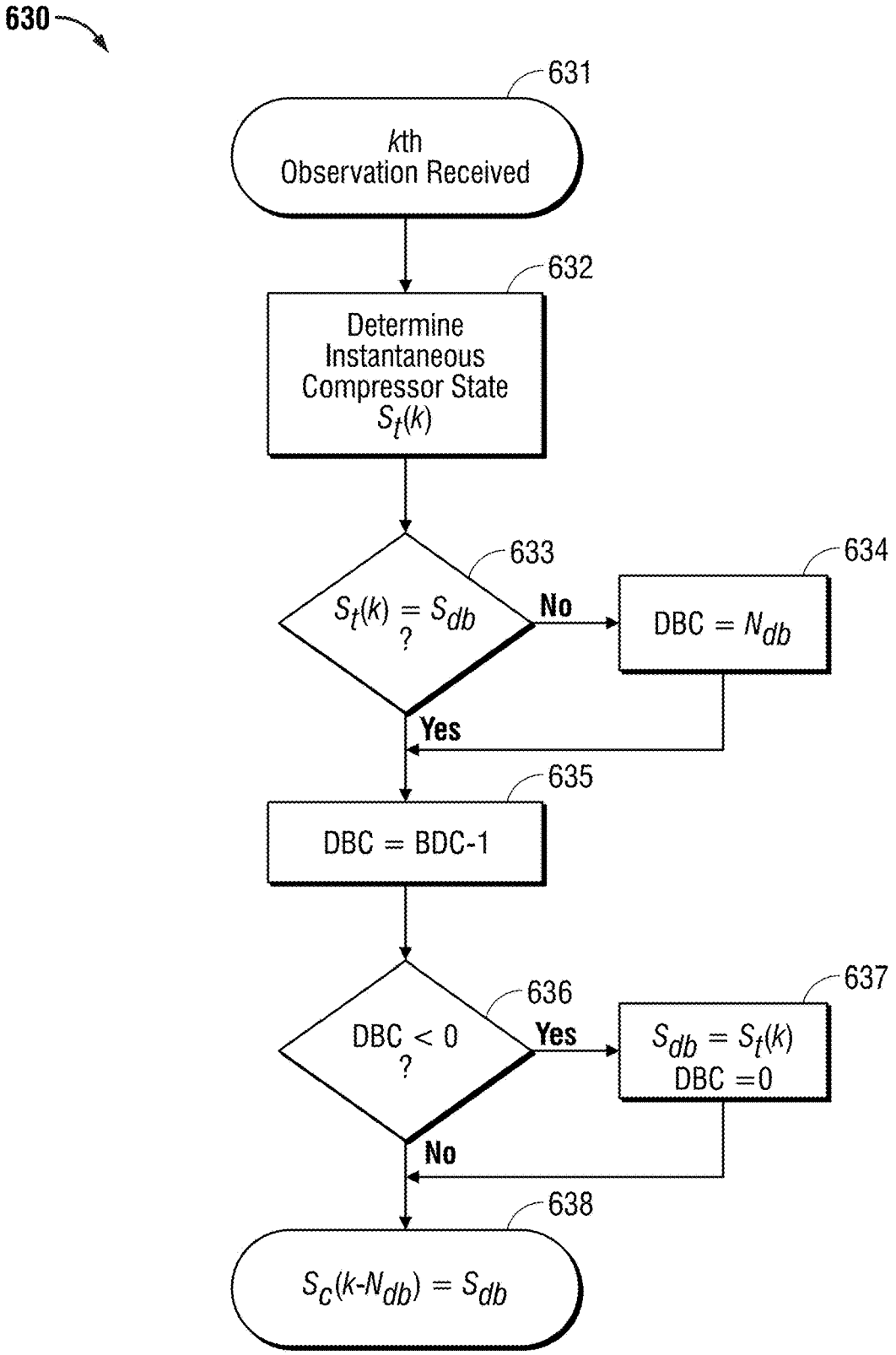
FIG. 6C illustrates a flowchart for an exemplary debounce logic that may be used with the VCC state generator according to aspects of the disclosed embodiments.

FIG. 6C shows an exemplary flowchart 630 illustrating an exemplary debounce logic that may be used with the debounce function block 622 in some embodiments. The debounce logic shown in flowchart 630 is suitable for use in embodiments having either a single compressor or multiple compressors. The purpose of the debounce function is to defer the declaration of a change in compressor state until the new state has been observed for a certain number of contiguous samples defined by the debounce machine constant $N_{db}$. The delay in declaring the compressor state is to ensure that the debounced state of a sample represents the "true" state of the system at the time of the observation, with a typical value of $N_{db}$ being in the range of three to five samples. The debounce function provides this internal value as the output $S_c(k-N_{db})$.

The debounce logic maintains two internal state variables. An internal compressor state variable, $S_{db}$, maintains the present debounced state of the compressor as declared by the debounce logic. An internal counter, DBC, is used to facilitate the delay of transition of declared compressor state. The internal compressor state variable $S_{db}$ is typically initialized to a value 0, indicating all compressors in the system are declared OFF (including the single compressor in a simple HVAC system 100 described above), and DBC is initialized to the value $N_{db}$ above.

Entry into the flowchart 630 begins with receipt of the kth observation O(k) at block 631, where the power parameters of the kth observation are extracted from the observation. One power parameter is extracted per compressor, preferably each power parameter being uniquely responsive to the electrical current flowing to an individual compressor, meaning the power parameter representing one compressor does not include, or is a function of, other compressor currents. Such would be the case when a single current transformer is used to measure the compressor current for a single compressor. At block 632, the "instantaneous state" of each compressor is determined by comparing the power parameter value to a threshold value either unique to each compressor or a system-wide threshold to determine whether the individual compressor is in an ON state, as indicated by the power parameter value for that compressor exceeding the threshold or the OFF state if the power parameter value for that compressor is less than or equal to the threshold in one embodiment. In one embodiment, the instantaneous ON/OFF state of each compressor is encoded into a number, such as a binary number. An example of such an encoded number is shown in Table 2 below for an M-compressor system:

TABLE 2

Compressor ON/OFF State Encoding for an M-compressor System as an M-bit Binary Representation

| Bit M-1 Compressor M | Bit M-2 Compressor M-1 | . . . | Bit 1 Compressor 2 | Bit 0 Compressor 1 |
|---|---|---|---|---|
| ON = 1<br>OFF = 0 | ON = 1<br>OFF = 0 | | ON = 1<br>OFF = 0 | ON = 1<br>OFF = 0 |

The result of such an encoding is a number, represented as $S_t(k)$, that may change from observation to observation as individual compressor states change. For example, in a single compressor system, this number will range between "0" (compressor OFF) and "1" (compressor ON). In an M-compressor system, the number will range between 0 (all compressors OFF) and $2^M$ (all compressors ON). The internal representation of the debounced compressor state is in the encoded format of Table 2.

Once the instantaneous state of each compressor is determined and encoded as $S_t(k)$, the debounce logic then compares $S_t(k)$ to the stored state, $S_{db}$, at block 633. If the observed state $S_t(k)$ and the declared state $S_{db}$ are different, then it is possible that one or more of the compressors has changed state, but as described above, it is desired to defer declaring that state change until the new state has been observed for $N_{db}$ observations in a row. Accordingly, if the instantaneous compressor state has changed at block 633, then in the present example, the debounce counter is loaded with the value $N_{db}$ in at block 634. The flowchart then proceeds to block 635 where the debounce counter DBC is decremented by one or some other predefined decrement. On the other hand, if the instantaneous state $S_t(k)$ and the previously stored state $S_{db}$ agree at block 633, then control passes to block 635 where the debounce counter DBC is decremented.

At block 636, a determination is made whether the debounce counter DBC is less than zero. If yes, then control passes to block 637, where the internal state variable $S_{db}$ is set to $S_t(k)$, and the debounce counter DBC is set to a value of zero in anticipation of the next observation. Control then passes to block 638. If at block 636, the debounce counter DBC is determined to be greater than or equal to zero, control passes directly to block 638. At block 638, the control logic returns the present value of $S_{db}$ as the compressor state, $S_c(k-N_{db})$.

The output of the compressor state debounce function 622 is then declared to represent the "true" or "derived" state of the compressors for the raw observation $O(k-N_{db})$. That this is correct is evident by noticing that if one or more of the compressor states changes in the kth observation, then the output of the compressor state debounce function 622 changes to match this observation $N_{db}$ samples later. The resulting output of the compressor state debounce function 622, labeled $S_c(k-N_{db})$, is delayed by one sample in delay block 624, resulting in the compressor state sequence $S_c(n)$ before being incorporated in the augmented observation $O_a(n)$.

Referring again to FIG. 6B, a power stability function 626 is provided to compute the power parameter lead blanking, power parameter lag blanking and power parameter prediction intervals of FIG. 4A. A separate ETD stability function 628 is provided to compute the evaporator temperature drop lead blanking, evaporator temperature drop lag blanking, and evaporator temperature drop prediction intervals of FIG. 4B. The need for and functionality of the power stability function 626 and the ETD stability function 628 are best understood by first considering a simple, single compressor system 100, such as that shown in FIG. 3. When the compressor has been OFF for a long time in such a system 100, the pressure of the refrigerant throughout the system tends to equalize such that the refrigerant is in a pure vapor state throughout, and the temperature of the evaporator and condenser coils tend toward the temperature of the ambient conditions in which they operate in accordance with the laws of thermodynamics. Turning the compressor ON causes the system to migrate in operation toward another quasi-steady state, where the refrigerant states are driven to the liquid and vapor states described in the discussion of the VCC cycle above by virtue of the mechanical action of the compressor, and the corresponding power consumed to move the refrigerant through the system stabilizes as the level of liquid refrigerant in the condenser also stabilizes. The time required to achieve this is referred to previously as the "power parameter lead blanking interval" 402 of FIG. 4A.

As a practical matter, the system of discourse is usually implemented as a sample-data system in which the sample period may be long with respect to the time required to turn the compressor off. For instance, the time required to completely remove power from a compressor and therefore disrupt the VCC cycle may be on the order of 10 to 50 milliseconds whereas the sampling period of the sample-data system to achieve accurate results while the system has been operating for some time may be much longer, on the order of several seconds or even minutes in some implementations. Additionally, as described above, the value of the power parameter furnished by data acquisition processor 600 often represents the average of the power parameter value over the sample period. In such systems, the power parameter value of the last sample of the system in a compressor cycle in which the compressor changes state sometime within the sampling interval may range between nearly zero in the case where the compressor is turned off at the very beginning of the interval and the full value of the power parameter where the compressor turns off near the very end of the interval. The resulting average value of the power parameter over this last sample interval may not represent the true value of the power parameter within that interval, which could result in an inappropriate value being learned or an inappropriate normalize residual being generated. As such, especially in some implementations that employ averaging a number of power parameter measurements over several seconds in constructing the power parameter component of the observation, it is it is important to ignore this last sample of the compressor cycle, i.e., the sample just before the compressor is first detected in the OFF state by compressor state debounce function 622 in the case of a simple single compressor system or, more generally, when one or more compressors change state in a multi-compressor system. This is referred to previously as the power parameter lag blanking interval 406 in FIG. 4A.

The identical problem exists for the evaporator temperature drop. For the evaporator temperature drop to stabilize, not only must the conditions for stability of the power parameter be met, but the rate of heat transfer from the evaporator coil to the evaporator ambient fluid must also stabilize. Indeed, in some cases, the evaporator temperature drop lead interval for evaporator temperature drop can be significantly longer than that required for the power parameters to stabilize, whereas the requirements for the evaporator temperature drop lag interval 426 are identical to that of the power parameter lag interval 406. Accordingly, some state logic is needed to determine when an observation is valid and stable for purposes of learning the associated property (either power parameter or evaporator temperature drop). The form of this stability logic may be identical for both properties (power parameter or evaporator temperature drop), differing only by the lead blanking time.

The stability logic indicating suitability of an observation for power parameter or evaporator temperature drop learning and prediction is implemented in the VCC state generator 608 via the power parameter stability function 626 and the ETD stability function 628. These stability functions have as outputs the state sequence $S_p(n)$ and $S_e(n)$ respectively. The state sequence $S_p(n)$ indicates that the augmented observation lies with the power parameter prediction interval 404 of the VCC process when it takes the value TRUE, indicating an observation is suitable for use in learning and predicting the power parameter(s) of compressors in the ON state, and FALSE when the observation is not. Similarly, the state sequence $S_e(n)$ indicates that the augmented observation lies with the evaporator temperature drop prediction interval 424 of the VCC process when it takes the Boolean value TRUE, indicating an observation is deemed suitable for learning and predicting the evaporator temperature drop if at least one compressor is in the ON state and FALSE if not.

Figure 6D:
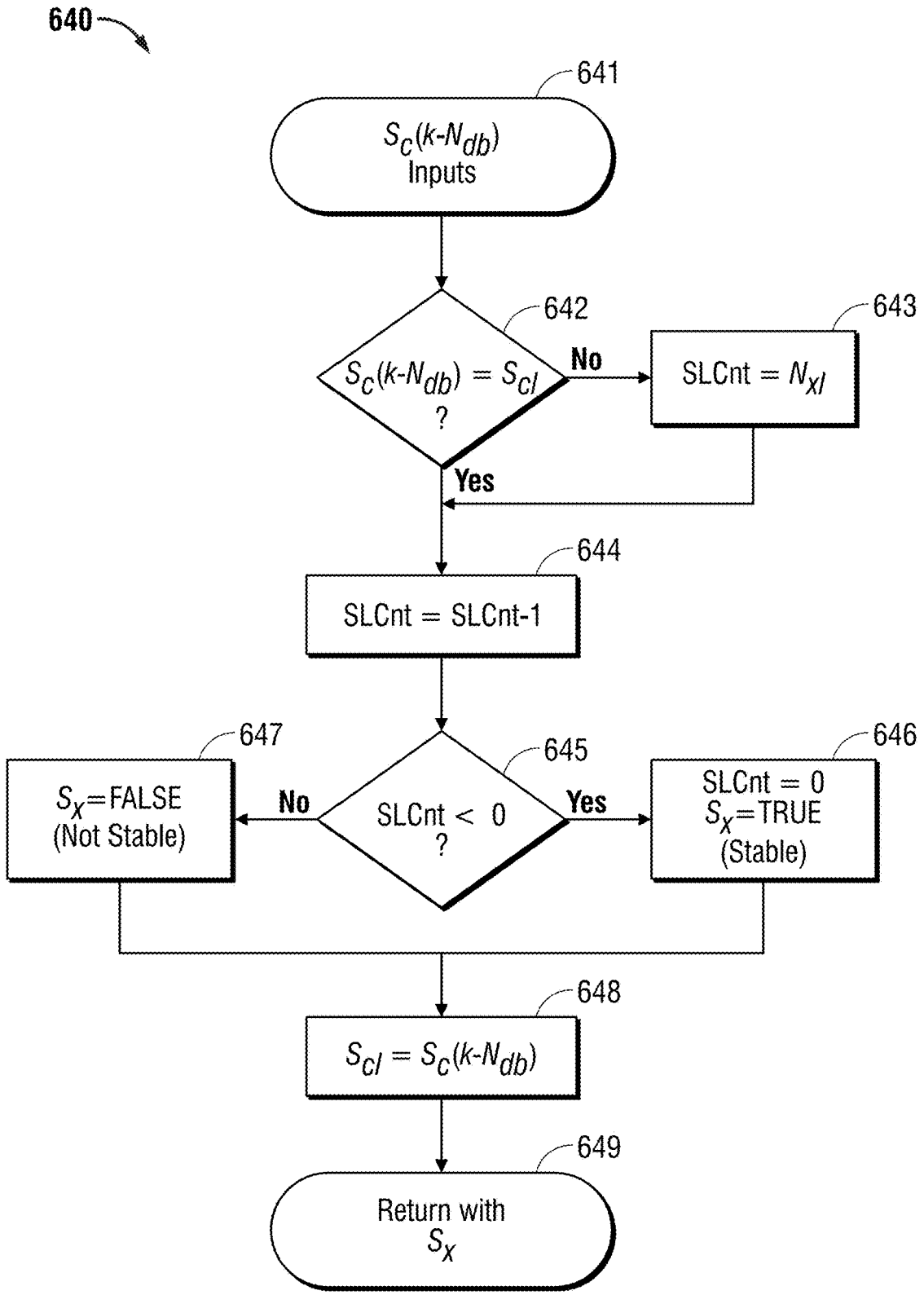
FIG. 6D illustrates a flowchart for an exemplary stability logic that may be used with the VCC state generator according to aspects of the disclosed embodiments.

FIG. 6D shows an exemplary flowchart 640 illustrating an exemplary stability logic that may be used with the power parameter stability function 626 and the ETD stability function 628 according to one embodiment. The flowchart 640 represents one implementation of this stability function and may be used for both the power parameter stability function 626 and the ETD stability function 628, differing only by a parameter denoted $N_{xl}$ intended to represent the corresponding lead blanking interval, with $N_{xl}$ taking on the value $N_{pl}$ in the case of the power parameter stability function and a separate, perhaps larger value $N_{el}$ in the case of evaporator temperature drop stability function $N_{pl}$ and $N_{el}$ are stored as machine constants in some implementations.

Referring back to FIG. 6B, the input to both the power parameter stability function 626 and ETD stability function 628 is the debounced compressor state $S_c(k-N_{db})$ (furnished by the compressor state debounce function 622). As the flowchart 640 in FIG. 6D suggests, computation of $S_c(k-N_{db})$ occurs before executing the stability functions for the kth observation. Internally, each instance of the stability function maintains an internal counter, SLCnt, an internal state variable $S_{cl}$ intended to represent the delayed state of the compressors from the previous observation, i.e., $S_c(k-N_{db}-1)$. In some instances, the counter SLCnt is initialized to the value $N_{xl}$, where $N_{xl}$ is a parameter that is dependent on the individual function implemented, and the internal state variables $S_{cl}$ is initialized to indicate all compressors in the OFF state to facilitate repeatable behavior on system start-up.

Upon entry to the flowchart 640 at block 641, a determination is made at block 642 whether the result of executing compressor state debounce function 622 for the kth observation has changed since that generated for the previous observation, maintained as per above by $S_{cl}$. If so, control passes to block 643, which loads the counter SLCnt with a value $N_{xl}$, where $N_{xl}$ is the desired lead blanking interval for the specific stability function (i.e., the lead blanking intervals 402 and 422 for the power parameter and evaporator temperature drop, respectively) expressed as an integer number of sample periods. Control then passes to block 644, which decrements the counter SLCnt by one or another predefined decrement, which may result in a negative number in SLCnt. If it is determined in block 642 that the compressor state has not changed since the previous observation, control passes directly to the counter decrement block 644.

From block 644, control passes to block 645, which checks whether the counter SLCnt is less than zero. If so, control passes to process block 646, where the counter SLCnt is loaded with the integer value "0" for use on the next observation and a temporary internal state variable $S_x$ is set TRUE, indicating that the observation of discourse is within the associated prediction interval (i.e. the power parameter prediction interval 404 or evaporator temperature drop prediction interval 424 as appropriate). Control then passes to block 647 for further operations. If in block 645 the counter SLCnt is greater than or equal to zero, then control instead passes to block 647, where $S_x$ is set to a logic FALSE, indicating that the observation of discourse is not within the associated prediction window. Control then passes again to block 648 for further operations.

In block 648, the internal state variable $S_{cl}$ is then set to the value $S_c(k-N_{db})$ in anticipation of use in the next observation. In block 649, the value of $S_x$, determined per above, returned as the output $S_p(n)$ in the case of the power lead stability function 626, and $S_e(n)$ in the case of the ETD lead stability function 628.

In some implementations in which only the power parameter is used to detect system degradation, the logic required to implement the ETD stability state variable $S_e(n)$ is not required. In other implementations in which both the power parameter and ETD are employed to detect system degradation, a single stability function could be implemented employing the maximum of $N_{pl}$ and $N_{el}$, with the resulting value indicating that the system is stable.

In yet other systems where the power parameter is not available and in which only the evaporator temperature drop is used to detect system degradation, the evaporator temperature drop itself may be used as a proxy for the power parameter input P(k) in the compressor state debounce function 622. In this case, a threshold for evaporator temperature drop would be selected as the threshold value to apply to the single value of evaporator temperature drop in block 632 (FIG. 6C), with an evaporator temperature drop greater than that threshold providing an indication that the compressor is likely "ON" and a drop less than the threshold an indication that the compressor is likely "OFF." In this case, only the evaporator temperature drop stability logic would be implemented.

The augmented observation $O_a(n)$ resulting from the foregoing is shown in Table 3 below. As can be seen, Table 3 is similar to Table 1 except for the additional inclusion of the system state values.

TABLE 3

| Augmented Observation | | | | | |
|---|---|---|---|---|---|
| Time Stamp (optional) | $T_{ci}$ | $T_{ei}$ | $T_{ed}$ | Power Parameter P | System States $S_c$, $S_p$, and $S_e$ |
| Date/Time represented by observation | Sensor Reading(s) | Sensor Reading(s) | Sensor Reading(s) | Sensor Reading(s) | Compressor On/Off (TRUE/FALSE), Power Parameter Stable (TRUE/FALSE), ETD Stable TRUE/FALSE) |

In some embodiments, the VCC state generator 608 provides the augmented observation $O_a(n)$ discussed above to the CIPP processor 610, the ETD processor 612, and the rCOP processor 613, as discussed above in FIG. 6. Those processors 610, 612, and 613 can then use the augmented observation $O_a(n)$ to determine, using internal logic as needed, whether the augmented observation is suitable for further processing. The means by which these decisions are made will be discussed as part of the discussion to follow. Alternatively, the VCC state generator 608 can select only the observations which have been considered stable with respect to the power parameter, i.e., those augmented observations for which the $S_p$ state variable has been declared TRUE and for which at least one compressor is ON as indicated by the $S_c$ state variable for processing by the CIPP processor 610, resulting in a sequence of observations produced one at a time, or in a batch or a data frame, dependent upon specific details of implementation. In an analogous way, the VCC state generator 608 can also select only those observations for which the VCC state generator 608 has declared the HVAC&R system 100 to be stable with respect to the evaporator temperature drop, i.e., the observations for which the evaporator temperature drop state variable $S_e$ have been set TRUE and for which at least one compressor is ON as indicated by the $S_c$ state variable for processing by the ETD processor 612. In other implementations, using the state information provided by the VCC state generator 608, other components in prediction processor 606 can determine which augmented observations are relevant for their individual functions as needed.

The augmented observations $O_a(n)$ allow the CIPP processor 610 to learn the relation between the intake temperatures and the compressor input power parameter values associated with those temperatures (i.e., the CIPP relation), selectively generating predictions of power parameter values representing the HVAC&R system in newly maintained condition for a given observation and generating a normalized power parameter residual value for the observation when appropriate. Similarly, the ETD processor 612 uses the augmented observations $O_a(n)$ to learn the relation between the intake temperatures and the evaporator temperature drop values associated with those temperatures (i.e., the ETD relation), selectively generating predictions of evaporator temperature drop values representing the HVAC&R system in newly maintained condition for a given observation and generating a normalized evaporator temperature drop residual value for the observation when appropriate. The CIPP processor 610 and the ETD processor 612 are essentially identical functionally, differing only in their parametric focus, and both follow the basic signal processing described above for generating normalized residuals. In what follows, the term "prediction of discourse" will be used to describe either the power parameter or evaporator temperature drop as appropriate.

Learning the CIPP relation and the ETD relation was previously mentioned with respect to FIGS. 5A and 5B, which referenced a learned CIPP relation block 500 and a learned ETD relation block 506. The purpose of the learned CIPP relation block 500 is to learn the relation between the evaporator intake temperature, condenser intake temperature and the power parameter of a compressor, and to provide a prediction of the power parameter value representing the operation of the system in newly maintained condition. The purpose of the learned ETD relation 506 is to learn a similar relation between the evaporator intake temperature, condenser intake temperature and evaporator temperature drop of an HVAC system representing the system in newly maintained condition. The CIPP processor 610 and the ETD processor 612 implement the purposes of the CIPP relation block 500 of the learned ETD relation block 506. Following now is a more detailed explanation of how the CIPP relation and the ETD relation may be learned in some embodiments.

As background, existing solutions for the learned CIPP relation and learned ETD relation used a so-called lumped regression approach in which a large set of observations was obtained with the system assumed to be operating in newly maintained condition gathered over a long period of time and intended to represent the entire operating "range" of the equipment in temperature. The large data set was intended to be obtained while the system was in "newly maintained" condition and assembled into a training data set and a test data set and, in some cases, a validation set. Machine learning in the form of a linear regression algorithm was used to create a model of the system from the entire training set, with those observations of the training set meeting the criteria and logic of the VCC state generator 608 applied to select those observations that represent "stable" operation with respect to the predictions of discourse.

Lumped linear regression algorithms are well established and understood in the discipline of machine learning—the prediction of discourse is "predicted" using a linear combination of functions of the explanatory variables; $T_{ei}$ and $T_{ci}$ in the present application, a so-called parametric model with the parametric coefficients of the linear combination selected (learned) to minimize a cost functional, normally the mean-squared error between the observed and predicted values of the prediction of discourse over the training set. Once the parametric coefficients are determined, the resulting parametric model relating $T_{ei}$ and $T_{ci}$ to the prediction of discourse represents operation of the system under all conditions. To make a prediction from the parametric model for an observation, an evaporator intake temperature and condenser intake temperature are substituted into the parametric model with the learned coefficients and the result calculated. The test data set is then applied to the parametric model to confirm that the model can indeed represent the characteristics of the actual system and not just the training set on which the parametric coefficients were determined. Often, it is required to "tune" the algorithm parametric coefficients to ensure that parametric model represents not only the training set, but also the test set with enough joint accuracy to be used practically in an application. In some cases, once the parametric model is appropriately tuned, it is applied to a third, validation set with observations the parametric model has never "seen", the purpose of which is to establish a level of confidence that the tuned parametric model represents the underlying mechanisms of the process to be modeled, and not just the specifics of the training set and test set.

As described above, prior solutions had practical considerations that limited the usefulness and salability of an HVAC&R degradation detection system. One limitation of prior solutions was the large data set required which usually took a long time to assemble, especially where the training was customized to an individual HVAC&R system. Accurate predictions of expected power parameter or evaporator temperature drop values were deferred until the training was complete. For example, for an air conditioning system operating in a moderate climate, an entire cooling season of data might be needed to ensure that all expected external conditions are observed, for instance, because average and peak outdoor temperatures in May are generally considerably cooler than average and peak outdoor temperatures in August in most places in the United States. The availability of the degradation detection system of necessity was deferred until the data sets were acquired.

Another limitation of prior solutions was that the HVAC&R system needed to remain in a "newly maintained" condition throughout the interval over which the various data sets were acquired to build an accurate parametric model. This was not practical when the training interval took several weeks or months to complete due to the large training data set required and degradation due to condenser and evaporator fouling (which may be due to dirty filters) are fully expected.

Yet another practical limitation is the collection and storage of vast amounts of observations for training data may not be feasible except in cloud-based solutions that have large storage capacity, as solutions that reside more proximate to the HVAC&R system typically have much smaller storage capacity.

Yet another practical limitation of prior art solutions was the manual "tuning" of the parametric coefficients of the model often required to establish accurate predictions and the need to verify the validity of these predictions against a test set and validation set.

Yet another practical limitation of prior art solutions was that it is difficult to know whether a given observation for which the learned parametric model is to predict lies within a range of operation for which there were sufficient observations in the training set. Lumped regression algorithms are susceptible to generating inaccurate predictions when operating outside the range of the bulk of explanatory variables that created them. Accepting the result of a prediction from the lumped linear regression model without additional information about the distribution of the training set can lead to inaccurate predictions without knowing that it happened, resulting in the system generating false positives i.e., declaration of degradation when none exists or false negatives i.e., representing the system is in relatively good condition when it is not. It would be better if the agent simply ignored the observation rather than make a bad prediction or series of bad predictions leading to false positives or false negatives.

Accordingly, one aspect of the embodiments herein is a novel learning method of signal processing and signal flow by which the agent 314 learns the corresponding relation (CIPP or ETD) described in function blocks 500 and 506, respectively (see FIGS. 5A and 5B), which addresses the limitations above. Although particularly well suited to the tasks of learning the CIPP relation and ETD relation while the physical HVAC&R system is experiencing degradation, predicting power parameter and evaporator temperature drop values reliably and doing so without the need to collect large sets of data a-priori, it should be clear that the embodiments disclosed herein are applicable to many other types of applications.

Figure 6E:
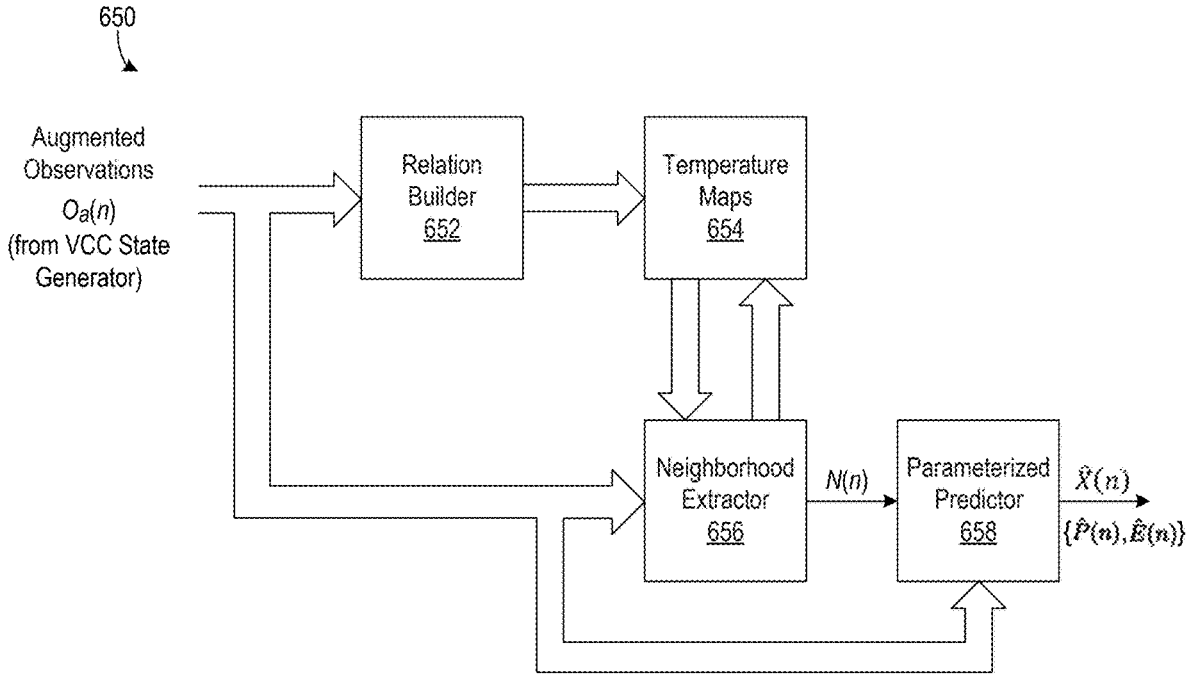
FIG. 6E illustrates an exemplary relation learner according to aspects of the disclosed embodiments.

With the above background, reference is now made to FIG. 6E where an exemplary relation learner process 650 is shown that can be operated or otherwise employed by the CIPP processor 610 and the ETD processor 612 to learn the CIPP relation and the ETD relation, respectively, using the augmented observations $O_a(n)$ furnished by the VCC state generator 608, and make predictions of parametric values using these relations. In some embodiments, this relation learner 650 learns the CIPP relation and the ETD relation using a machine learning process. The machine learning used by the relation learner 650 employs a novel approach that exploits certain characteristics of the physics and design of HVAC&R equipment in particular but are more generally applicable to a larger class of applications.

In the embodiments herein, two relation learners 650 are assigned to the compressor in a single compressor system of FIG. 3; one relation learner 650 assigned to learn the CIPP relation and a second relation learner 650 assigned to learn the ETD relation. These relation learners 650 are the internal mechanisms behind the learned CIPP relation 500 in FIG. 5A and the learned ETD relation 506 in FIG. 5B, respectively. In a multiple compressor system, a separate pair of relation learners are assigned to each compressor for each possible state of Sc(n) in which the compressor is in the ON state. For the moment, however, the operation of a relation learner is best understood in terms of the simple, single compressor system of FIG. 3, with the extension to multiple compressor systems deferred until the principles of the relation learner are understood per below.

In the FIG. 6E example, the relation learner 650 uses several modules to learn the CIPP and ETD relations and make predictions, including a relation builder 652, a temperature map 654, a neighborhood extractor 656, and a parameterized predictor 658. In general, the temperature map 654 relates the intake temperatures and the parameters of discourse likely to represent the HVAC&R system in newly maintained condition associated with those temperatures (as received from VCC state generator 608), while the relation builder 652 operates to compile and maintain the temperature map 654. The neighborhood extractor 656 defines a range or "neighborhood" of acceptable temperature points around a given measured temperature tuple of the observation, $(T_{ei}(n), T_{ci}(n))$, and the parameterized predictor 658 operates to make a prediction of the prediction of discourse, $\hat{X}(n)$, from the values in the temperature map 654 for that temperature tuple.

A benefit of using the temperature map 654 is it allows the neighborhood extractor 656 to detect when a temperature tuple of a steady state observation in the temperature map 654 lies outside a range where a prediction can be confidently made. This means the agent 314 can choose not to make a prediction via the parameterized predictor 658 rather than run the risk of predicting an erroneous value for the corresponding prediction of discourse. Such an arrangement can serve to greatly reduce the chance of generating a "false positive" condition in which degradation is declared when no problem exists, or a "false negative" condition declaring the system to be in good condition when it is, in fact, degraded.

In some embodiments, the parameterized predictor 658 makes predictions using a parameterized model of predetermined form in which the parametric coefficients of the model are derived from data in the (one or more) temperature maps each time a prediction is to be made as contrasted with the lumped regression model above. An example of the parameters and parameterized function is discussed later herein with respect to FIG. 6G.

In some embodiments, the relation builder 652 uses a 2-stage bootstrap learning strategy combined with a reference degradation estimator function to modify in some cases the prediction of discourse values of steady state observations prior to using the modified observations to populate the temperature map 654. Details of these two functions will be described in greater detail subsequently with respect to FIG. 7.

For the simple, single compressor system of FIG. 3, in some implementations, the relation builder 652 builds the temperature map 654 using only those augmented observations $O_a(n)$ provided by the VCC state generator 608 for which the compressor is declared in the "ON" state via the state variable $S_c(n)$, and only if the observation represents the vapor compression cycle in a stable state with respect to the prediction of discourse as discussed above via the state variable $S_p(n)$ in the case of the power parameter and $S_e(n)$ in the case of evaporator temperature drop. In what follows, observations meeting the criteria above are referred to as steady state observations for purposes of both the relation builder 652 and the neighborhood extractor 656, and the associated relation learner is declared "active" for that observation. Observations not meeting these criteria for the prediction of discourse are ignored by relation builder 652. The notion of an active relation learner will be extended to multiple compressor systems subsequently.

Each steady state observation $O_a(n)$ furnished by VCC State generator 608 includes a temperature tuple $(T_{ei}(n), T_{ci}(n))$ and a corresponding observation of the "prediction of discourse", X, either the power parameter P, or the temperatures from which the evaporator temperature drop, E, may be computed. Each temperature tuple $(T_{ei}, T_{ci})$ when quantized, serves as a 2-dimensional index into the temperature map 654. For each indexing temperature tuple, the agent 314 "learns" by updating summary data for a "cell" corresponding to the temperature tuple from the sequence of prediction of discourse values. Details of the cell contents will be described subsequently. When observations meeting certain requirements are encountered, the relation builder 652 updates the summary data for a given cell in this manner until enough observations have been applied to be considered representative of the prediction of discourse of a machine in newly maintained condition at that temperature tuple, as described later herein, after which, the relation builder 652 stops updating the summary data for that cell and the summary data of the cell can be used to make predictions of the power parameter value representing the system in newly maintained condition. Power parameter and EDT predictions in some cases may derive directly from the summary data of an individual cell indexed by a tuple of a steady state observation once the requisite number of observations have been made for that cell. In other cases, the parameterized prediction function may derive a power parameter prediction for a tuple of a steady state observation by first building a localized parametric model with parametric coefficients derived using summary data from nearby tuples, using the neighborhood extractor 656 and parameterized predictor 658 as will be described subsequently.

With the above approach, the relation builder 652 can build a useful relation quickly, the neighborhood extractor 656 can be used to determine whether a prediction should be made for a given tuple (i.e., within the "neighborhood"), and the parameterized predictor 658 can begin making predictions of the prediction of discourse almost immediately. This allows the CIPP processor 610 and ETD processor 612 (via the relation learner 650) to begin making corresponding parameter predictions and generating useful normalized parameter residual sequences soon, within the same day in some cases, after the HVAC&R system is commissioned, provided the system is running and is in newly maintained condition, and allows the relative COP processor 613 (using the parameter predictions) to create a relative COP sequence, rCOP(n).

Using the temperature map 654 described herein, the neighborhood extractor 656 can assess whether a prediction of the power parameter corresponding to a given temperature tuple is likely to represent the characteristics of an HVAC&R system in newly maintained condition and decide whether to issue a prediction. The ability to assess the reliability of a prediction greatly reduces the possibility of the agent providing false positives and false negatives. Additionally, because the normalized residuals for both the CIPP relation and ETD relation can be assumed to be quasi-temperature independent (as mentioned above and discussed further herein), the agent 314 can continue to learn the characteristics of the HVAC&R system in newly maintained condition while the system is degrading, thereby compensating for the degradation so the predictions better represent the system in newly maintained condition.

Continued learning of the relation by the relation builder 652 can be achieved by updating the temperature map 654 as additional temperature and measured prediction of discourse data becomes available in the form of observations. In some embodiments, the temperature map 654 is updated in batches, whereby a group of observations are assembled into one or more data frames of steady state observations (i.e., a collection of observations) and presented to the prediction processor 606 of the agent 314 by the data acquisition processor 600 as a batch of time-ordered observations. The batches of observations may be acquired on an hourly, daily, or other time base, and presented to the agent as a time sequence using the time stamp (TS) described above or another means to order the time sequence. It is also possible in some embodiments to provide the observations on an individual observation basis, one at a time as they are received.

In some embodiments, the temperature map 654 is built by using the evaporator intake temperature $T_{ei}$ and the condenser intake temperature $T_{ci}$ over a particular temperature range of interest. Assuming a quantization of 0.1 deg. C. (other quantization levels may of course be used) and a temperature range from 10 to 40 deg. C. for each $T_{ei}$ and $T_{ci}$, the resulting temperature map would be a 300×300 table (with 90,000 cells). A partial example of an exemplary temperature map 654 is shown in Table 4 below, where the cells of the map contain summary values for the compressor input power parameter observed for each temperature tuple ($T_{ei}$, $T_{ci}$). Although the table is shown as being mostly filled, in general, only those cells for which the values of $T_{ei}$ and $T_{ci}$ have been observed will contain summary values.

TABLE 4

Exemplary Temperature Map

| $T_{ei}$ (° C.) | $T_{ci}$ (° C.) | | | | | |
|---|---|---|---|---|---|---|
| | | 10.0 | 10.1 | 10.2 | . . . | X |
| | 10.0 | C00 | C10 | C20 | . . . | CX0 |
| | 10.1 | C01 | C11 | C21 | . . . | CX1 |
| | 10.2 | C02 | C12 | C22 | . . . | CX2 |
| | . . . | . . . | . . . | . . . | . . . | . . . |
| | Y | C0Y | C1Y | C2Y | . . . | CXY |

As mentioned above, each cell (e.g., C00, C01, C02, etc.) in the temperature map contains summary values for the observations corresponding to the temperature tuple ($T_{ei}$, $T_{ci}$) that serves as an index into the cell. These summary values, also called summary statistics or sample statistics in some cases, provide summary information about the steady state observations represented by the cell. For example, summary values may provide information about the data in the data set, such as the sum total, the mean, the median, the average, the variance, the deviation, the distribution, and so forth.

As described previously, power parameter values of steady state observations are computed from measurements by power or current meters that are specially designed for the purpose, and the evaporator temperature drop is computed from the readings of temperature sensors. However, real world measurements may nevertheless be noisy due to operational and/or environmental variability. The temperature map 654 therefore inherently incorporates realistic conditions whereby values used to update the cells may be corrupted with noise. These real-world conditions may be described as a stationary zero-mean additive random noise process, Noise(0, $\sigma_x^2$), where $\sigma_x^2$ is the variance, which may be dependent upon the noise process of the prediction of discourse. Each measured value of steady state prediction of discourse, X, can then be expressed as shown in Equation (10):

$$X = X_o(T_{ei}(n), T_{ci}(n)) + \text{Noise}(0, \sigma_x^2) \tag{10}$$

where $X_o(T_{ei}(n), T_{ci}(n))$ is the underlying value of the prediction of discourse of the observation.

In one embodiment, the relation builder 652 applies one of two functions of parameter values from the steady state observations to populate and update the summary values of the cells in the temperature map of Table 4. In what follows, the term $f_x(X, n)$ will be used to describe the result of applying the appropriate function to the measured prediction of discourse value, X, of the nth steady state augmented observation, $O_a(n)$, used to update a specific cell. One of the functions applied is an identity function, in which the value of the measured prediction of discourse itself is the result of the function. In this case, $f_x(X, n)$ is given by:

$$f_X(X, n) = X \tag{11}$$

When compensating the learning process for system degradation, the agent may apply a second, time varying compensation function based on characteristics of the system previously learned, the details of which will be described subsequently. To reduce the measurement noise present in a real system, the agent builds and maintains summary data for each cell that can be stored in the cell and used for computing sample statistics for the prediction of discourse corresponding to the indexing temperature tuple. In some embodiments, the summary data of each cell includes the following summary values:

$$\text{Sum of values observed, } \sum_{n=1}^{N} f_x(X, n) \tag{12}$$

$$\text{Sum of the squares observed, } \sum_{n=1}^{N} f_x^2(X, n) \tag{13}$$

where N is the total number of observations stored in the sums, a value which is also stored as an element of the summary data in the cell. In other words, each time the relation builder 652 updates the summary data in a cell, it does the following:

a. Applies the appropriate function to the value in the steady state operation, represented by Equation (11), resulting in the value $f_x(X, n)$;

b. Adds the value $f_x(X, n)$ to the sum of values observed, described by Equation (12);

c. Computes the square of $f_x(X, n)$, resulting in the value $$f_x^2(X, n);$$

d. Adds the value $$f_x^2(X, n)$$

to the sum of squares observed, described by Equation (13); and e. Increments the value of N associated with the cell to reflect the update.

These summary values can be used by the parameterized predictor 658 to compute a predicted value of the prediction of discourse value corresponding to the cell as required and are also used in compensating subsequent observations of the prediction of discourse, both in a manner to be discussed subsequently.

Additionally, for each cell of the temperature map, in some implementations, the relation builder 652 maintains two metadata: (1) an indication of whether enough observations were made at the particular temperature tuple represented by the cell such that summary statistics represented by the cell can be designated as valid for purposes of prediction; (2) an indication of whether one or more observations used in forming the summary statistics of the cell were modified to compensate for system degradation.

The first metadata can be stored as a Boolean variable, for example "OBSERVED," with the variable set to TRUE to indicate that sufficient observations were made, and FALSE to indicate otherwise. Entries in the temperature map are populated as rapidly as possible with enough observations such that the mean of the observations stored can be used to reliably predict the power parameter, while stopping population of the entries in the map when the number of observations is sufficient that, under normal conditions of noise, additional observations are not likely to change the sample mean of the cell significantly. Thus, in some embodiments, the cell corresponding to a temperature tuple ($T_{ei}$, $T_{ci}$) is defined to be observed and the "OBSERVED" metadata variable set to TRUE when a minimum of four observations have been made and the relation builder 652 stops adding information to the cell at this point. This approach has the effect of limiting the data stored in the cell to that most likely to reflect a newly maintained condition of the system and serves as an aid to allowing the parameterized predictor 658 to begin predicting the system condition quickly.

The "OBSERVED" metadata variable is in some sense optional, as it is derived from the already stored summary data value N. However, maintaining this variable so it is "set" only once, can reduce processing times, and is an aid to understanding the principles and teachings herein.

The second metadata can be also stored as a Boolean variable, for example "COMPENSATED," with TRUE indicating that the time-varying compensation function has been applied to at least one of the steady state observations used in forming the summary data of the cell, and FALSE indicating that none of the steady state observations used in forming the summary of the cell were compensated for system degradation using the compensation function. Further details are provided with respect to the discussion of FIG. 8.

Thus in some implementations, each cell in the temperature map includes the following exemplary variables and corresponding data therefor: "SV" {summary data}, "COMPENSATED" {TRUE/FALSE} and optionally "OBSERVED" {TRUE/FALSE}.

An estimate of the mean prediction of discourse value for an entry in a cell of the temperature map may be computed from the summary quantities using Equation (14):

$$\overline{X} = \frac{\sum_{n=1}^{N} f_x(X, n)}{N} \tag{14}$$

where $\overline{X}$ is the mean prediction of discourse value, while an estimate of the variance $\sigma^2$ of the prediction of discourse values accumulated may be computed using Equation (15):

$$\sigma_X^2 = \frac{1}{N}\sum_{n=1}^{N} f_X^2(X, n) - \overline{X}^2 \tag{15}$$

Equation (14) can be used for predicting the value for the prediction of discourse most likely to represent the HVAC&R system in newly maintained condition at the temperature tuple values of the corresponding steady state observations when the methods taught subsequently herein are applied. In some implementations, Equation (15) can be used as an indicator of the "fidelity" of the prediction, with low variance indicating that the values forming the sum were all nearly the same and high variance indicating otherwise.

Following now is a discussion of how predictions for a prediction of discourse may be extracted from a temperature map, such as the temperature map 654, unique to the prediction of discourse to be used by the CIPP processor 610 and the ETD processor 612, respectively, to compute the respective sequences $\hat{P}(n)$, $\hat{E}(n)$ presented to the rCOP processor 613 and the respective residual sequences $R_P(n)$ and $R_E(n)$ presented to the degradation detection processor 614 in FIG. 6. The method by which a prediction of the prediction of discourse may be extracted from the temperature map 654 is best understood in reference to FIGS. 6F and 6G.

Figure 6F:
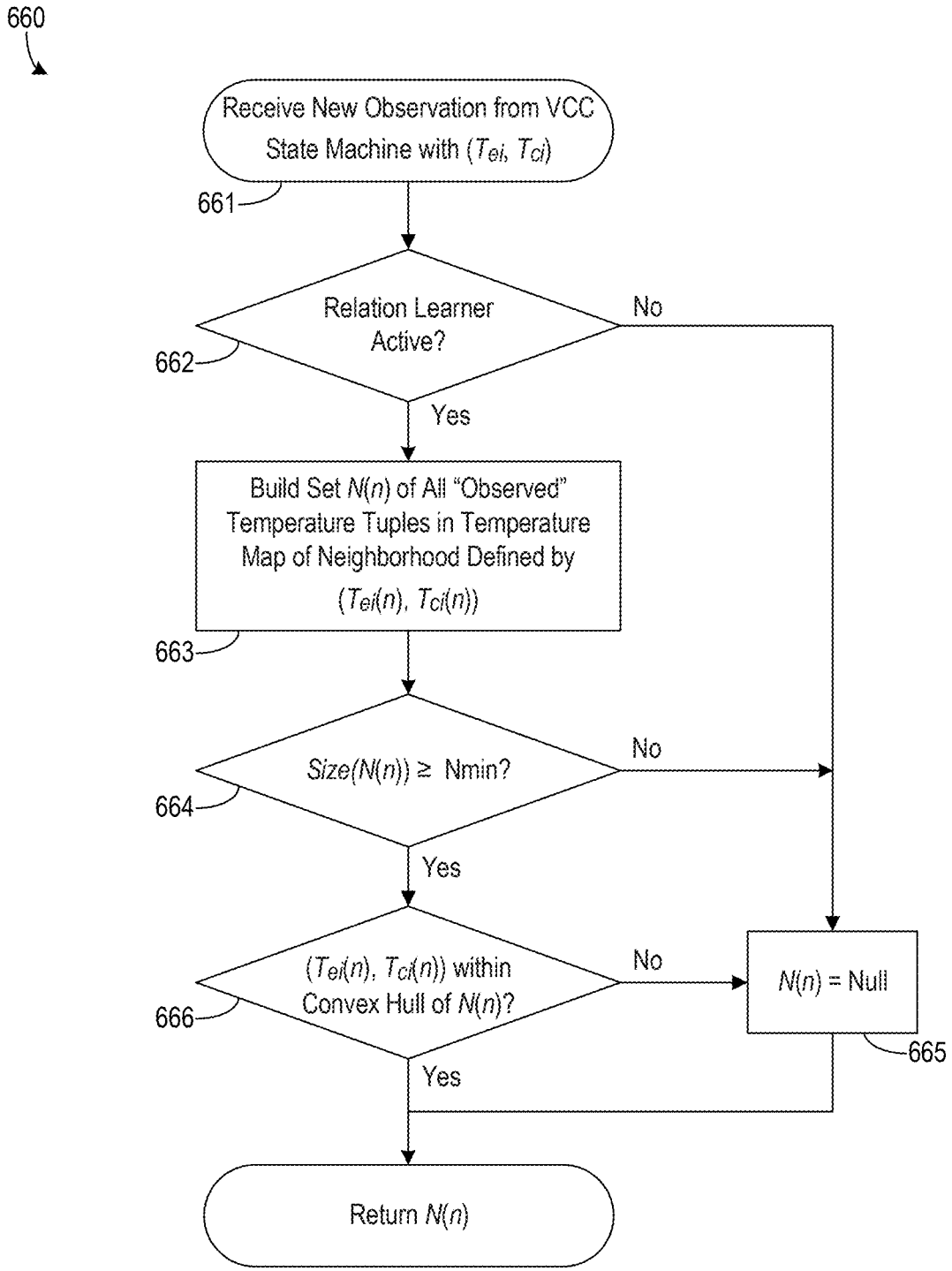
FIG. 6F illustrates a flowchart for an exemplary neighborhood extractor logic that may be used with the relation learner according to aspects of the disclosed embodiments.
Figure 6G:
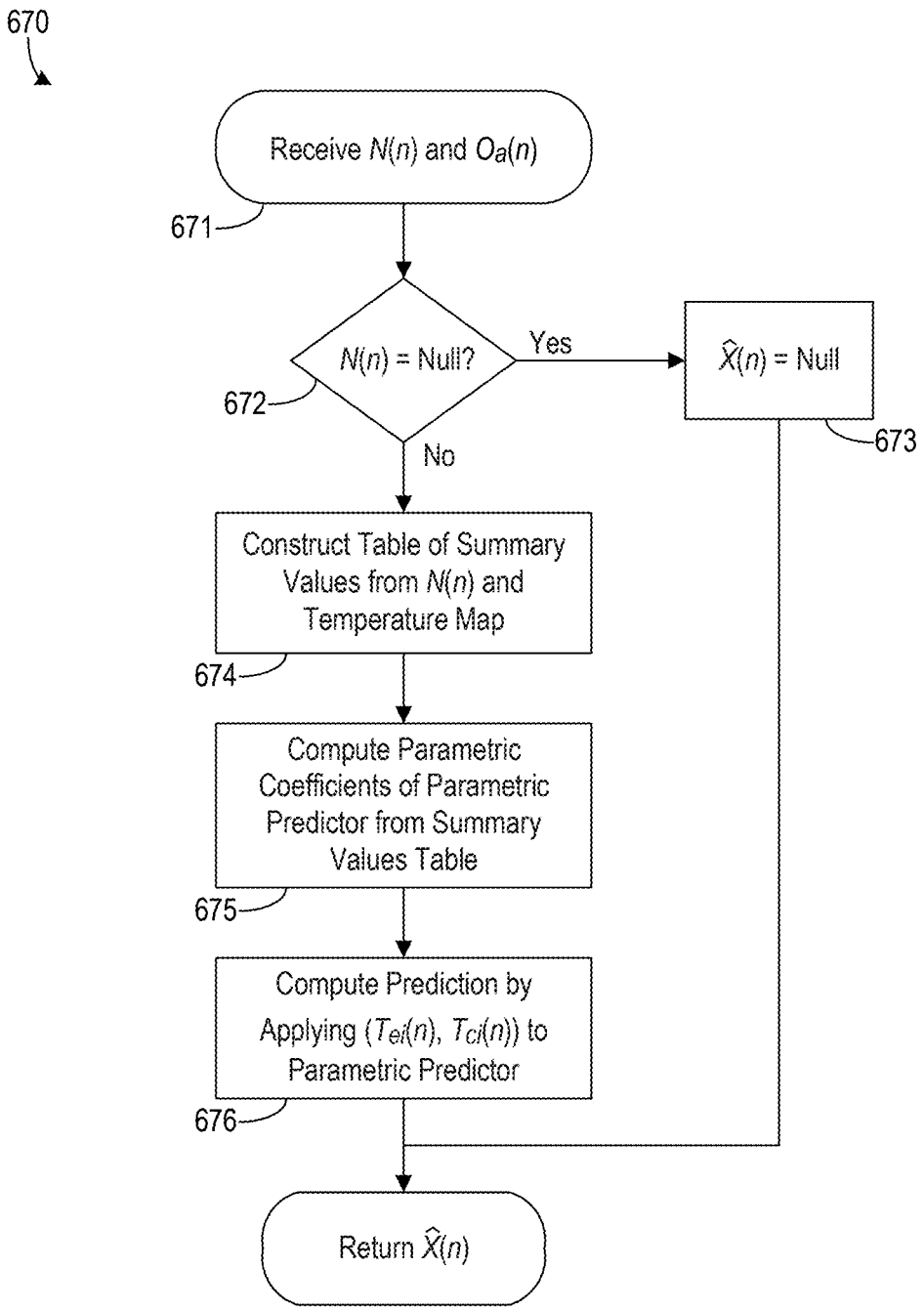
FIG. 6G illustrates a flowchart for an exemplary parametric prediction logic that may be used with the relation learner according to aspects of the disclosed embodiments.

FIG. 6F shows a flowchart 660 illustrating an exemplary process that may be used by or with the neighborhood extractor 656 to determine whether to make a prediction and to furnish a table of temperature tuples pointing to cells in the temperature map 654 of the prediction of discourse sufficient to build a local parametric model via parameterized predictor 658 to predict the parameter of discourse when appropriate. FIG. 6G shows a flowchart 670 illustrating an exemplary process that may be used by or with the parameterized predictor 658 to predict what the value of the prediction of discourse (i.e., compressor input power parameter, evaporator temperature drop) should be if the HVAC&R system is in "newly maintained" condition for purposes of degradation detection.

As described above, the purpose of the neighborhood extractor 656 is to determine whether to make a prediction and when a prediction is to be made to assemble and provide a set of temperature tuples, denoted herein as N(n), based on the observed temperature tuple ($T_{ei}$(n), $T_{ci}$(n)) pointing to cells within the temperature map 654 of the parameter of discourse, the summary values of which may be used by the parameterized predictor 658 in making that prediction. Referring first to FIG. 6F, the flowchart 660 generally begins at 661 where the neighborhood extractor 656 receives or is presented with an augmented observation (i.e., the nth observation of the sequence) furnished by the VCC state generator 608 as $O_a$(n) with temperature tuple ($T_{ei}$ (n), $T_{ci}$(n)). The neighborhood extractor 656 operates on individual augmented observations received from VCC state generator 608, one at a time as they are generated, or serially in a data frame.

In some implementations, the neighborhood extractor 656 can simply ignore any observation from the VCC state generator 608 that does not meet the criteria for a steady state observation with respect to the prediction of discourse, i.e., the relation learner is not active as defined above. Accordingly, at 662, the neighborhood extractor 656 determines whether the relation learner 650 of discourse is active for the present observation. If the relation learner is not active, the neighborhood extractor 656 immediately assigns a NULL value to the set, N(n), in process step 665 for that observation, and the process is complete for that observation, the value NULL indicating that no prediction should be made.

Assuming the relation learner 650 is determined to be active for the prediction of discourse in 662, then the neighborhood extractor 656 searches a "neighborhood" of temperature tuples that are within +/−δ degrees of the observed temperature tuple ($T_{ei}$(n), $T_{ci}$(n)) in both $T_{ei}$ and $T_{ci}$, with a typical δ of 0.5 degree C. Thus, for instance, if the nth steady state observation of the system results in a temperature tuple ($T_{ei}$(n), $T_{ci}$(n)), then the neighborhood extractor 656 searches all temperature map cells (points) that satisfy Equations (16) and (17):

$$T_{ei} - \delta \le T_{ei}(n) \le T_{ei} + \delta \tag{16}$$

$$T_{ci} - \delta \le T_{ci}(n) \le T_{ci}(n) + \delta \tag{17}$$

and for which the temperature tuples lie within the established range of the temperature map 654.

For the above search, the neighborhood extractor 656 only considers "observed" temperature map cells, that is, cells for which the "OBSERVED" metadata variable has been set to TRUE in some embodiments, as discussed above or otherwise tested for the condition. Each time the neighborhood extractor 656 finds a cell within the neighborhood above determined to be "observed" per above, it adds the corresponding temperature tuple ($T_{ei}$ (n), $T_{ci}$(n)) to an initially empty or NULL set N(n). The neighborhood extractor 656 then allows (or recommends) a prediction to be made if and only if two criteria are satisfied. First, a certain absolute minimum number of observed cells is mathematically required to determine the parametric coefficients of the parameterized predictor 658, but a greater number of observed cells may be used and is preferable. Accordingly, a minimum number of cells, Nmin, is determined by a predefined constant that is system dependent must be at least the absolute minimum number of tuples required of the parameterized predictor 658, with a greater number preferable. In some embodiments, an absolute minimum number of 3 observed cells is required by parameterized predictor 658 and Nmin may be set at five cells in those embodiments.

To ensure this first requirement is met, when the search is complete in process step 663, the set N(n) contains the number of tuples denoted as Size(N(n)). In decision step 664, a test is made to determine if the number of tuples in the set N(n) is greater than or equal to the minimum number defined by the predefined constant Nmin per above. If this criterion is not met, then the set N(n) is assigned the value NULL at 665 and the work of neighborhood extractor 656 is complete for this observation.

If the neighborhood extractor 656 finds enough temperature tuples in the set N(n) at 664, then the neighborhood extractor 656 continues to 666 to test for the second criterion needed for making a non-NULL prediction in the present invention, namely, whether the temperature tuple ($T_{ei}$, $T_{ci}$) of the observation lies within a convex hull formed by a subset of the set of temperature tuples represented by N(n) collected as described above, with the specific point ($T_{ei}$(n), $T_{ci}$(n)) of the observation of discourse excluded for purposes of this test if it is a member of N(n). This criterion basically means that the temperature tuple of the observation is "surrounded" by the temperature tuples of N(n). This allows the parameterized predictor 658 to perform a local interpolation using summary data contained in the cells corresponding to those tuples rather than extrapolating outside the convex hull defined by the observed tuples, which can lead to an imprecise prediction as is often observed in the lumped regression methods described above. Determining whether a point lies within the convex hull of a set of points is a common problem in the field of linear programming and there are numerous "packaged" solutions that can be used to make that determination. As an example, the packaged function "linprog" included in the Python scipy.optimize library can be used in the determination, and there are many other packaged functions in Python and other programming languages capable of making the determination. If it is determined in 666 that the tuple of the observation does not lie within the convex hull of the tuples of cells determined at 664 above, then the set N(n) is assigned a value NULL value at 665, and the process is complete for this observation.

If the neighborhood extractor 656 determines at 666 that the temperature tuple of an observation lies within the convex hull of a minimum number of temperature tuples determined per above, this can greatly improve the reliability of prediction compared with prior art solutions. If both criteria at 664 and 666 are satisfied, then at 668, the neighborhood extractor 656 furnishes the set of tuples N(n)

as discovered above to parameterized predictor 658, as discussed below with respect to FIG. 6G.

FIG. 6G shows a flowchart 670 illustrating an exemplary process that may be used by or with the parameterized predictor 658 to make predictions. The flowchart 670 begins at 671, where the parameterized predictor 658 receives the set of temperature tuples N(n) provided by neighborhood extractor 656 per above and the corresponding augmented observation $O_a(n)$ (or observation sequence). At 672, the parameterized predictor 658 determines whether N(n) has been set to NULL. If yes, then the prediction $\hat{X}(n)$ is likewise set to NULL, and no prediction is returned for the given observation. If the set of temperature tuples N(n) is non-null, in process step 674 the parameterized predictor 658 constructs a table of values from summary data in the cells of the temperature map 654 of the prediction of discourse. The table of values comprises as rows the values of $T_{ei}$, $T_{ci}$ from each entry in N(n) along with the mean value of the parameter of discourse $\hat{X}$ corresponding to each tuple in N(n), already determined by neighborhood extractor 656 to be tuples for which the corresponding cells in the respective temperature map meet the criterion for an "observed" cell above. Mean values are computed from the summary data in the cells using Equation (14). Assuming there are m temperature tuples in the temperature map N(n), the resulting table of values is described by Table 5:

TABLE 5

Table of Values Extracted from Temperature Map

| Index | $T_{ei}$ | $T_{ci}$ | $\overline{X}$ |
|---|---|---|---|
| 1 | $T_{ei1}$ | $T_{ci1}$ | $\overline{X}_1$ |
| 2 | $T_{ei2}$ | $T_{ci2}$ | $\overline{X}_2$ |
| . . . | . . . | . . . | . . . |
| m | $T_{eim}$ | $T_{cim}$ | $\overline{X}_m$ |

With Table 5 constructed per above, in step 675 the parametric coefficients of the parametric predictor of discourse may be determined from the data in the table. In some embodiments the form of this parametric model for the Parameterized CIPP Predictor 658' is a simple hyperplane of the form:

$$\hat{X}(T_{ei}(n), T_{ci}(n)) = K_{x0} + K_{xei}T_{ei}(n) + K_{xci}T_{ci}(n) \tag{18}$$

where the parameters $K_{x0}$, $K_{xei}$, $K_{xci}$ are the parameters of the predictor function valid only for the present observation $O_a(n)$ which includes the measured values of $T_{ei}(n)$ and $T_{ci}(n)$. In some embodiments the parametric coefficients are computed from the values in Table 5 using an optimization program such as scipy.optimize.lsq_linear developed for the Python programming language, or many equivalent packages in other programming languages.

When applied per above, these optimization programs choose the values of the parameters $K_{x0}$, $K_{xei}$, $K_{xci}$ in Equation (18) that provide a "best fit" to the data in Table 5. Many optimization programs allow the values of select parameters to be constrained as needed to better represent the thermodynamics of the system. An example of this is when predicting the power parameter using Equation (18) above, the parameters $K_{xei}$ and $K_{xci}$ may be constrained to be non-negative to reflect that an increase in either temperature should cause an increase in compressor power.

Once the parametric values are established in process step 675 above, in process step 676, the prediction extractor 656 evaluates the resulting Equation (18) using the parametric values determined in step 675 at the temperature tuple ($T_{ei}(n)$, $T_{ci}(n)$) of the observation $O_a(n)$ to compute the predicted value of the prediction of discourse and assigns that value to $\hat{X}(n)$, and the process is complete for the prediction of discourse for this observation.

The processes described in FIGS. 6F and 6G above allow the CIPP processor 610 and the ETD processor 612 to provide predictions $\hat{X}(n)$ for the prediction of discourse, designated as $\hat{P}(n)$ in the case of the CIPP processor 610 and $\hat{E}(n)$ in the case of the ETD processor 612, as shown in FIG. 6. From these predictions of the values of the prediction of discourse, the CIPP processor 610 and the ETD processor 612 can generate normalized residual sequences $R_P(n)$ and $R_E(n)$, respectively, in accordance with FIGS. 5A and 5B, using Equation (3) to compute $R_P(n)$ when the prediction value $\hat{P}(n)$ is not NULL and assigning the value NULL to $R_P(n)$ when $\hat{P}(n)$ is assigned the value NULL, and using Equation (8) to compute $R_E(n)$ when $\hat{E}(n)$ is not NULL and assigning the value NULL to $R_E(n)$ when $\hat{E}(n)$ is NULL. In addition, the CIPP processor 610 and the ETD processor 612 also provide the $\hat{P}(n)$ and $\hat{E}(n)$ parameters to the relative COP processor 613 for use in determining the corresponding relative COP sequence, denoted rCOP(n), with rCOP(n) assigned the value NULL when either $\hat{P}(n)$ or $\hat{E}(n)$ have been assigned the value NULL, and a numerical value when both are not NULL, with specifics of the generation of the sequence rCOP(n) to be discussed subsequently. One or more, or all, of these outputs (i.e., the normalized residual sequences $R_P(n)$ and $R_E(n)$ and the sequence rCOP(n)) are then provided to the degradation detection processor 614 for further analysis.

As mentioned, the degradation detection processor 614 operates to interpret the sequence of normalized residuals and the sequence rCOP(n) to detect performance degradation, and can issue warning signals or messages or audio-visual displays, or send information via newsfeeds, as generally indicated at 616, to notify of potential problems with the HVAC&R system. General operation of the degradation detection processor 614 is described with respect to FIG. 6H.

Figure 6H:
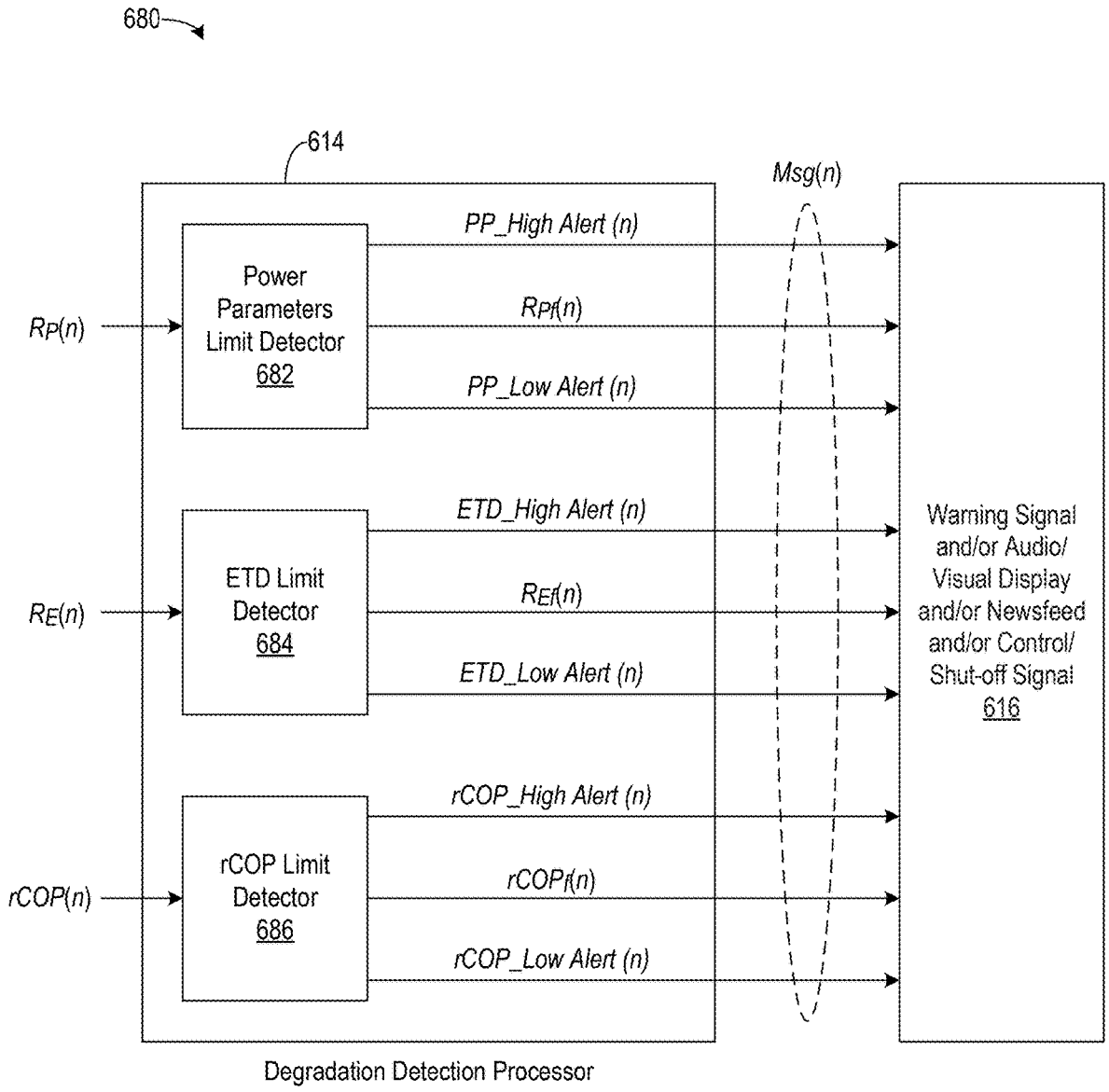
FIG. 6H illustrates an exemplary degradation detection processor according to aspects of the disclosed embodiments.

Referring to FIG. 6H, a block diagram 680 is shown illustrating exemplary operation of a degradation detection processor 614 according to embodiments of the present disclosure. The purpose of the degradation detection processor 614 is to monitor the sequence of normalized residuals $R_P(n)$ and $R_E(n)$ and the relative COP sequence rCOP(n) and issue alerts and warnings as needed when it detects potential problems via the degradation residual sequences. In the exemplary degradation detection processor 614 shown here, the normalized residual sequences $R_P(n)$ and $R_E(n)$, and the to-be-defined-subsequently relative COP sequence rCOP(n) are received by several limit detection blocks, including a power parameter limit detector 682, an ETD limit detector 684, and an rCOP limit detector 686, respectively. These blocks operate in a similar manner to one another, as described in FIG. 6I, and may be used by the degradation detection processor 614 to generate alert signals indicating when the corresponding normalized residual is deviating excessively from zero in the case of the power parameter normalized residual sequence $R_P(n)$ or evaporator temperature drop normalized residual sequence $R_E(n)$, both furnished by the prediction processor 606 above, or when the relative COP as indicated by the sequence rCOP(n) and provided by prediction processor 606 above has deviated significantly from 1.0 or, equivalently 100%, for any reason, where 100% relative COP indicates operation as expected from an HVAC&R system in newly maintained condition.

Figure 6I:
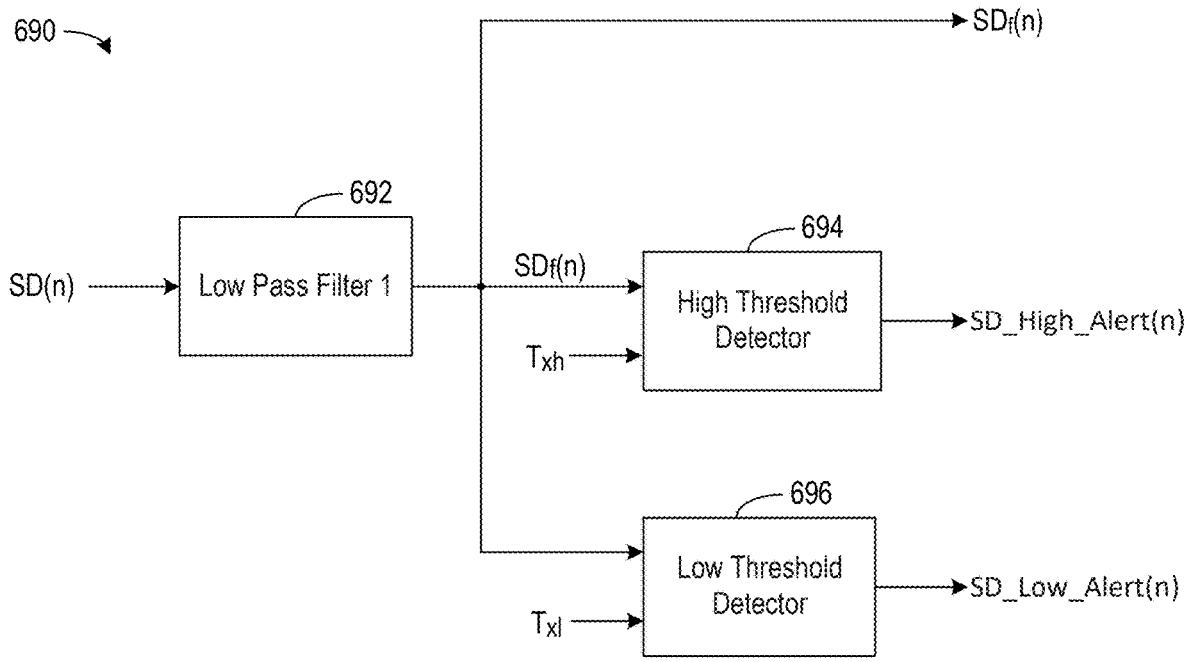
FIG. 6I illustrates an exemplary limit detector according to aspects of the disclosed embodiments.

FIG. 6I shows an exemplary limit detector 690 and detection process that may be used, illustrating how each of the power parameter limit detector 682, ETD limit detector 684, and rCOP limit detector 686 may be implemented, either in hardware or firmware. The input to each of the limit detectors 682, 684, 686 is shown symbolically as the "sequence of discourse" or SD(n) and may be one of the sequences $R_P(n)$, $R_E(n)$ or rCOP(n). Recall that the internal processing of the prediction processor 606 (FIG. 6A) assigns a NULL value for the sequence of discourse SD(n) (i.e., normalized residual compressor input power parameter sequence $R_P(n)$ and evaporator temperature drop parameter sequence $R_E(n)$, and the corresponding rCOP(n) sequence) whenever the requirements to provide a numerical value for the sequence of discourse is not satisfied. The non-NULL members of the sequence SD(n) are passed to a low-pass digital filter 692, which may be an EWMA (Exponentially Weighted Moving Average) filter to reduce the noise in the reference residual sequence. One general form of such a filter is shown in Equations (19) and (20):

$$x(m+1) = \beta x(m) + (1-\beta)u(m) \tag{19}$$

$$y(m) = x(m+1) \tag{20}$$

where x(m) is an internal state variable for the mth update of the filter, u(m) is the mth value of the input sequence to the filter; the normalized residual, y(m) is the mth output of the filter and β is the EWMA filter time constant which determines how quickly the filter responds to changes in the input. In some implementations, a value of β of 0.9996 may be employed as the filter constant. The output of this filter 692 is a filtered sequence of discourse, $SD_f(n)$, which takes on the resulting value of the output of the filter if the input sequence element is non-NULL, and takes on the value NULL if the input sequence element is NULL.

The initial value, x(0), of each of these EWMA filters is chosen to represent the expected value of the associated SD(n) for a system in newly maintained condition. Since it is expected that the value of the power parameter residual and evaporator temperature drop residual is zero for a newly maintained system, x(0) is assigned the value zero at initialization. Assuming the relative COP sequence is expressed as a percentage with 100% representing the coefficient of performance of a newly maintained system, an appropriate value for x(0) is 100.

The filtered sequence of discourse, $SD_f(n)$, from the low pass filter 692 is provided to two threshold detectors, a high threshold detector 694 and a low threshold detector 696. The high threshold detector 694 operates to compare the non-NULL sequence elements of the filtered $SD_f(n)$ sequence against a preset high threshold value, $T_{xh}$, and declares a logical variable SD_High_Alert to have Boolean value TRUE when the value of an filtered sequence $SD_f(n)$ exceeds the high threshold $T_{xh}$. Otherwise, the high threshold detector 694 declares variable SD_High_Alert to have Boolean value FALSE. Typical threshold values will be discussed subsequently. Similarly, the low threshold detector 696 produces as an output a logical variable SD_Low_Alert that is assigned Boolean value TRUE when $SD_f(n)$ is less than a lower threshold value, $T_{xl}$, and Boolean value FALSE otherwise.

In some implementations, the high threshold detector 694 and low threshold detector 696 can employ debounce logic similar to the debounce logic 630 described previously in FIG. 6C to ensure that when one of the two alert variables, SD_High_Alert and SD_Low_Alert, has been set TRUE, it is because the sequence $SD_f(n)$ has exceeded the threshold values for a determined number of non-NULL observations in a row and not simply due to a corrupted observation.

The filtered signal sequence $SD_f(n)$ generated internally to the limit detection process 690 may be of interest in other functions, particularly when synchronized with the time-stamp of the augmented observation sequence $O_a(n)$. In some implementations, the limit detection function 690 can set a value of NULL for any observation for which the input sequence SD(n) is NULL, so an external function can determine which sequence elements have actually been updated by limit detection function. Trend analysis can be applied to such a sequence to estimate a date and time for which the sequence $SD_f(n)$ will cross a predetermined threshold, indicating a rate of degradation and a sense of urgency for service. Of particular interest, trend analysis may be on a moving subsequence of $SD_f(n)$ to predict when the predicted subsequence will exceed one of the thresholds, $T_{xh}$ or $T_{xl}$, indicating how quickly the system is degrading. As an HVAC&R service provider, it would be beneficial to know, for instance, when it is expected that a limit will likely be exceeded in the next 30 days. As such, the sequence $SD_f(n)$ is provided as an output of the limit detections function so it may be subjected to external analysis.

Referring back to FIG. 6H, the various threshold detectors operate as described above to provide alerts when the normalized residuals become large or small relative to what would be considered "normal" operation of the HVAC&R system. Selection of the various threshold values for the thresholds $T_{xp}$ and $T_{xl}$ in the limit detection process 690 of FIG. 6I are part of the art of HVAC&R degradation detection. For instance, when the limit detection process 690 is applied for the power parameter limit detector 682 of FIG. 6H, for most residential and commercial air conditioning systems, typical values of $T_{xp}$ and $T_{xl}$ that have been employed are +0.05 and −0.05, respectively. Experience has shown that when these limits are employed and output variables PP_High_Alert or PP_Low_Alert is asserted by the power parameter limit detector 682, if a service technician is sent to the equipment site, the technician can nearly always find something to service that causes the subsequent normalized residual power parameter sequence, $R_P(n)$, and its filtered counterpart $R_{Pf}(n)$ to tend toward zero again. A PP_High_Alert usually indicates that something in the system is causing pressure in the system to be greater than normal, and it can be inferred that condenser fouling or degraded condenser fan operation, a plugged expansion valve or refrigerant overcharge are possible causes, whereas a PP_Low_Alert usually indicates that something in the system is causing refrigerant pressure to be less than normal, and can infer a loss of refrigerant or undercharging, fouled evaporator or dirty filter, other types of air flow occlusion, degraded evaporator fan operation or perhaps an expansion valve that is stuck open. Thus processed, the residual sequence $R_P(n)$ generated using the teachings of the embodiments herein can be used not only to indicate degradation, but to infer possible causes of the degradation and issue an appropriate alert signal.

It has been observed empirically that the evaporator temperature drop residual, $R_E(n)$, tends to be more sensitive to system degradation than the power parameter residual, $R_P(n)$, so typical values of $T_{xp}$ and $T_{xl}$ that have been employed in the ETD Limit Detector 684 are +0.1 and −0.1, respectively. An ETD Low Alert signal indicates system degradation from causes that may include refrigerant loss, a reduction in refrigerant flow to the evaporator due to expansion valve issues or condenser issues such as condenser fouling or condenser fan degradation, whereas an ETD High Alert signal indicates system degradation from causes that may include evaporator or filter fouling, evaporator fan degradation or failure or excessive refrigerant flow into the evaporator due to expansion valve issues.

Typical values of $T_{xp}$ and $T_{xl}$ that have been employed in the rCOP Limit Detector 686 are +115% and 90%, respectively. An rCOP High Limit Alert signal can be caused by a serious reduction in airflow across the evaporator, possible causes of which are a fouled evaporator coil, a fouled air filter in the evaporator fluid stream, failure of an evaporator fan, or excessive refrigerant loss that causes frost buildup on the evaporator. Expansion valve issues can also generate an rCOP High Limit Alert. An rCOP Low Limit Alert Signal can be caused by sources of degradation that include refrigerant loss, condenser fouling or condenser fan degradation and expansion valve issues.

Furthermore, the corresponding rCOP(n) sequence can, in some instances, provide an indication of the severity of the degradation in terms of energy wasted and can be used to infer the urgency of service required. For instance, a PP_High_Alert combined with an average rCOP value of 0.98 would indicate that, even though there is a condition requiring attention, the equipment is still running at 98% efficiency, and a user might schedule maintenance for the next week or two or even wait until an upcoming scheduled maintenance to address the issue, with the understanding that the issue should be addressed in the near future, whereas an average rCOP value of 0.7 would indicate the equipment is operating at 70% expected efficiency and should be serviced very soon.

Similarly, and in a very common scenario, an air conditioner can begin to lose refrigerant due to a leak and if the condition is not detected, can begin to lose cooling capacity. While the equipment may provide adequate cooling on cooler days, on very hot days, the equipment may no longer be capable of maintaining the appropriate temperature in the conditioned space. A PP_Low_Alert, can be used to infer a possible loss of refrigerant and, if accompanied by a low rCOP value of 0.8, can indicate that service should be performed very soon since the equipment is operating at 80% of expected efficiency and, as above, some possible causes can be inferred. A PP_Low_Alert accompanied by an rCOP value above or near 100% could be used to infer that a filter change over the next few days will likely solve the problem. Appropriate alert signals may then be issued accordingly.

In some implementations, multiple limit detectors of the type described above may be incorporated to indicate different "levels" of alert. As an example, referring to detection of degradation via the power parameter normalized residual, one embodiment might create three instances of the power parameter limit detector 682, one set with upper and lower limits (or thresholds) of +0.03 and −0.03 respectively and a second with upper and lower limits (or thresholds) of +0.1 and −0.1 respectively. The first instance above could be used to indicate the need to schedule maintenance on the equipment while alerts generated by the second could be used to indicate the need for immediate service. A third instance, perhaps set at +0.2 and −0.2, might be used to automatically shut off the HVAC&R equipment (or portions thereof) by, for instance, remotely opening branch feeder circuit 114 via an appropriate control or trip signal to the circuit breaker thereof when the relative. Similar limits and controls may be established and implemented for any of the limit detectors of the degradation detection processor 614, including ETD limit detector 684 and relative COP detector 686, using similar threshold values. Moreover, it is not necessary for these limit detectors 682, 684, 686 to have upper and lower threshold values that are symmetrical about a central point, i.e., the magnitude of the lower threshold value may be different from the upper threshold.

If the physical HVAC&R system could remain in newly maintained condition long enough to acquire observations over the entire range of temperature tuples likely to be encountered by a system over one or more weather seasons of operation, the temperature map so constructed using only the identify function would be sufficient to characterize the system completely. As discussed previously, this is unlikely in general, and so a means is now described to permit learning of the system characteristics of a "newly maintained" system while the system is degrading in performance.

It should be recalled here that in some embodiments, each observation provided by the data acquisition processor 600 includes a timestamp indicating the date and time when the observation was obtained while in other embodiments the VCC state generator 608 of prediction processor 606 can implicitly keep track of the date and time of a given observation or simply the time elapsed from a reference time. Learning involves the relation builder 652 of the relation learner 650 of a prediction of discourse applying the appropriate function $f_x(X, n)$ to the prediction of discourse and using the condenser and evaporator intake temperatures to build sample statistics for the cells of the temperature map 654 that can be used to predict power parameter or ETD values of the equipment in "newly maintained" condition as described above and may best be illustrated with the aid of the exemplary timing diagram of FIG. 7.

Figure 7:
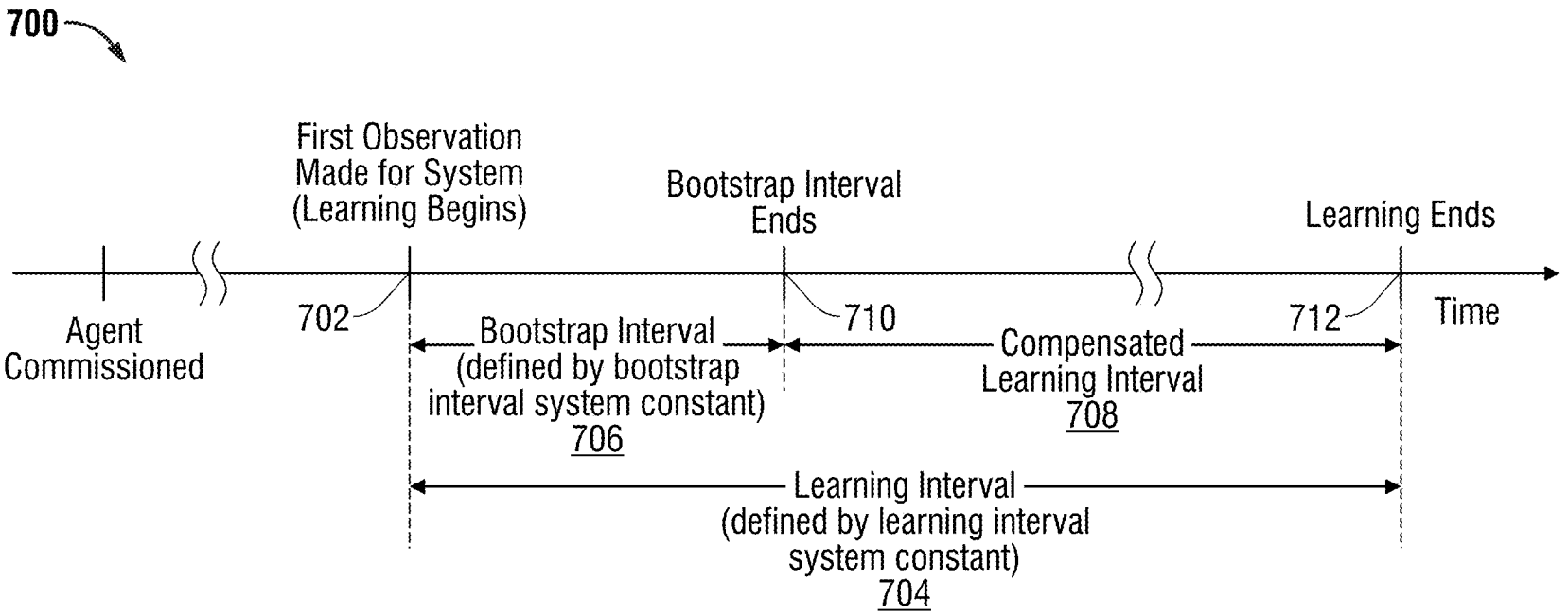
FIG. 7 illustrates a timing diagram for building a temperature map according to aspects of the disclosed embodiments.

Referring to FIG. 7, the timing diagram 700 generally begins once the HVAC&R system including the agent 314, and the relation builder 652 thereof, has been commissioned or otherwise deployed and it is assumed that when learning begins, the HVAC&R equipment is in "newly maintained" condition. Once these conditions are met and learning is enabled, learning of the prediction of discourse characteristics starts with receipt of an initial valid observation for which the relation learner 650 of the parameter of discourse is active (i.e., an observation obtained during steady-state operation with the compressor ON and the appropriate state variable $S_p(n)$ or $S_e(n)$ set TRUE in the case of a single compressor system) at 702. The steady state observation is presented to the relation builder 652 and is preferably the first steady state observation received after the above considerations are met. Learning continues with receipt of additional steady state observations over a learning interval 704 that is defined by a learning interval system constant. After the learning interval 704 is completed, the relation builder 652 is considered to have adequately learned the characteristics of the prediction of discourse of the HVAC&R system, which characteristics should not vary over time in the absence of system degradation once this is learned. If the system has degraded and subsequently restored to a newly maintained state, the relation should once again reflect the newly maintained characteristics of the system without further training.

As FIG. 7 shows, the learning interval 704 includes two constituent intervals, a "bootstrap" interval 706, and a compensated learning interval 708. The "bootstrap" interval 706, as the name implies, jumpstarts the learning process for the relation builder 652. It is assumed that the physical HVAC&R system begins and remains in newly maintained condition during the bootstrap interval, and during this interval the relation builder 652 applies the identity function of Equation (11) above to prediction of discourse values of the steady state observations to update the sample statistics of the corresponding cells. In other words, during the bootstrap interval, the relation builder 652 uses the unmodified values of the prediction of discourse entries of steady state observations to update the sums of the SV portion of the corresponding cells per above when the steady state observations are within the bootstrap interval (i.e., $f_x(X, n)=X$).

The bootstrap interval 706 begins with receipt of the initial steady state observation at 702 and ends after a predefined duration dictated by a bootstrap interval system constant at 710. The bootstrap interval 706 can be as short as a few days, but in practice may need to be set as high as the first 30 days of system operation, depending on the particular HVAC&R system. During the bootstrap interval, the COMPENSATED meta-data for each cell is FALSE. If enough observations are made during the bootstrap interval for a cell to be labeled "observed" by setting the "OBSERVED" meta data for the cell TRUE per the logic above, the sums in the cells will no longer be updated and will remain constant effectively "forever". These cells can be identified by the meta data OBSERVED=TRUE and COMPENSATED=FALSE are designated "reference cells" in what follows as they are the cells most likely to represent the system in newly maintained condition.

Following the bootstrap interval is a compensated learning interval 708 over which the assumption that the system remains in newly maintained condition is relaxed and during which the relation builder 652 can modify the values of power parameter in steady state observations using the time-varying compensation function intimated above to compensate for estimated degradation prior to updating the sample statistics of a cell. When the relation builder 652 updates a cell during the compensated learning interval 708, because the OBSERVED metadata variable is not yet set TRUE, it sets the COMPENSATED metadata variable of that cell to TRUE to indicate that at least one of the prediction of discourse values used to update the sample statistics of the cell was modified using the compensation function. The compensated learning interval 708 starts at 710 at the end of the bootstrap interval and continues until the end of the learning interval at 712, completing the learning interval 704. In some embodiments, a typical value for the learning interval 704 is on the order of 120 days, although fewer or greater number of days may certainly be used.

Once the learning interval 704 is completed, the learning by the relation builder 652 is considered sufficient for the purposes herein and the temperature map 654 is considered to be fully representative of the expected operation of the HVAC&R system, so that no further learning by the relation builder 652 is needed. The relation builder 652 is idle thereafter unless it is determined by other means that it needs to be re-started, such as when the HVAC&R equipment has been replaced with new or different equipment.

Compensating the power parameter values prior to updating the sample statistics during the compensated learning interval 708 is facilitated by a time-varying reference degradation generator function, next described. Reference cells of the map declared to be "observed" during the bootstrap interval 706 (i.e., OBSERVED=TRUE, COMPENSATED=FALSE) per above are likely most representative of the system in a newly maintained state because a) they represent the observations temporally nearest the time when the system was placed in newly maintained condition, and b) enough observations have been made that the sample statistics of the cell are likely representative of the actual characteristic of the system at that temperature tuple. For these cells, the mean value of the prediction of discourse given by Equation (14) is an estimate of the prediction of discourse value of the equipment in newly maintained condition for the corresponding temperature tuple. Since the OBSERVED=TRUE metadata variable indicates that the relation builder 652 will no longer update the summary statistics of this cell, the prediction of discourse estimates of the mean for this cell so generated via Equation (14) are now a constant.

In the bootstrap interval 706 above, the relation builder 652 assumes that the HVAC&R system remains in newly maintained condition, which is a reasonable assumption if the bootstrap interval is short in duration. It has been observed that, in practice, the relation between temperature and any normalized residual of the prediction of discourse, $R_P$ in the case of the power parameter (Equation (3)) or $R_E$ in the case of evaporator temperature drop (Equation (8)) is quasi-temperature independent, at least for levels of degradation not normally considered extreme. The term "quasi-temperature independent" as used herein means that the normalized residual of the prediction of discourse defined above is approximately independent of the observed temperature tuple ($T_{et}(n)$, $T_{ct}(n)$) over the working range of temperatures of the HVAC&R system, so long as the physical condition of the equipment does not change. Experience has shown that this is true in practice, at least for relatively small magnitude of normalized residuals in the range of temperatures considered "normal" and begins to be violated as the system degrades to levels that would suggest a service call for maintenance.

Consider an HVAC&R system in which the above assumptions hold true and for which the characteristics of the system have been learned and the temperature map 654 has acquired a few reference cells during the bootstrap interval 704, but not all cells in the temperature map 654 meet the conditions for a reference cell. Further, assume that a sufficient number of reference cells have been acquired that the prediction extractor 656 can use those cells when encountered in subsequent steady state observations to predict the "newly maintained" value of the prediction of discourse for an observation at least some of the time using the mean value of the prediction of discourse for the indexed reference cell computed per Equation (14) above as the prediction, $\hat{X}$. For a steady state observation for which the relation builder 652 indexes a reference cell, the relation builder 652 can subsequently compute a normalized residual $R_x$ as appropriate to the prediction of discourse from Equations (3) or (8) as appropriate, with X as the prediction of discourse value of the observation and $\hat{X}$ as computed above. Because of the quasi-temperature independence assumption, the normalized residual $R_x$ value computed under these conditions should be independent of the temperature tuple, as described above, and hence independent of the cell in the temperature map 654 used to make the prediction. In other words, any steady state observation, the temperature tuple ($T_{ei}(n)$, $T_{ci}(n)$) of which corresponds to one of the reference cells should yield (approximately) the same value of $R_x$, so long as the physical condition of the HVAC&R system does not change.

In the absence of system degradation and measurement noise, the residual $R_x$ should be zero or near-zero, as the predicted prediction of discourse value should be equal to the prediction of discourse value of the observation. System degradation, as understood in the art, appears as a bias in $R_x$ and this bias has been demonstrated to be beneficial for detecting system degradation. The sequence of resulting individuals residuals $R_x$, designated $R_x(m)$, where the index m indicates the mth such residual computed by the relation builder 652 when the temperature tuple ($T_{ei}(n)$, $T_{ci}(n)$) of an observation indexes a reference cell, can be used to infer the evolution of degradation of the system for purposes of compensation of observations.

Ideally, the normalized residual $R_x(m)$ will represent the true normalized difference between the measured value of the prediction of discourse and what the value the prediction of discourse would be with the equipment in newly maintained condition, but the prediction of discourse of the steady state observation used in computing the reference residual value $R_x(m)$ is assumed corrupted by additive noise as described above (Equation (10)). As a result, the sequence of reference normalized residuals may be somewhat noisy. By appropriate signal processing (e.g., filtering), an estimate of the normalized residual sequence can be made such that the effects of the noise in the observations is relatively insignificant.

In some implementations, the agent uses a simple filter, such as the EWMA filter discussed above in form by Equations (19) and (20), to reduce the noise in the reference residual sequence. In the computation of a reference residual estimate, the input sequence u(m) is the series of residuals $R_s(m)$ computed by the agent's residual estimator function per above, and the output sequence y(m) is denoted the system degradation sequence, $R_{Xsys}(m)$, where the "Xsys" subscript implies the specific system residual sequence for the prediction of discourse. An exemplary value for $\beta$ is 0.98 in some embodiments. An appropriate initial value for x(0) is 0.0.

As a next inventive step, suppose $R_{Xsys}$ represents the most recent estimate of the system degradation sequence $R_{Xsys}(m)$ in the form of a normalized residual. Suppose also that a steady state observation with prediction of discourse value X is made within the compensated learning interval 708 for which the cell in the temperature map 654 represented by the temperature tuple does not meet the requirement for an observed cell, that is, the OBSERVED metadata variable for this second cell is set to FALSE. Since $R_{Xsys}$ is representative of the entire system, then from Equation (3) or (8) above, dependent upon the prediction of discourse, an adjusted value of the observed power parameter, $f_x(X, n)$, that is more closely representative of what would have been observed in the absence of system degradation can be defined from $R_{sys}$ and X, as follows:

$$R_{Xsys} = \frac{X - f_x(X, n)}{f_x(X, n)} \tag{21}$$

Equation (21) can then be solved for the adjusted value of the power parameter:

$$f_x(X, n) = \frac{X}{R_{Xsys} + 1} \tag{22}$$

The adjusted observation $f_x(X, n)$ from Equation (22) above represents the best estimate by relation builder 652 of what the observation X(n) should have been had there been no system degradation and is based on the value of $R_{Xsys}$ at the time of the steady state observation and is the second, time varying compensation function described above applied to the prediction of discourse of the observation prior to updating the summary statistics of the cell of the corresponding temperature map 654. Updating the summary statistics of the cell corresponding to this observation with the "corrected" value $f_x(X, n)$ during the compensated learning interval 708 instead of the original measured prediction of discourse, X(n), as would be done during the bootstrap interval 706 should better represent the operation of the equipment in newly maintained condition. It is this value that is used by the relation builder 652 to update the sample statistics of a cell during the compensated learning interval 708.

The above discussion provides a way for the agent 314, using the relation builder 652, to extend the temperature map 654 beyond the cells that can be fully learned during the bootstrap interval 706. The process of maintaining the temperature map 654 for an individual observation is described in further detail in FIG. 8.

Figure 8:
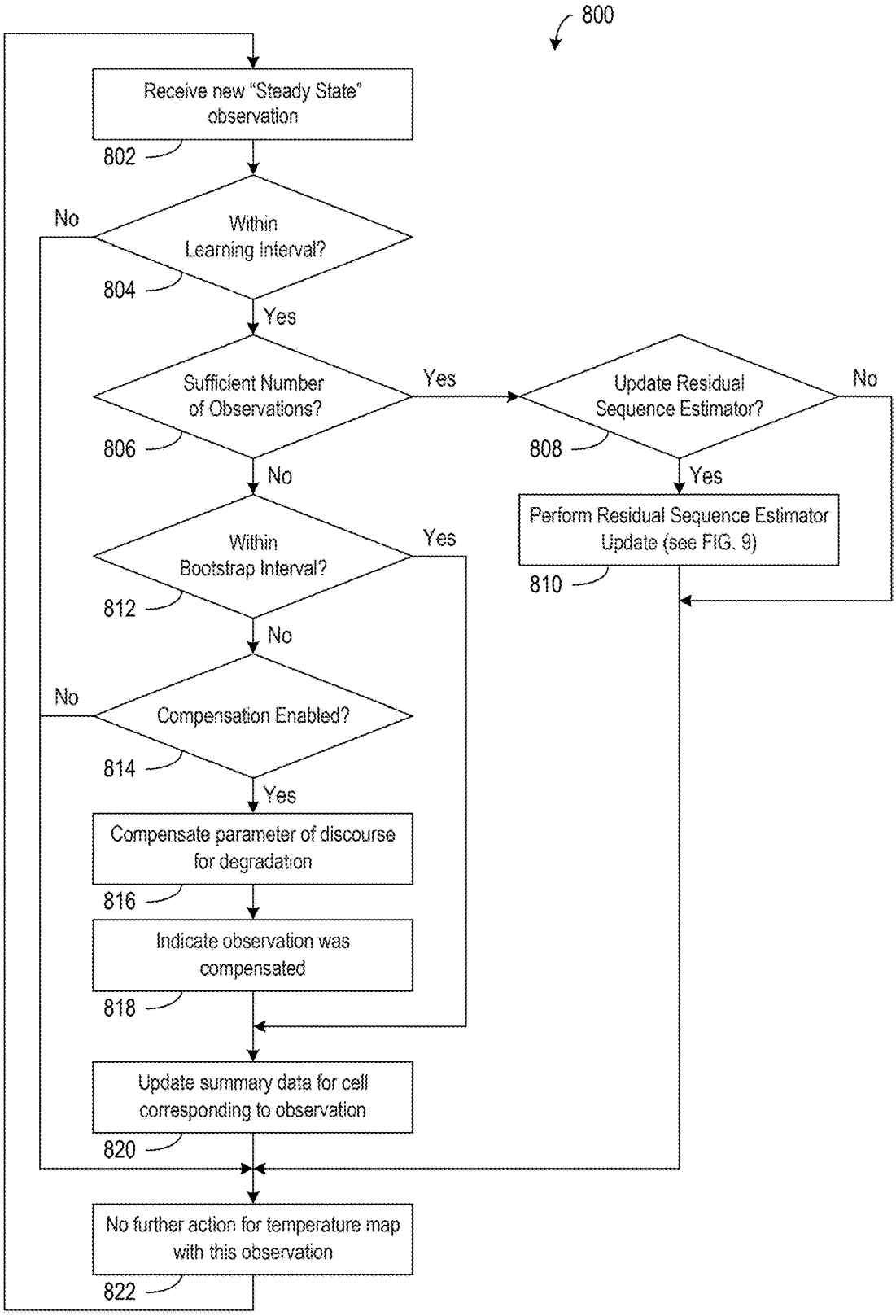
FIG. 8 illustrates a flowchart for determining whether to compensate an observation according to aspects of the disclosed embodiments.

Referring to FIG. 8, a flowchart 800 is shown illustrating a method that may be used by or with the agent 314 and the relation builder 652 of an active relation learner 650 per above to maintain the temperature map 654 for an individual observation. The method generally begins at 802 when the relation builder 652 receives a new steady state augmented observation $O_a(n)$ with temperature tuple ($T_{ei}(n)$, (n)) from VCC state generator 608. At 804, the relation builder 652 checks whether the time of the observation is within the learning interval 704. If not, then the observation is not used for maintaining the temperature map 654, and control flow proceeds to 822 where no further action is taken for the temperature map 654 with respect to this observation. If it is determined at 804 that the observation was obtained within the learning interval 704, then the relation builder 652 determines at 806 whether a sufficient number of observations have already been obtained (e.g., OBSERVED metadata variable for the cell corresponding to the observed temperature tuple ($T_{ei}(n)$, $T_{ci}(n)$) is TRUE).

If the determination at 806 is yes, then at 808 the relation builder 652 determines whether to update a residual sequence estimator for the observation being processed (e.g., is COMPENSATION metadata variable set to FALSE). If no, then the observation being processed is not a candidate for updating the residual sequence estimator $R_{Xsys}$, and the relation builder proceeds to 822 where no further action is taken for the temperature map 654 with respect to this observation. If the determination at 808 is yes (e.g., COMPENSATION metadata variable is TRUE), then the relation builder 652 proceeds at 810 to update the residual sequence estimate $R_{Xsys}$ referenced above. This estimator update function, which is further described in reference to FIG. 9 below, provides two details that are useful for maintaining the temperature map 654 during the compensated learning interval 708. First, the function updates the value of the residual sequence estimator $R_{Xsys}$. Second, it provides indication whether subsequent observations made within the compensated learning interval 708 should be compensated for system degradation prior to being used to update the temperature map 654. In some embodiments, this indication may be in the form of a Boolean system state variable, such as COMPENSATION_ENABLED, the generation of which will be defined subsequently in the presentation of FIG. 9. Following the update of the $R_{sys}$ estimate, flow proceeds to 822, where no further action is taken for the temperature map update with this observation.

Referring back to 806, if a sufficient number of observations have not been obtained for this cell (e.g., OBSERVED metadata variable is FALSE), then the relation builder 652 continues to process the observation as a candidate for updating the temperature map 654 by determining at 812 whether the observation was obtained during the bootstrap interval 706. If the time of the observation lies within the bootstrap interval 706, then the relation builder 652 uses the observation to update the cell corresponding to the temperature tuple of the observation at 820 by updating the summary data for the cell using the identity function of Equation (11) above (and also updating the OBSERVED metadata variable in the process).

If the determination at 812 is no, meaning the observation was not inside the bootstrap interval (706), but was instead within the compensated interval (708), then the relation builder 652 determines at 814 whether the observation should be compensated for degradation (e.g., COMPENSATION_ENABLED state variable is TRUE) prior to updating the summary data for the cell. If not (e.g., COMPENSATION_ENABLED state variable is FALSE), then the agent takes no further action for temperature map at 822. If observation compensation was enabled for the cell (e.g., COMPENSATION_ENABLED state variable is TRUE), then at 816 the relation builder 652 compensates the observed value of the prediction of discourse (i.e., compressor input power parameter or evaporator temperature drop) included in this observation for degradation by computing $f_X(X, n)$ using Equation (22) above, and indicates at 818 that the observation has been compensated (e.g., by setting COMPENSATED metadata variable to TRUE). The relation builder 652 thereafter updates the summary data for the cell at 820 using the adjusted value of the observed prediction of discourse $f_x(X, n)$ (and also updates the OBSERVED metadata variable in the process). At this point, no further action is taken for the temperature map with respect to this observation 822.

Figure 9:
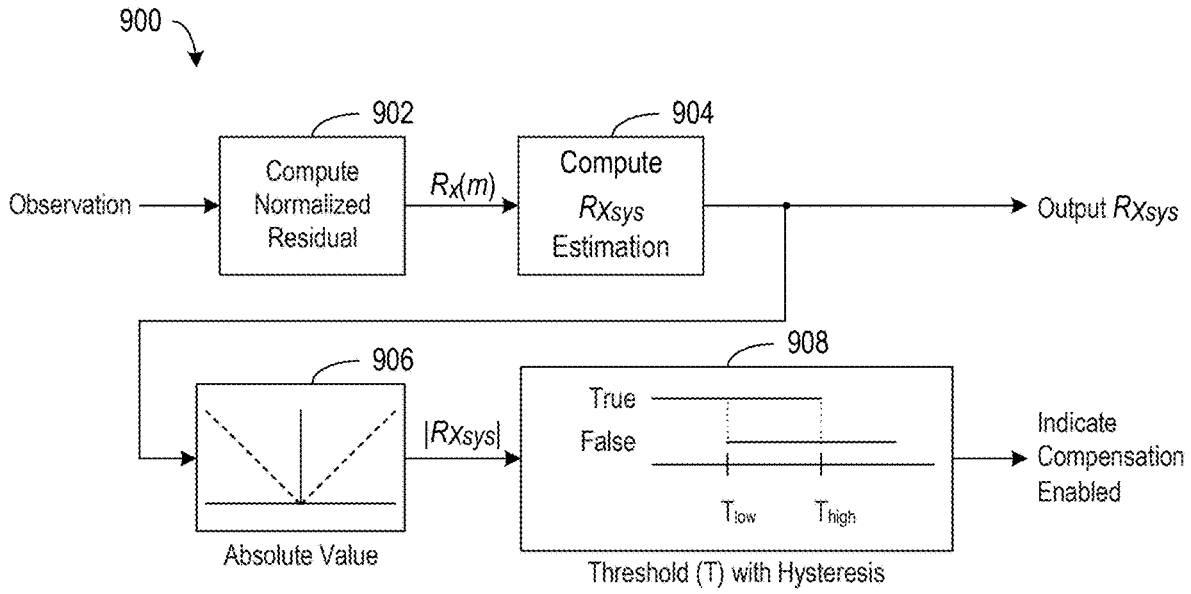
FIG. 9 illustrates a functional block diagram for updating a residual sequence estimator according to aspects of the disclosed embodiments.

FIG. 9 shows a functional diagram 900 illustrating additional details of the $R_{sys}$ estimator update process 900 referenced in FIG. 8. This estimator update process 900 provides the most recently updated value of the system degradation level, the residual sequence estimator $R_{sys}$, and updates the value of the COMPENSATION_ENABLED state variable. The process generally begins at 902 where the agent computes a normalized residual of the present observation using the relation learned from the temperature map 654 by computing g from the cell indexed by the pair ($T_{ei}$, $T_{ci}$) according to Equation (14), resulting in the computed residual $R_x(m)$ shown. Recall that according to FIG. 8, the cell corresponding to the temperature tuple ($T_{ei}$, $T_{ci}$) for this observation has the OBSERVED metadata variable set to TRUE, and the COMPENSATED metadata variable of the cell is set to FALSE. From the summary data of this cell, the predicted value $\hat{X}(n)$ is the mean value of the prediction of discourse, $\hat{X}(n)$, as given by Equation (14) above. From this predicted value $\hat{X}(n)$ and the observed value of the prediction of discourse in the observation, the normalized residual $R_x$ can be computed by Equations (3) or (8) above as appropriate to the prediction of discourse. The agent (via the relation builder 652) then feeds this normalized residual into an $R_{sys}$ estimator at 904, which may be a simple filter, such as an EWMA filter described above, that computes and outputs an $R_{sys}$ estimate.

The notion that the $R_{sys}$ estimate from 904 is suitable for use in compensating for system degradation is dependent upon the assumption that the residuals are quasi-temperature independent. This assumption has been observed to be reasonable when the magnitude of the residual sequence is small. The assumption begins to break down as the condition of the equipment degrades to the point that service is needed to bring the equipment back into proper function. In practice, it has been shown that in an HVAC&R application, when the magnitude of normalized residuals of the power parameter consistently exceeds about 4% to 5%, service is usually warranted, with a typical limit for the evaporator temperature drop of about 10% and that well before these limits are reached, the quasi-temperature independence assumption begins to break down. Attempting to compensate an observation for degradation under these conditions may have uncertain effects once the equipment is brought back into newly maintained state.

Accordingly, in some embodiments, the agent (via the relation builder 652) maintains a Boolean system state variable, COMPENSATION_ENABLED for each relation managed by relation builder 652, to limit the degradation compensation process based on the present value of $R_{Xsys}$ as computed by the $R_{Xsys}$ estimator 904. In one implementation, the value of $R_{Xsys}$ just computed by the $R_{Xsys}$ estimator 904 is the input to an absolute value function 906, the output of which is shown as $|R_{Xsys}|$. The absolute value $|R_{Xsys}|$ is then fed to a compensation threshold function 908, which operates based on a preset compensation limit and composition hysteresis. These parametric inputs are system dependent and may be represented by variables "CompensationLimit" and "CompensationHysteresis" in some embodiments. Typical values of these parameters are 0.02 and 0.002, respectively, for the power parameter residual and 0.05 and 0.005, respectively, for the evaporator temperature drop residual. These two parameters work together to create two threshold values, labeled $T_{low}$, and $T_{high}$ according to:

$$T_{low} = \text{CompensationLimit} - \text{CompensationHysteresis} \tag{23}$$

$$T_{high} = \text{CompensationLimit} + \text{CompensationHysteresis} \tag{24}$$

The output of this compensation threshold function 908 is the Boolean system state variable COMPENSATION_ENABLED mentioned above, which serves to indicate to the relation builder 652 whether the system residual $R_{Xsys}$ is within a range to assume it valid for applying degradation compensation. In some embodiments, upon initialization of the system, the state variable COMPENSATION_ENABLED is set to TRUE. If, after updating $R_{sys}$ and subsequently $|R_{Xsys}|$ the mth value of $|R_{Xsys}|$ is less than $T_{low}$, the mth value of the COMPENSATION_ENABLED state variable is always set to TRUE. Similarly, if the mth value of $|R_{Xsys}|$ is greater than $T_{high}$, the COMPENSATION_ENABLED state variable is always set to FALSE. For values of $|R_{Xsys}|$ in the range $T_{low} \leq |R_{sys}| \leq T_{high}$, the value of the COMPENSATION_ENABLED state variable remains unchanged.

Thus far, the embodiments herein have largely focused on the basic HVAC&R system 100 shown and described in FIG. 3, employing a single compressor, a single evaporator and a single condenser. VCC based systems that are more complex than the basic HVAC&R system discussed thus far may also benefit from the principles and teachings herein. Many commercial and industrial HVAC&R systems, for example, have multiple compressors rather than a single compressor. The multiple compressors are housed within a single mechanical package and operate singularly or in parallel in response to the heat load conditions.

Figure 10:
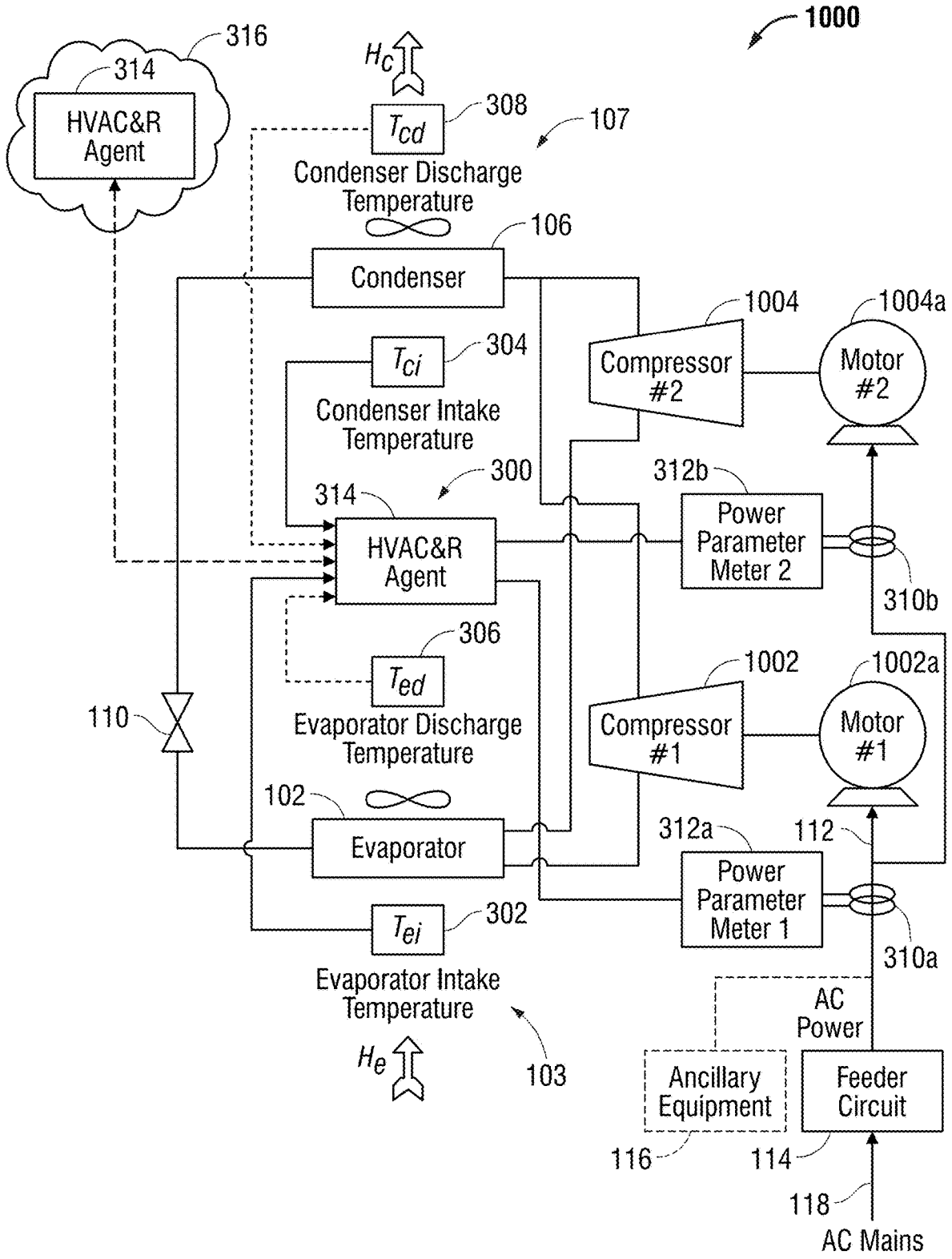
FIG. 10 illustrates an HVAC&R system having multiple compressors equipped with a monitoring agent according to aspects of the disclosed embodiments.

FIG. 10 shows an example of a HVAC&R system 1000 having multiple (e.g., two) compressors that is equipped with the early problem detection system 300 discussed herein. The early problem detection system 300 otherwise operates in a similar manner to that described above with respect to the HVAC&R system 100 of FIG. 1 using similar components, except that instead of a single compressor, the early problem detection system 300 predicts the compressor input power parameter for two compressors 1002 and 1004. As can be seen, each compressor 1002, 1004 is being driven by a corresponding motor 1002*a* and 1004*a*, with the input power for each motor 1002*a*, 1004*a* being measured by a respective current detection device 310*a* and 310*b* and power parameter meter 312*a* and 312*b*. In such an arrangement, it has been observed that the power consumed by each motor 1002*a*, 1004*a* individually when both motors are running is lower compared to the power consumed by either motor running alone. The input power measurements from each power parameter meter 312*a*, 312*b* are then provided to the agent 314, which processes the measurements to derive the CIPP relation for each compressor 1002, 1004 using separate temperature maps for the CIPP relation each compressor when operated singularly or in tandem, respectively.

In still other HVAC&R systems, multiple refrigerant loops may exist, each refrigerant loop supported by one or more compressors. In many of these systems, each refrigerant loop has its own condenser coil (and fan assembly in the case of a direct exchange), and the condenser coils may be physically separated in space in such a manner that they may experience significantly different intake temperatures. This is often the case, for example, with rooftop units in which for certain parts of the day, one condenser coil and the rooftop nearby is directly in the sun whereas the other side is shaded. For this reason, there may be one condenser intake temperature sensor required for each condenser assembly. Many of these multi-refrigerant-loop systems share an interleaved evaporator coil in which the refrigerant of the individual loops is maintained separate from one another, but all of the loops are cooling the same fluid flowing across the interleaved evaporator. In this case a single evaporator intake temperature sensor and a single evaporator discharge sensor may be employed even though there are multiple condenser intake temperature sensors.

In some chilled water systems, each refrigerant loop has its own condenser coil, likely physically separated in space, and its own evaporator coil separated in space. In these systems, each refrigerant loop chills its own fluid and the fluids are mixed upstream. In this type of system, there may be more than one evaporator intake temperature sensor and more than one evaporator discharge sensor. From a practical design perspective, it is preferable to structure the system so that each compressor is permitted to have its own virtual condenser and evaporator intake temperature sensor for purposes of managing the various CIPP and ETD relations that may be needed, each CIPP and ETD relation requiring a separate relation learner for each state value Sc(n) per above for which the compressor is in the ON state as encoded per Table 2 above.

Consider the case of an interleaved evaporator coil in a direct exchange system. For a given intake airflow temperature and rate (mass flow rate) across the evaporator function, the power required of one compressor in a multi-compressor system will be dependent upon the states of the other compressors. If two compressors are employed to cool the air, it is expected that the power consumed by either compressor operating in tandem will be less than that of the same system under the same conditions if only a single compressor is running. The important point from a CIPP perspective is that the operating characteristics of a given compressor in a system may be dependent upon the state of the other compressors in the system. Accordingly, a CIPP relation is preferably maintained for every compressor for each combination of compressors for which said compressor is operational.

Similarly, multiple versions of an ETD relation may be necessary in a multiple compressor system. In an interleaved evaporator system with multiple refrigerant loops, a different EDT relation can be expected dependent upon which compressors are "on" and "off". Intuitively, for a fixed condenser intake temperature, a larger evaporator temperature drop would be expected for the system of FIG. 10 when both compressors are in the ON state than when only one compressor is ON.

It should be noted that in the foregoing embodiments, the agent has little control over the condenser intake temperatures, as the intake temperatures can be dependent upon many factors, including the weather, the time of day, the orientation of the condenser, and so forth. In operation, the agent is simply presented with the intake temperatures as observations of the HVAC&R system to be monitored, each observation comprising a minimum of one or more condenser intake temperature $T_{ci}$, one or evaporator intake temperature $T_{ei}$, and a compressor input power parameter P for each compressor in the system. The compressor input power parameter P may be compressor current, real power, volt-amperes, and the like.

As a matter of learned or commissioned configuration, to each compressor is assigned an appropriate condenser intake temperature measurement, or a combination of compressor intake temperature measurements, an evaporator intake temperature measurement or a combination of evaporator intake temperature measurements, and the measured power parameter for that compressor. In some systems, a single condenser intake temperature may suffice for all compressors, but in some systems it can be advantageous to have different condenser intake values, particularly when there is more than one condenser that may be oriented differently from one another. Similarly, in chiller systems, each chiller compressor unit has its own evaporator function and it can be advantageous to assign a separate temperature to each intake. In other systems, an interleaved evaporator assembly can be employed, in which case a single temperature measurement can be sufficient for all compressors in all refrigerant loops that incorporate the interleaved evaporator.

In some systems, multiple compressors may be employed in a single refrigerant loop, while in other systems incorporating interleaving or condenser and evaporator units in close proximity to one another, the characteristic learned by the agent for a given compressor may be a function of the "compressor state" of the system (i.e., which compressors are on or off at a given time).

Also, the fluids at the intakes referred to above need not be air. Water or a chemical mix (such as ethylene glycol and water or a saline solution) can serve as the evaporator ambient fluid or the condenser ambient fluid. In a so-called chilled water system, the liquid evaporator ambient fluid is circulated as a liquid through the system. This chilled liquid fluid can be circulated through a building to different radiators where it can be used to cool remotely. This can be useful for cooling large areas, such as schools, hospitals and commercial buildings, as well as more commonplace spaces, such as supermarket refrigerators and freezers where the chemical mix can be cooled to well below the freezing point of water. The condenser ambient can likewise be a liquid. This can be useful in large chilled water systems where the condenser fluid can be circulated over the condenser coil of a system located inside a building and the heat transferred to a heat exchanger located outdoors. Such a system can have an advantage over direct exchange systems insofar as not requiring long runs of refrigerant lines operating under high pressure to and from an outdoor heat exchanger. A very common chilled water system called an air-cooled chiller uses direct exchange of heat through the air as the condenser ambient, while cooling a liquid as the evaporator ambient fluid. This allows the entire mechanical system including the compressor(s) and condenser fans to be located outdoors or in an out-building.

In a heat pump system operating in the heating mode, a reversing valve reverses the roles of the condenser and evaporator as described in FIG. 1, with the condenser function located within the conditioned space and the evaporator function pulling heat from the outdoor ambient. The physical heat exchangers do not move, but their roles are reversed. The evaporator function (now outside) absorbs heat from the outdoor ambient air and rejects this heat into the air of the conditioned space via the condenser function (now inside). In this case, it is normal for frost to condense onto the evaporator coil function (outside) which must be defrosted occasionally as part of normal operation.

The extension of the disclosed monitoring and early problem detection system to more complex HVAC&R systems thus provides many benefits. Because of the potential for interaction between compressors in multi-compressor systems, in some embodiments the agent assigns and maintains a separate relation learner 650 each for the CIPP relation and ETD for each compressor in the system and for each compressor state, Sc(n), in which the compressor is operational or in the ON state. For example, in a three-compressor system in which a total of 8 individual combinations of compressor on/off states are possible, a total of 12 pairs of relation learners are required to learn the CIPP relations and ETD relations, one pair for each compressor for each individual state, Sc(n) for which the compressor is ON.

In some embodiments, for a given augmented observation $O_a(n)$, a relation learner assigned in this way is considered active per above if it a) it has been assigned by the agent to the specific compressor in the encoded state Sc(n) for which the compressor is encoded ON per Table 2 above and b) the appropriate "stable" state Sp(n) in the case of the CIPP relation or Se(n) in the case of the ETD relation) is TRUE. The test for active relation learners is made for each observation and all such relation learners operate as described above. A consequence of this embodiment is that even though multiple relation learners are assigned to a given compressor to represent the different combinations of compressors, at most one pair of relation learners is active per compressor at a given time for an observation. By selecting only non-null residuals and relative COP values for the compressor, a single series of residuals for each compressor can be presented to the degradation processor 614, appropriately expanded in scope to monitor each compressor.

While having a direct, isolated measurement of a compressor power parameter can yield the most accurate predictions of that compressor power parameter as described herein, and the method and has been described in these terms, a signal simply responsive to a compressor power parameter can similarly provide useful information and systems so-instrumented can be valuable in detecting HVAC&R system degradation. In particular, in many HVAC&R systems, it is simpler to monitor a power parameter of the power feed to the entire unit or partial unit instead of direct measurement of the compressor. Many, if not most, HVAC&R units are driven by isolated branch feeder circuits that may have current or power measurement capability built in to the circuit breakers. Many of these circuit breakers provide the capability for remote activation and many residential split-systems, packaged units and commercial rooftop units have a disconnect located physically near the unit to allow an HVAC&R technician to electrically isolate the unit for the purpose of service. The power feed to the entire unit often includes the power provided to condenser fans, and multiple compressors, which add to the power consumed by the compressor.

The entire or partial unit power feed embodiment above is shown as an alternative implementation in FIGS. 3 and 10 via dashed lines. As shown in FIGS. 3 and 10, in some embodiments, instead of (or in addition to) a power parameter meter such as the power parameter meter 312, the input to the power parameter processor 604 can be provided by an energy meter embedded in the branch feeder circuit 114 or included with an electrical disconnect box or other ancillary equipment 116. The energy meter may be a discrete meter that forms part of the branch feeder circuit 114, or it may be integrated in the feeder circuit 114, for example, in a circuit breaker of the feeder circuit 114. In either case, the power measured by the energy meter reflects the entire or partial unit power input to the HVAC&R system 100. This feeder circuit power input may then be provided to the power parameter processor 604 of the agent for detecting HVAC&R system degradation in a similar manner to that described for the power parameter meter 312.

Those having ordinary skill in the art will appreciate that other implementations are available within the scope of the present disclosure. From a practical consideration, a desirable characteristic of a learning system to monitor HVAC&R systems for problems that are developing is to quickly become functional and not require a long training interval over which time the equipment is not monitored for degradation. That is, to the extent practical, the agent 314 should learn the time invariant CIPP relation and the ETD relation on-the-fly.

Figure 11A:
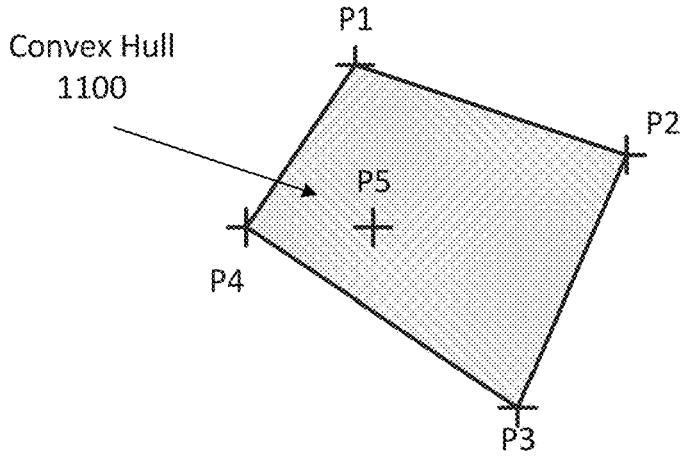
FIGS. 11A-11C illustrate exemplary convex hulls for determining whether to present a CIPP or ETD prediction according to aspects of the disclosed embodiments.
Figure 11B:
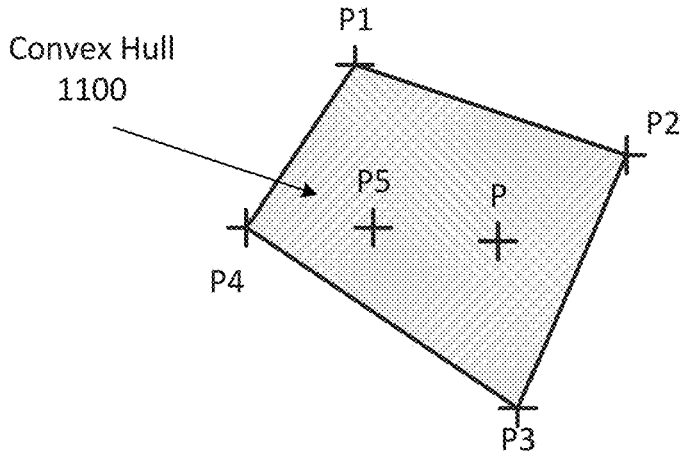
Figure 11C:
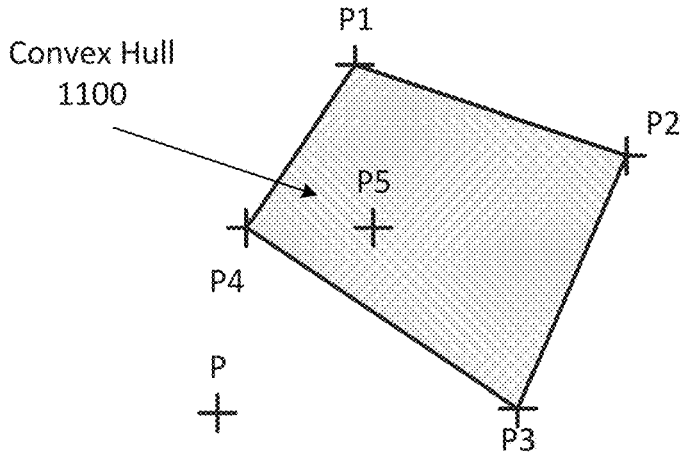

Turning now to FIGS. 11A-11C, recall from above that in some embodiments the agent generates a prediction only if the temperature tuple ($T_{ei}(n)$, $T_{ci}(n)$) for the observation of interest lies within a convex hull of the set of observed tuples. In these embodiments, a newly observed temperature tuple must lie within a convex hull formed of previously observed tuples (points) that were in the original set used by the agent to learn the CIPP relation. This ensures that the agent is interpolating between tuples (points) that were already "seen" by the agent rather than extrapolating from unseen points. In some embodiments, the convex hull can be defined as follows. Given a set of training points {X} in a Euclidean space, the convex hull H(X) of the set {X} is the smallest set containing the points in {X} for which every point on any line between any two points in H(X) lies entirely within H(X).

FIGS. 11A-11C graphically illustrate examples of hull convexity in accordance with some embodiments. Referring first to FIG. 11A, an exemplary convex hull 1100 is created by a set {X} that contains five 2-dimensional tuples, labeled P1 to P5, respectively. The line segments P1→P2, P2→P3, P3→P4 and P4→P1 form the edges of the convex hull 1100 defined by the set {X}. In this example, the tuples P1 to P5 defining the edges of the convex hull 1100 are included in the convex hull. The hull is "convex" in that any line segment in the hull, including those line segments formed by tuples on the edges of the hull, lies completely within the hull. The tuple P5 also lies within the hull. It can be seen visually that the convex hull 1100 is the smallest set of tuples that contains all the tuples in the set {X}, and is convex.

FIG. 11B shows an example of a tuple P that lies within the convex hull 1100. If an interpolated model made from the set of tuples {P1 . . . P5} is applied to the tuple P, the model is interpolating between the values of the tuples within the set.

FIG. 11C shows an example of a tuple P that lies outside the convex hull 1100. In this example, a line drawn between P and, say P5, contains points that lie within the convex hull 1100 as well as points that lie outside the convex hull. If an interpolated model made from the set {P1 . . . P5} is applied to the tuple P, the model is extrapolating from the values of the tuples within the set. The accuracy of extrapolation, in general, is generally less precise than interpolation. Accordingly, the agent requires that any tuple for which a predicted compressor input power parameter value is to be determined needs to lie within the convex hull of observed tuples.

As discussed, embodiments of the monitoring agent herein use a CIPP relation to predict compressor input power parameter values for the HVAC&R system in the "newly maintained" condition and compare those values with observed compressor input power parameter values to detect performance degradation early. Embodiments of the monitoring agent can similarly learn the ETD relation and compute a sequence of normalized temperature drop residuals that can similarly detect performance degradation early. The agent can also use the combination of CIPP and ETD relations to not only detect the existence of a problem, but also to indicate the possible nature of the problem. As explained, the process of learning the ETD relation via a separate temperature map is nearly identical to that of learning to predict the expected power parameter and normalized power parameter residual, requiring simply that the evaporator temperature drop be substituted for the compressor input power parameter. The mechanism for learning the evaporator temperature drop while the system is degrading is also identical, although optionally, the compensation limits and compensation hysteresis in Equations (23) and (24) above may be individually selected for the CIPP and ETD relations as required or desired, as can the lead blanking intervals 402 and 422. The resulting ETD normalized residual sequence is then presented to the degradation detection processor 614, along with the CIPP normalized residual sequences, as discussed.

In addition to the above, the ability of the monitoring agent to simultaneously predict an expected power parameter sequence and expected evaporator temperature drop sequence for a given observation along with the measured values of power parameter and evaporator temperature drop, E, computed from $T_{ed}$ and $T_{ei}$ using Equation (5) allows the agent to compute a relative COP for the observation, as discussed. This offers a number of additional benefits. For one thing, a relative COP can be used not only to detect degradation, but also quantify the energy usage and cost attributable to the degradation in some cases. A monitoring agent such as described above that can quantify the degradation in the form of a relative COP, relative to the learned, normal condition of the system, provides significant advantages. For example, knowing that a system has degraded in performance to a certain percent (X %) of its original efficiency implies that, under the observed conditions, the system costs about 100/(X %) more to operate than when the system was newly maintained. As the agent can monitor an input power parameter of the compressor (as described above) and the evaporator temperature drop to compute the relative COP, the agent can also provide an estimate of the power consumed, and therefore the running cost of system degradation, and thus not only declare a problem when a problem is detected, but also declare a sense of urgency when the degradation becomes too costly.

As discussed with respect to FIG. 6, the monitoring agent 314 (and the prediction processor 606 therein) uses the relative COP processor 613 (and the CIPP processor 610 and the ETD processor 612) to compute the relative COP. In some embodiments, the relative COP processor 613 can compute the relative COP using the measured power parameter measurement P(n) and measured evaporator temperature drop measurement E(n) from the augmented observation $O_a(n)$, furnished by the VCC state generator 608, along with the power parameter prediction $\hat{P}(n)$ furnished by the CIPP processor 610 and evaporator temperature drop prediction $\hat{E}(n)$ furnished by the ETD processor 612 to compute a relative coefficient of performance, or rCOP sequence, as used herein.

As a matter of background, the "rate" form of the instantaneous coefficient of performance, COP, of an HVAC&R system is usually defined as:

$$COP = \frac{h_t}{Pwr_{system}} \tag{25}$$

where $Pwr_{system}$ is the total electrical power delivered to the system including the compressor(s), fans, controls, pumps, and so on, and $h_t$ is the total rate of heat removal from (or in addition to, in the case of heat pumps) the air passing over the evaporator coil. It is common to use "h" as a rate of heat transfer in Watts or J/S. This total heat rate comprises the sensible (i.e., can be sensed) heat rate, $h_s$, which manifests itself in a drop in temperature across the evaporator, and latent heat rate, $h_l$, which is the rate of heat lost by the air as moisture condenses on the evaporator coil:

$$h_t = h_s + h_l \tag{26}$$

The COP defined by Equation (25) above captures the efficiency of the equipment, but is difficult and expensive to measure. As might be expected, it is a sensitive function not only of the condition of the equipment, but also the intake temperature tuple ($T_{ei}$, $T_{ci}$), humidity, and the mass airflow rates of the heat transfer fluid at the intake and discharge of the evaporator. To measure the input power to the total system requires the application of a power meter at the power feed to the equipment which, as discussed briefly above, can be expensive. Measuring the total heat removed by the evaporator from the conditioned space usually involves employment of expensive mass airflow sensors on both the intake and discharge of the evaporator, both of which are impractical and prohibitively expensive in most commercial systems. There are other ways to estimate the COP of the system by measuring certain internal conditions of the VCC cycle, involving measuring actual refrigerant temperatures and pressures, but these too may be expensive and impractical for all but the most sophisticated HVAC&R systems.

HVAC&R systems are often characterized by the equipment manufacturers to provide an indication of system performance relative to other, similar equipment. For instance, it is common to provide an air conditioning system with a "seasonal energy efficiency rating" or SEER rating in which a weighted average of the COP of the equipment, measured under carefully controlled conditions in a laboratory under several pre-defined sets of indoor and outdoor ambient conditions, provides an indication of the expected efficiency and cost of operation of the equipment. While this rating can be useful in selecting one piece of equipment over another, it does not address the question of equipment degradation, i.e., how is the equipment behaving "right now" under the conditions experienced "right now" compared to when it was in new or newly maintained condition. This measure is useful in determining when an HVAC&R system may need repair or maintenance.

To address this condition, the relative COP (or rCOP) can be defined as follows:

$$rCOP = \frac{COP_{measured}}{COP_{ref}} \tag{27}$$

where $COP_{measured}$ is the instantaneous COP measured or estimated from the conditions of the equipment and the present environment into which it is placed and $COP_{ref}$ is a reference COP, computed when the equipment is in newly maintained condition and placed into the identical environment. For purposes of detecting system degradation and its effect on performance for a piece of HVAC&R equipment that has already been selected and installed, this is a more practical measure because it can show how inefficient it has become relative to the newly maintained condition. An rCOP of 0.8 per the definition in Equation (27) above means that the equipment in its present physical condition and present operating environment is removing heat at a rate 80% of what it should be in newly maintained condition. To a first approximation, the system needs to consume about 1/0.8=1.25 times more energy to remove the same heat from a conditioned space, which means it costs about 25% more to operate in the present condition than it would were it in newly maintained condition. Knowing this cost factor (computed at 1.25) and the present rate of usage, the degree or extent of system degradation can be determined both in terms of energy wasted and in cost if the cost of energy is known.

The relative COP defined above using the classic definition of COP, while useful, suffers from the many practical problems addressed by the embodiments herein. First, to be useful, the classic definition of relative COP requires that a reference model for COP be constructed operable over the entire expected operating range of intake temperatures ($T_{ei}$, $T_{ci}$) above. If the reference model is not furnished by the equipment manufacturer, it must be learned on-site by some method. The relation learner process 650 of the embodiments herein could be employed to learn the actual COP of the system, but the instrumentation required to measure the actual COP of the equipment is still prohibitively expensive in most applications. If a mathematical model of the relative COP is made using regression or other typical machine learning techniques, there is the added concern about whether the model adequately represents the present external operating conditions of the system.

An additional aspect of the embodiments herein is based on the much simpler instrumentation of the embodiments herein and provides a very useful relative COP proxy value for purposes of detecting degradation and estimating wasted energy and associated cost. These embodiments use the power parameter predictions of the CIPP processor 610, $\hat{P}(n)$, and evaporator temperature drop values of the ETD processor 612, $\hat{E}(n)$, when both are valid (i.e., obtained when the system is operating in both refrigerant steady state and thermal steady state per above) along with the measured values of P(n) and E(n). Since the relation learner 650 learns to predict these residual sequences quickly and accurately, a system based on these residual sequences can quickly provide an approximate rCOP estimate and would also know when this estimate is likely to closely approximate the rCOP value and when it may not, declining to make an estimate when confidence is not high.

The rCOP processor 613 is operable to provide a sequence of approximate relative COP values, rCOP(n) to the degradation detection processor 614 using:

$$rCOP(n) = \frac{E(n)}{\hat{E}(n)} \times \frac{\hat{P}(n)}{P(n)} \tag{28}$$

for those quantities corresponding to the nth observation for which $\hat{E}(n)$ and $\hat{P}(n)$ have not been assigned the value "NULL" by the ETD processor 612 and CIPP processor 610, respectively, and the value NULL otherwise. The output of rCOP processor 613, designated as the sequence rCOP(n) computed per above, directly feeds degradation detection processor 614.

For background, the form of rCOP defined in Equation (28) above may be explained as follows. Deriving the rCOP approximation begins with defining a version of Equation (27) for the coefficient of performance, denoted COPC, that is more suited to the instrumentation generally available at this time:

$$COPC = \frac{h_s}{W_c} \tag{29}$$

where $W_c$ includes the electrical power delivered to the compressor. In this more general definition, the latent heat $h_l$ in Equation (26) is ignored and only sensible heat $h_s$ is considered. The effect of neglecting the latent heat will be discussed below.

With the assumptions above in place, the rate of sensible heat removal from the air, $h_s$, by the evaporator is given by.

$$h_s = \dot{m}_e C_{pe} E \tag{30}$$

where E is the measured temperature drop across the evaporator coil, $\dot{m}_e$ is the mass air flow rate across the evaporator $C_{pe}$ is the specific heat of the fluid flowing across the evaporator. If each of these parameters is assumed constant, the mass air flow rate $\dot{m}_e$ and specific heat $C_{pe}$ both referred to in FIG. 2 above can be merged into a single COPC constant, $K_{copc}$:

$$K_{copc} = \dot{m}_e C_{pe} \tag{31}$$

and the equation for COPC becomes:

$$COPC = K_{copc}\frac{E}{W_c} \tag{32}$$

As will be seen later herein, the COPC constant $K_{copc}$ is useful for deriving a relative COP.

By measuring the temperature drop across the evaporator, $E_m(n)$, and the compressor power $W_{mc}$ (n) at an observation n in time, an instantaneous measured COPC of the system, $COPC_m$, can be computed using the same constant $K_{copc}$:

$$COPC_m(n) = K_{copc}\frac{E_m(n)}{W_{mc}(n)} \tag{33}$$

Now, using this same definition, assume there exists a reference COPC value, $COPC_r$, that represents what the COPC should be under the present observation of measured temperatures ($T_{ei}(n)$, $T_{ci}(n)$) if the equipment is operating in newly maintained condition. A relative COP, rCOP(n), for this observation may be written in terms of $COPC_m(n)$ and $COPC_r(n)$ as:

$$rCOP(n) = \frac{COPC_m(n)}{COPC_r(n)} \tag{34}$$

In a manner identical to Equation (33) above, the reference $COPC_r(n)$ may take the form:

$$COPC_r(n) = K_{copc}\frac{E_r(n)}{W_{rc}(n)} \tag{35}$$

where $W_{rc}(n)$ is a theoretical reference electrical power value in some implementations, yet undefined but will be eliminated from the discussion subsequently, and $E_r(n)$ is a corresponding reference evaporator temperature drop. Substituting the equations for the measured COPC (Equation (33)) and reference COPC (Equation (35)) into the equation for relative COP (Equation (34)) and arranging terms gives:

$$rCOP(n) = \frac{E_m(n)}{E_r(n)}\frac{W_{rc}(n)}{W_{mc}(n)} \tag{36}$$

Under the assumptions of constant line voltage and power factor above, the following relationship holds completely for any two measures or estimates of power, $W_{c1}$ and $W_{c2}$ and the corresponding a power parameter, such as power, current, volt-amperes, and so on, $P_1$ and $P_2$:

$$\frac{W_{c1}}{W_{c2}} = \frac{P_1}{P_2} \tag{37}$$

Substituting Equation (37) into Equation (36) above yields:

$$rCOP(n) = \frac{E_m(n)}{E_r(n)}\frac{P_{rc}(n)}{P_{mc}(n)} \tag{38}$$

Where $P_{rc}(n)$ is the value of the power parameter corresponding to $W_{rc}(n)$ in Equation (36), and $P_{mc}(n)$ is the value of the measured power parameter corresponding to $W_{mc}(n)$ in Equation (36). Referring to FIG. 6A of the embodiments herein, for the nth augmented observation as furnished by the VCC state generator 608, the terms $E_m(n)$, $E_r(n)$, $P_{rc}(n)$ and $P_{mc}(n)$ in Equation (38) are immediately recognized from FIG. 6A to be E(n), $\hat{E}(n)$, $\hat{P}(n)$ and P(n) respectively for the nth augmented observation $O_a(n)$. When these values are substituted into Equation (38) above, Equation (28) immediately follows. Thus, the rCOP processor 613 computes the sequence rCOP(n) by evaluating equation (28) above for each observation in which both $\hat{P}(n)$ and $\hat{E}(n)$ are not NULL, assigning the value NULL to the rCOP(n) in observations where both $\hat{P}(n)$ or $\hat{E}(n)$ are assigned non-NULL values.

Several explicit assumptions are made in the computation of rCOP given by Equation (28). First, the mass air flow rate, $\dot{m}_e$ is approximately constant at a given evaporator intake temperature. Also, the air flowing across the evaporator is "dry," meaning the latent heat component of heat removal from the air is dominant. This is equivalent to saying that all the heat removed from the air is sensible (i.e., can be sensed). Further, the air is modeled as an ideal gas with specific heat $C_{pe}$, and is dry enough that the latent heat involved in condensation of the moisture on the evaporator coil is not significant. Finally, line voltage and compressor power factor are roughly constant in all cases, and the equipment is operating in quasi steady state, meaning that refrigerant is in the correct state everywhere in the refrigerant loop and condenser and evaporator temperature transient conditions have abated.

In the real world, one or more of the above assumptions may not hold true, such as the assumption of constant mass flow across the evaporator, which can be greatly affected by dirty air filters usually inserted in-line with the evaporator intake to prevent particulate matter from fouling the evaporator, to a large degree and by the fact that moisture entering the evaporator intake usually results in condensation, reducing the humidity at the discharge and hence the density. But despite any real-world limitations, embodiments of the present disclosure presented herein have proven to be both practical and beneficial.

In the case of a dirty air filter, the mass air flow rate $\dot{m}_e$, across the evaporator is reduced, causing the evaporator surface to cool. This results in two phenomena. First, the cooler evaporator causes a larger evaporator temperature drop to be measured than expected. Second, the cooler evaporator can cause the pressure in the evaporator to be reduced, reducing the power required to move refrigerant through the evaporator. The increase in evaporator temperature drop combined with a decrease in compressor power causes the rCOP value as given by Equation (28) to be greater than 1.0, or 100%. As such, the rCOP value may be confusing except when the condition manifests itself in a positive evaporator normalized residual combined with a negative power parameter residual. In this case, the rCOP value is suspect, but the combination can be used to infer a dirty filter condition and/or other types of air flow occlusion and issue an appropriate alert signal. Simply replacing the dirty filter with a clean one can eliminate this condition, exposing the more accurate rCOP value.

Figure 12A:
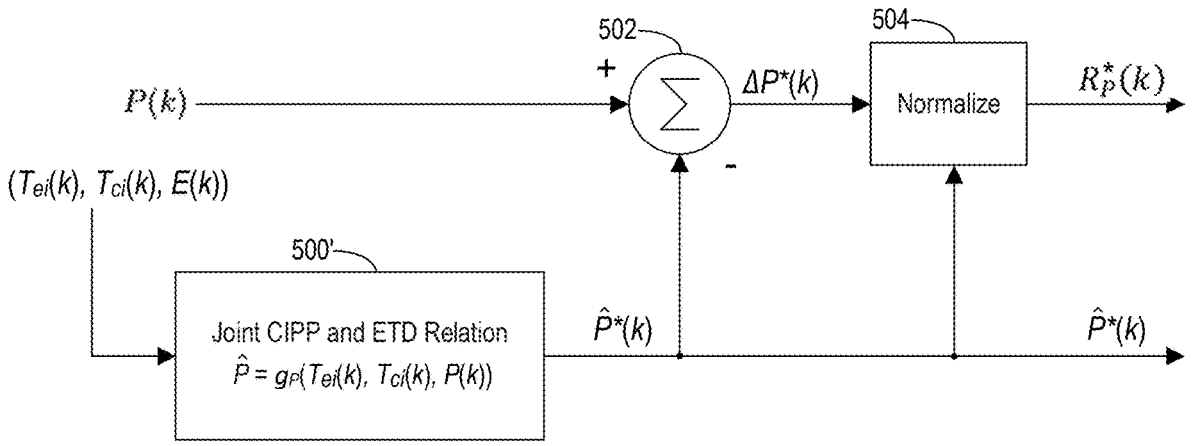
FIGS. 12A and 12B illustrate an alternative way of using learned relations according to aspects of the disclosed embodiments.
Figure 12B:
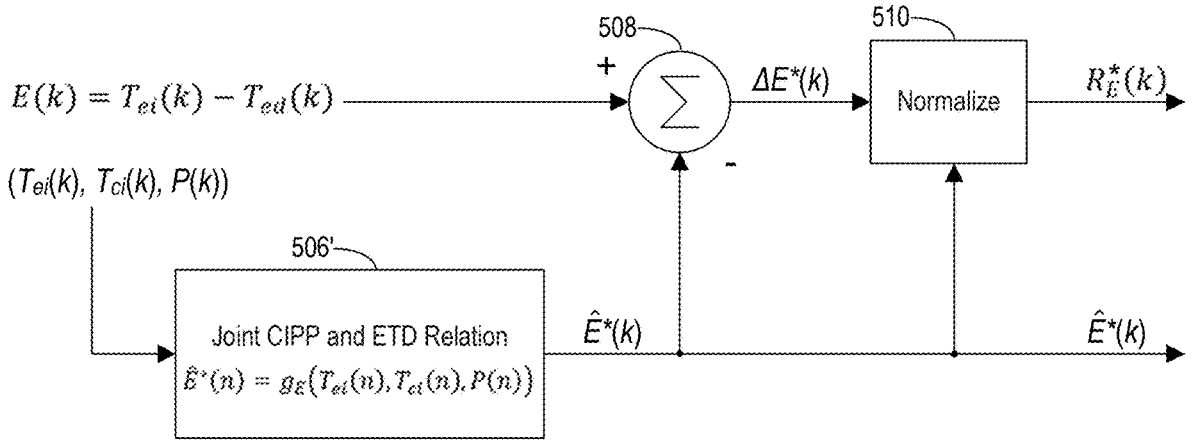

Turning next to FIGS. 12A and 12B, further techniques for computing relative COP in addition to (or as alternative of) the techniques described thus far are now described. As discussed, the temperature maps 654 (FIG. 6E) of the learned CIPP relation 500 and the learned ETD relation 506 (FIGS. 5A and 5B) above, learned using the relation builder 652 (FIG. 6E), represent the compressor current and evaporator temperature drop of the HVAC&R system in newly maintained condition. In some embodiments, the information contained in these respective CIPP and ETD temperature maps 654 can be combined in a novel way to model a virtual HVAC&R system based on the actual HVAC&R system in newly maintained condition, but which can predict "correct" operation under conditions outside that of newly maintained condition, from which alternative normalized residuals and relative COP "scores" can be constructed. Such a model of a virtual HVAC&R system may be software based, for example, a virtual HVAC&R executing on a network or cloud computing system.

In the form presented thus far, the temperature tuple ($T_{ei}(n)$, $T_{ci}(n)$) of the nth augmented observation $O_a(n)$ serves as the indexing element into the temperature maps, resulting in the predicted power parameter $\hat{P}(n)$ and predicted evaporator temperature drop $\hat{E}(n)$ as described previously, each representing the operation of the physical HVAC&R system in newly maintained condition. One virtual HVAC&R system that may be constructed according to the subsequent teachings herein allows a new evaporator temperature drop prediction, $\hat{E}^*(n)$, to be constructed as a function of the observed triple ($T_{ei}(n)$, $T_{ci}(n)$, P(n)):

$$\hat{E}^*(k) = g_E(T_{ei}(k), T_{ci}(k), P(k)) \tag{39}$$

Equation (39) is based on the physical system in newly maintained condition, and is adapted to predict the same (approximate) value $\hat{E}(n)$ per Equation (6) and the teachings provided above when the observed power parameter P(n) is exactly the learned value of the physical system in newly maintained condition, $\hat{P}(n)$, but allows for prediction of an equivalent evaporator temperature drop value, different from $\hat{E}(n)$, when P(n) is not the learned value of the physical system, as if for a given observed tuple ($T_{ei}(n)$, $T_{ci}(n)$) the system could operate "normally" at a different power parameter value, specifically that of the observation, P(n), with the resulting expected (or predicted) temperature drop given by Equation (39). In some embodiments, the function $g_E(T_{ei}(n), T_{ci}(n), P(n))$ is a parametric predictor with coefficients uniquely determined by the contents of the CIPP temperature map and ETD temperature map described above for the specific observation in a manner to be discussed.

From this new evaporator temperature drop, an alternative relative COP value, designated $rCOP_E(n)$, can be constructed from Equation (28) above by noting that in this case, the observed and predicted values of P(n) and $\hat{P}(n)$ are equal and substituting the computed value $\hat{E}^*(n)$ for $\hat{E}(n)$, resulting in:

$$rCOP_E(n) = \frac{E(n)}{\hat{E}^*(n)} \tag{40}$$

In an analogous manner, a second virtual HVAC&R system can be constructed according to the subsequent teachings herein that allows a new power parameter prediction $\hat{P}^*(n)$ to be constructed as a function of the observed triple ($T_{ei}(n)$, $T_{ci}(n)$, E(n)), symbolically:

$$\hat{P}^*(n) = g_P(T_{ei}(n), T_{ci}(n), E(n)) \tag{41}$$

Like Equation (39) above, Equation (41) is based on the physical system in newly maintained condition, and is adapted to predict the same (approximate) value $\hat{P}(n)$ per Equation (1) and the teachings above when the observed evaporator temperature drop E(n) is exactly the learned value of the physical system in newly maintained condition, $\hat{E}(n)$, but allows for prediction of an equivalent power parameter value, different than $\hat{P}(n)$, when E(n) is not exactly the learned value of the physical system, as if for a given tuple (Tei, Tci) the system could operate "normally" at a different evaporator temperature drop value, specifically that of the observation, E(n), with the resulting expected (or predicted) power parameter value given by Equation (41). In some embodiments, the function $g_P(T_{ei}(n), T_{ci}(n), E(n))$ is a parametric predictor with coefficients uniquely determined by the contents of the CIPP temperature map and ETD temperature map described above for the specific observation in a manner to be discussed.

In this case, an alternative relative COP value, designated $rCOP_P(n)$ can be constructed from Equation (28) above by noting that in this case, the observed and predicted values of E(n) and $\hat{E}(n)$ are equal and substituting the computed value $\hat{P}^*(n)$ for $\hat{P}(n)$, resulting in:

$$rCOP_P(n) = \frac{\hat{P}^*(n)}{P(n)} \tag{42}$$

FIGS. 12A and 12B conceptually illustrate the above alternative technique for computing relative COP using virtual HVAC&R systems. These figures are similar to their counterparts in FIGS. 5A and 5B for the physical HVAC systems except the compressor power parameter P(k) and the evaporator temperature drop E(k) are used to compute predictions in addition to the evaporator intake fluid temperature and the condenser intake fluid temperature tuple ($T_{ei}(k)$, $T_{ci}(k)$) discussed earlier. For example, the triple ($T_{ei}(k)$, $T_{ci}(k)$, E(k)) can be supplied to a joint CIPP and ETD relation block 500' (FIG. 12A) to predict the compressor power parameter, and the triple ($T_{ei}(k)$, $T_{ci}(k)$, P(k)) can be supplied to a joint CIPP and ETD relation block 506' (FIG. 12B) to predict the evaporator temperature drop. Each of these joint CIPP and ETD relation blocks 500' and 506' operate in an identical manner in form and function to their counterparts 500 and 506 (FIGS. 5A and 5B) to learn the relations between observed temperature tuples ($T_{ei}(n)$, $T_{ci}(n)$) and the corresponding power parameter and evaporator temperature drop using the individual relation builders 652, and the temperature maps for the CIPP relation and ETD relation 654 are also identical in form and function. The learned CIPP and ETD relations may then be employed jointly along with the observed temperature drop, E(n), to generate a new power parameter prediction $\hat{P}^*(k)$ and corresponding normalized residual therefor, and applied jointly along with the observed power parameter value, P(n), to generate a new evaporator temperature drop prediction $\hat{E}^*(k)$ and corresponding normalized residual therefor, in a similar manner to that described above with respect to FIGS. 5A and 5B. The differences between the learned CIPP relation 500 and learned CIPP relation 506 and their counterparts joint CIPP relation 500' and joint ETD relation 506' are that: (a) the joint CIPP relation 500' and joint ETD relation 506' each employ both the CIPP temperature map and ETD temperature map 654, (b) the manner in which a neighborhood is extracted for the observed temperature tuple, $(T_{ei}(n), T_{ci}(n))$, and (c) the form of the parametric predictors used to compute the predicted values.

Figure 13:
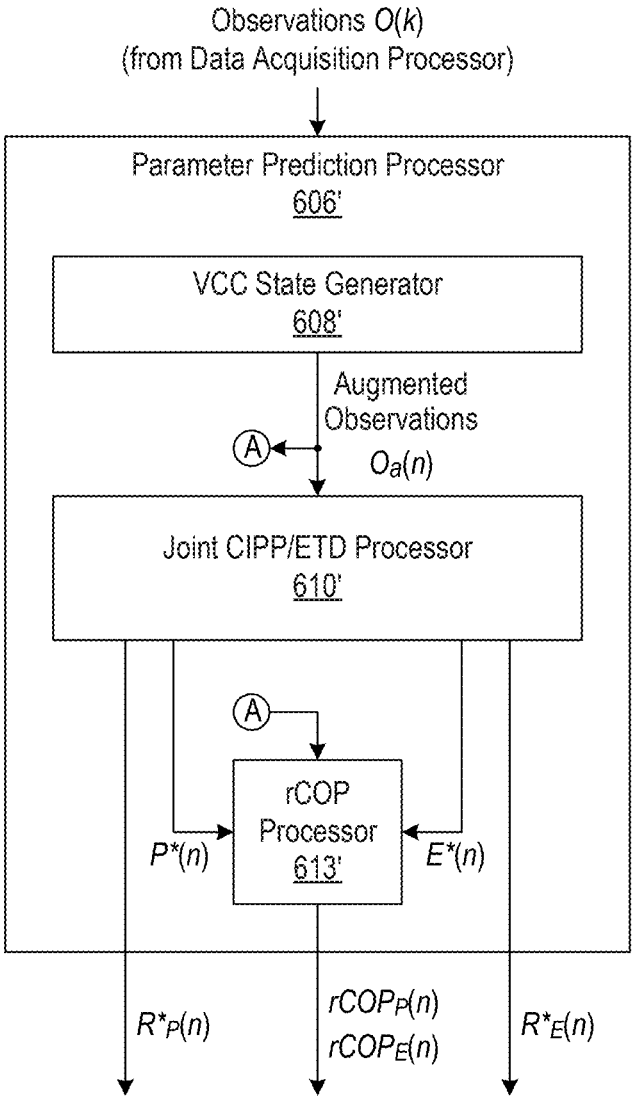
FIG. 13 illustrates an alternative exemplary implementation of a monitoring agent according to aspects of the disclosed embodiments.

FIG. 13 illustrates an exemplary implementation of a prediction processor 606' adapted to the alternative technique for use by or in the HVAC&R monitoring agent 314 to monitor a virtual HVAC&R system. In general, the prediction processor 606' accepts observations O(k) from the data acquisition processor 600 and can selectively use the observations to learn the individual CIPP and ETD relations in a manner identical to above. The prediction processor 606' can then generate normalized power parameter residual sequence and normalized ETD residual sequence, presenting these sequences to degradation detection processor 614 for analysis. As can be seen, the prediction processor 606' bears similarity to its counterpart, the prediction processor 606 in FIG. 6A, insofar as there is a VCC state generator 608', identical in form and function to 608 that can receive and accept a sequence of observations O(k) from the data acquisition processor 600 and augment that sequence with system state information, resulting in an augmented observation sequence $O_a(k)$.

But in the example shown, the prediction processor 606' includes a joint CIPP/ETD processor 610' instead of a separate CIPP processor and a separate ETD processor. The joint CIPP/ETD processor 610' may then be used to learn the individual CIPP and ETD relations referenced above and use the resulting temperature maps jointly to generate a new power parameter prediction $\hat{P}^*(k)$ and corresponding normalized residual, and a new evaporator temperature drop prediction $\hat{E}^*(k)$ and corresponding normalized residual. The normalized residuals are then provided to the degradation detector processor 614 of the HVAC&R monitoring agent 314 to be used for detecting degradation in the manner described above. Meanwhile, the new power parameter prediction $\hat{P}^*(k)$ and/or the new evaporator temperature drop prediction $\hat{E}^*(k)$ may be provided to an rCOP processor 613' along with the measured values of E(n) and P(n) for use in generating a power parameter-derived relative COP, designated $rCOP_P(n)$, and/or an ETD-derived relative COP, designated $rCOP_E(n)$, as will be described subsequently.

Figure 14:
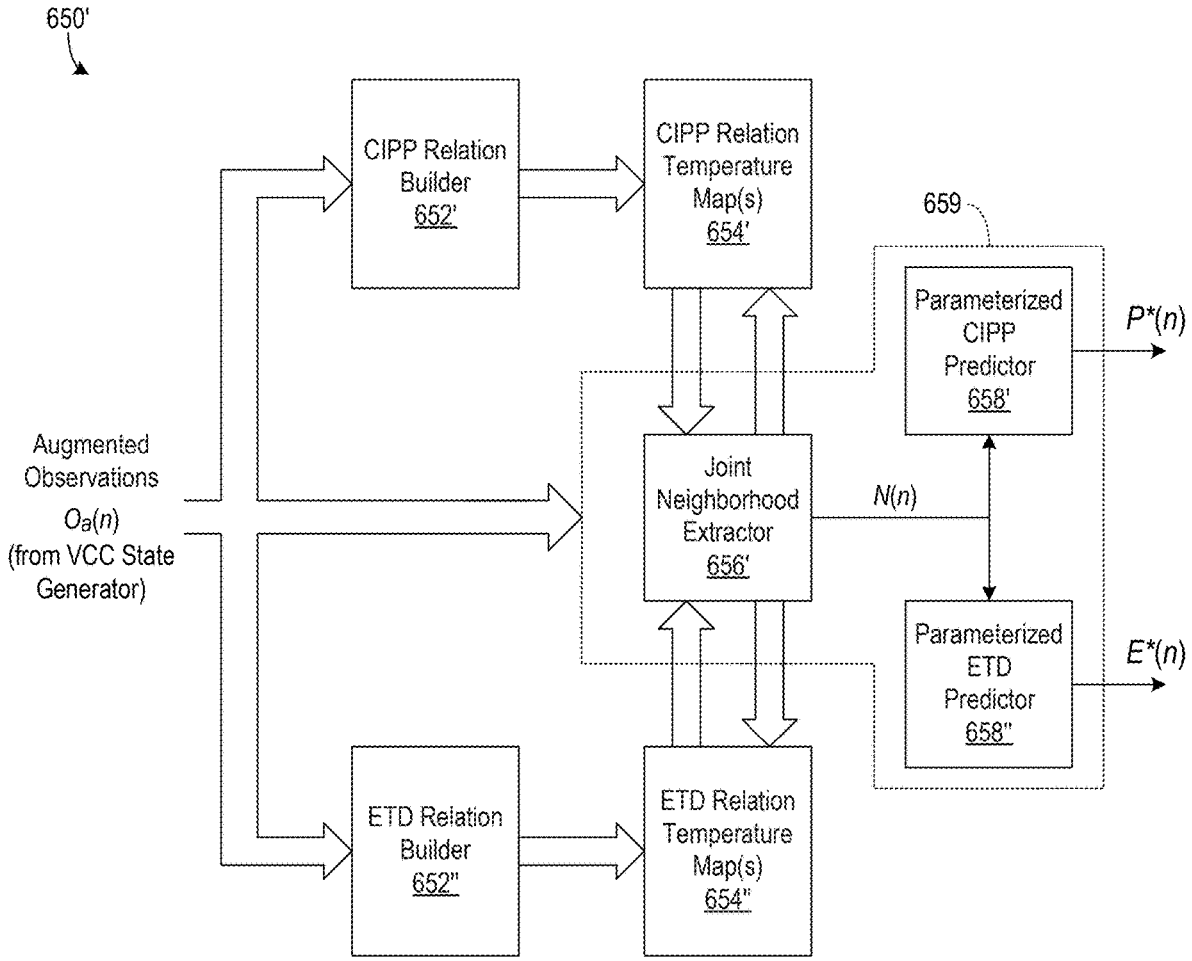
FIG. 14 illustrates an alternative exemplary joint relation learner according to aspects of the disclosed embodiments.

FIG. 14 illustrates an exemplary implementation of a joint relation learner 650' that may be used in or by the joint CIPP/ETD processor 610' to learn the CIPP and ETD relations and predict $\hat{P}^*(k)$ and $\hat{E}^*(k)$ from both. The joint relation learner 650' operates in a similar manner to its counterpart, the (single) relation learner 650 from FIG. 6E and the CIPP relation builder 652', CIPP temperature map 654', ETD relation builder 652" and ETD temperature map 654" are identical in form and function to their "single relation learner" counterparts, and thus may also be used by either the CIPP processor 610 or the ETD processor 612 of the prediction processor 606 (FIG. 6A). However, whereas the (single) relation learner 650 has a neighborhood extractor 656 that operates on a single temperature map, the joint relation learner 650' includes a joint neighborhood extractor 656' that operates on both temperature maps simultaneously to extract a set of tuples N'(n) from a neighborhood in which the cells in both the CIPP and ETD temperature maps within a defined neighborhood of the observed tuple $(T_{ei}(n), T_{ci}(n))$ in which corresponding cells in both the CIPP and ETD temperature maps are "observed" per above—these tuples and their corresponding cells are defined herein as "jointly observed." The joint neighborhood extractor 656' performs the same tests as the single neighborhood extractor, but on a set of jointly observed tuples, requiring a certain minimum number of jointly observed tuples within the defined neighborhood, the minimum number required consistent with the requirements of parameterized CIPP predictor 658' and parameterized ETD predictor 658" subsequently, and that the temperature tuple $(T_{ei}(n), T_{ci}(n))$ of the observation lie within the convex hull of a subset of the set N'(n), the subset excluding the temperature tuple $(T_{ei}(n), T_{ci}(n))$ if it is a member. As above, if either test fails, the joint neighborhood extractor provides a NULL value for N'(n).

Again in a manner similar to the relation learner 650, the resulting set N'(n) provides input to a parameterized CIPP predictor 658' and operates to make power parameter predictions, $\hat{P}^*(n)$, and a separate parameterized ETD predictor 658" which extract summary data from the cells corresponding to the tuples in N'(n) to create a parameterized models to make evaporator temperature drop predictions $\hat{E}^*(n)$. The parameterized predictors 658' and 658" differ in form from their counterparts 658 above. Whereas in the single relation learners 650, the parametric models 658 yielding $\hat{E}(n)$ and $\hat{P}(n)$ are functions only of the measured temperature tuple $(T_{ei}(n), T_{ci}(n))$, the parametric model of parameterized CIPP predictor 658' is constructed to compute a different estimate of the power parameter, $\hat{P}^*(n)$ as a function of the measured triple $(T_{ei}(n), T_{ci}(n), E(n))$, as if the measured value of E(n) represents operation of the system in newly maintained condition, and is independent of $(T_{ei}(n), T_{ci}(n))$. Similarly, the parametric model of Parameterized ETD Predictor 658" is constructed to compute a different estimate of the evaporator temperature drop, $\hat{E}^*(n)$ as a function of the measured triple $(T_{ei}(n), T_{ci}(n), P(n))$ as if the measured value of P(n) represents operation of the system in newly maintained condition and is independent of $(T_{ei}(n), T_{ci}(n))$.

The dashed line 659 is placed around the joint neighborhood extractor 656', parameterized CIPP predictor 658', and parameterized ETD predictor 658" is placed around these elements to indicate that they each have access to the observation $O_a(n)$ in performing their functions.

Figure 15A:
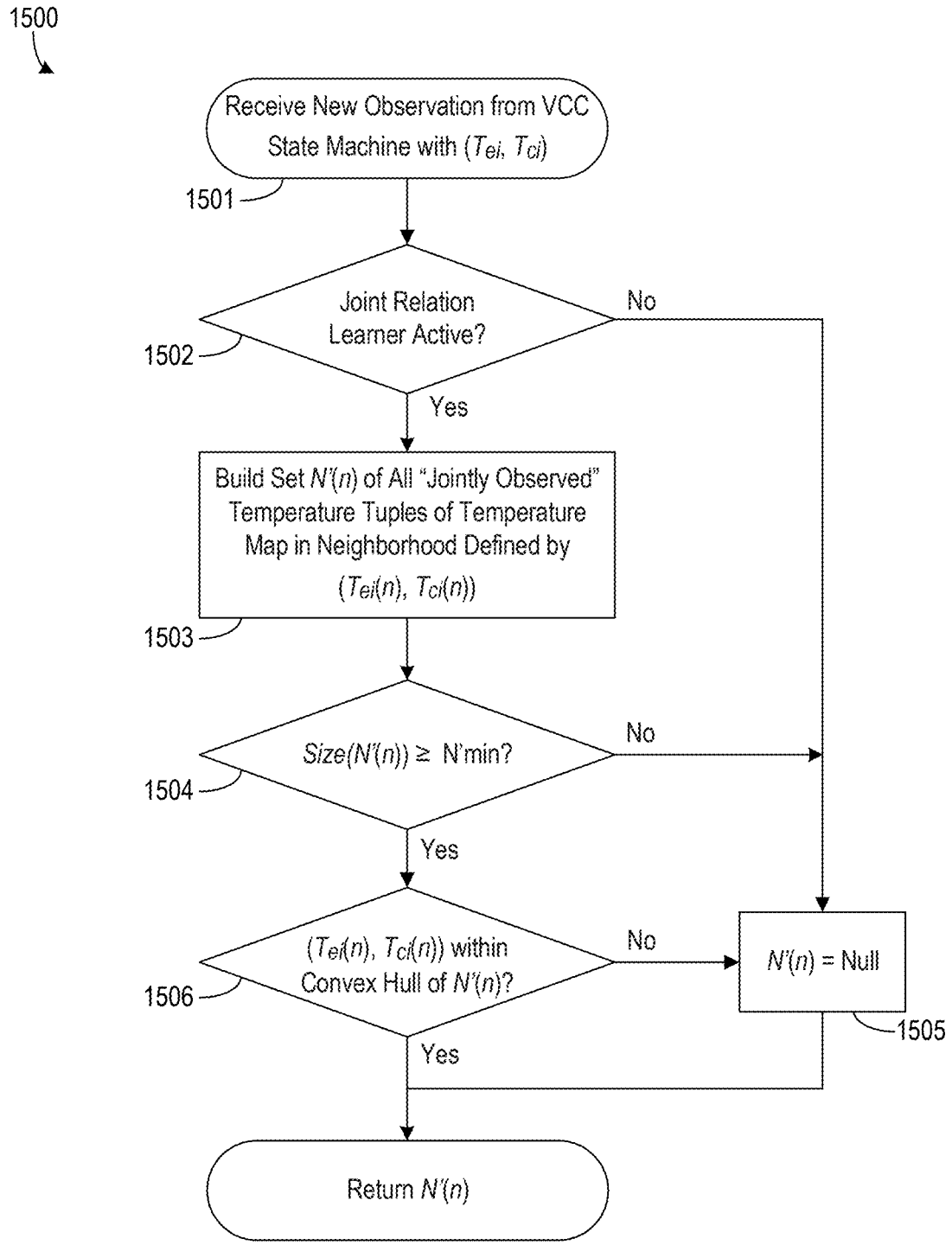
FIG. 15A illustrates a flowchart for an exemplary joint neighborhood extractor logic that may be used with the alternate exemplary joint relation learner according to aspects of the disclosed embodiments.

FIG. 15A shows a flowchart 1500 illustrating an exemplary process that may be used by or with the joint neighborhood extractor 656' to determine whether to make a prediction and to furnish a set of temperature tuples N'(n) pointing to jointly observed cells in the CIPP temperature map 654' and ETD temperature map 654" sufficient to build a local parametric model to predict the parameter of discourse via parametrized CIPP predictor 658' or parameterized ETD predictor 658", or both, when appropriate. Referring first to FIG. 15A, the flowchart 1500 generally begins at 1501 where the joint neighborhood extractor 656' receives or is presented with an augmented observation (i.e., the nth observation of the sequence) furnished by the VCC state generator 608' as $O_a(n)$ with observed temperature tuple $(T_{ei}(n), T_{ci}(n))$. The joint neighborhood extractor 656' operates on individual augmented observations received from the VCC state generator 608', one at a time as they are generated, or serially in a data frame.

In some implementations, the joint neighborhood extractor 656' can simply ignore any observation from the VCC state generator 608' that does not meet the criteria for a steady state observation with respect to both the power parameter and evaporator temperature drop for a given compressor in an ON state, a condition previously described as an "active" relation learner 650'. Accordingly, at 1502 the neighborhood extractor 656' determines if the joint relation learner 650' is active, defined by the conditions that: a) the compressor to which this joint relation learner applies is ON (indicated by Sc(n)=TRUE in a single compressor system, or Sc(n)>0 in a multiple compressor system), b) the observation from the VCC state generator 608 was made while the HVAC&R system was in steady state with respect to the power parameter prediction, indicated by Sp(n)=TRUE, and (c) the observation was made while the HVAC&R system was in the steady state with respect to the evaporator temperature drop, i.e., Se(n)=TRUE. If the joint relation learner 650' is not active in 1502, the neighborhood extractor 656' immediately assigns a NULL value to a set N'(n) in process step 1505 for that observation, and the process is complete for that observation, the value NULL indicating that no predictions should be made for this observation.

Assuming the joint relation learner 650' is determined active in step 1502, then in step 1503 the joint neighborhood extractor 656' searches a "neighborhood" within +/−γ degrees of the observed temperature tuple ($T_{ei}(n)$, $T_{ci}(n)$) in both $T_{ei}$ and $T_{ci}$. Thus, for instance, if the nth steady state observation of the system the temperature tuple ($T_{ei}(n)$, $T_{ci}(n)$) is observed, the joint neighborhood extractor 656' searches all temperature map cells (points) in both CIPP relation temperature map 654' and ETD relation temperature map 654" that satisfy both Equations (43) and (44):

$$T_{ei} - \gamma \le T_{ei}(n) \le T_{ei} + \gamma \tag{43}$$

$$T_{ci} - \gamma \le T_{ci}(n) \le T_{ci}(n) + \gamma \tag{44}$$

The neighborhood in which this search occurs specified herein by the parameter γ is often chosen larger than that used to determine the predicted power parameter and evaporator temperature drop predictions of the rCOP implementation above, specified by the parameter δ with a typical value of γ on the order of 1-2 degree C.

For the above search in step 1503, the joint neighborhood extractor 656' only considers those cells within the neighborhood established above for which both the CIPP relation temperature map 654' and ETD relation temperature map 654" cells are designated as "observed", that is, cells for which the "OBSERVED" metadata variable has been set to TRUE in some embodiments, as discussed above or otherwise tested for the condition. Such cells are referred to as "jointly observed" cells. Each time the joint neighborhood extractor 656' finds a jointly observed cell within the neighborhood above, it appends the corresponding temperature tuple ($T_{ei}(n)$, $T_{ci}(n)$) to an initially empty or NULL set N' (n). The set N' (n) is the result of process step 1503 and is made available for subsequent processing.

Based on the contents of the set N'(n), the joint neighborhood extractor 656' then allows (or recommends) a prediction to be made if and only if two criteria are satisfied. First, a certain absolute minimum number of observed cells is mathematically required to determine the parametric coefficients of the CIPP parameterized predictor 658' and ETD parameterized predictor 658", but a greater number of observed cells may be used and is preferable. Accordingly, a minimum number of cells, N'min, is determined by a predefined constant that is system dependent must be larger than the absolute minimum number of tuples required of the parameterized predictors 658' and 658", with a greater number preferable. In some embodiments, an absolute minimum number of 4 observed cells are required by parameterized predictors 658' and 658" and N'min may be set at 8 cells in those embodiments.

To ensure the first requirement is met, when the search is complete in process step 1503, the set N'(n) contains a number of tuples denoted as Size(N'(n)). In decision step 1504, a test is made to determine if the number of tuples in the set N'(n) is greater than or equal to the minimum number defined by the predefined constant N'min per above. If this criterion is not met, then the set of temperature tuples N'(n) is assigned the value NULL at 1505 and the work of joint neighborhood extractor 656' is complete for this observation.

If the joint neighborhood extractor 656' finds enough temperature tuples in N'(n) at 1504, then the joint neighborhood extractor 656' continues to 1506 to test for the second criterion needed for making a non-NULL prediction in the present invention, namely, whether the temperature tuple ($T_{ei}(n)$, $T_{ci}(n)$) of the observation lies within a convex hull formed by the set of temperature tuples represented by N'(n) collected as described above, with the specific point ($T_{ei}(n)$, $T_{ci}(n)$) excluded from the test if it is a member of N'(n). If it is determined in 1506 that the tuple of the observation does not lie within the convex hull of the tuples of cells determined at 1504 above, then the table of tuples N'(n) is assigned a NULL value at 1505, and the process is complete for this observation.

If the joint neighborhood extractor 656' determines at 1506 that the temperature tuple of an observation lies within the convex hull of a minimum number of temperature tuples determined per above, this can greatly improve the reliability of prediction compared with prior art solutions. If both criteria at 1504 and 1506 are satisfied, the joint neighborhood extractor 656 furnishes the table of tuples N'(n) as discovered above to CIPP parameterized predictor 658' or ETD parameterized predictor 658", or both, as discussed below with respect to the flowchart of FIG. 15B.

Figure 15B:
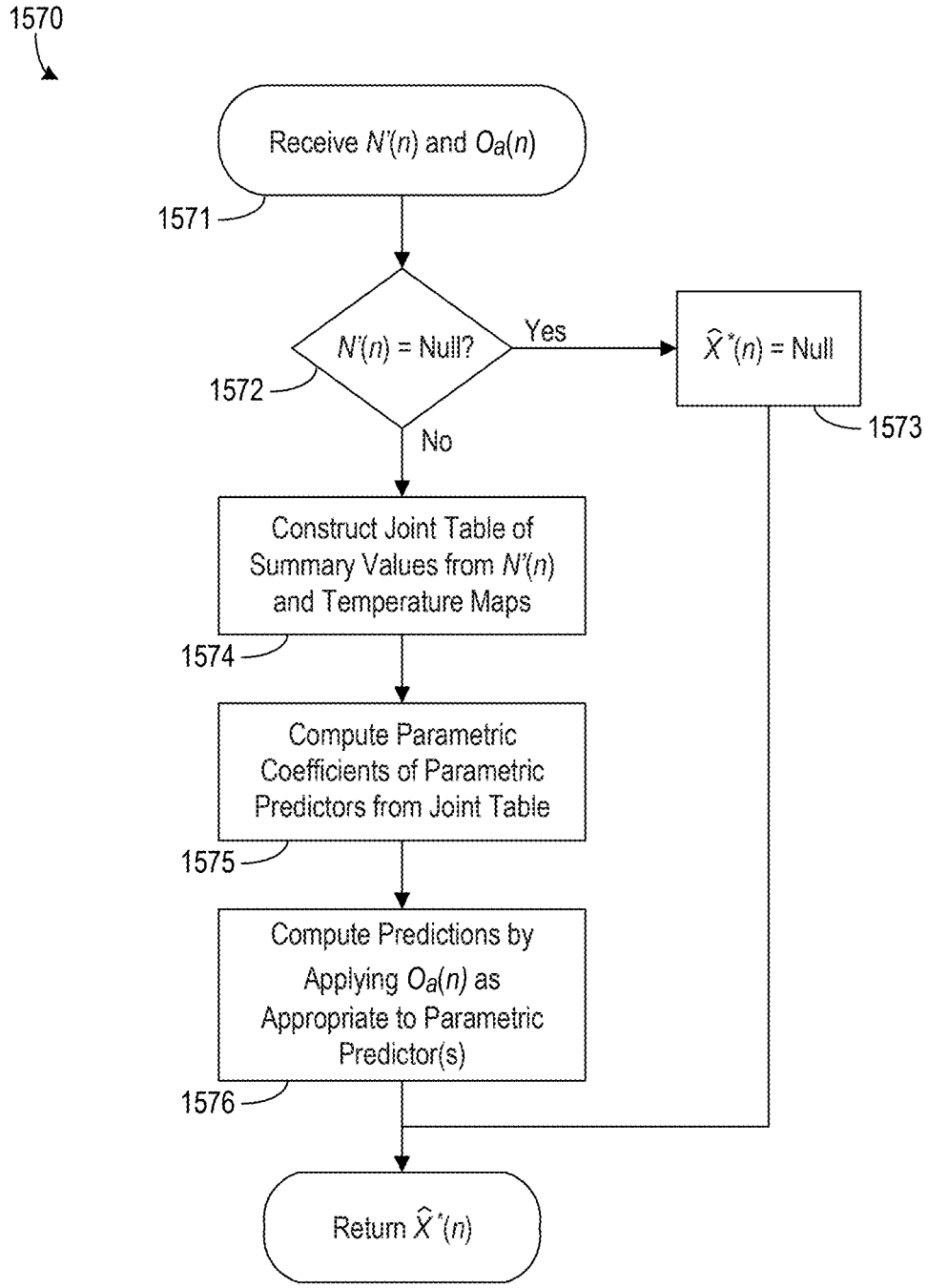
FIG. 15B illustrates a flowchart for an exemplary parametric prediction logic that may be used with the alternate exemplary joint relation learner according to aspects of the disclosed embodiments.

The flowchart of FIG. 15B describes the process by which the predictions of $\hat{P}^*(n)$ of the Parameterized CIPP Predictor 658' or $\hat{E}^*(n)$ of Parameterized ETD Predictor 658" (or both) are made. From FIG. 14, it is noted that the same set of temperature tuples N'(n) computed by the joint neighborhood extractor 656' is applied to both parameterized CIPP predictor 658' and parameterized ETD predictor 658", as is the observation $O_a(n)$. The flowchart 1570 begins at 1571, where the parameterized CIPP predictor 658' or parameterized ETD predictor 658" (or both) receive the set of temperature tuples N'(n) provided by joint neighborhood extractor 656' per above and the corresponding augmented observation $O_a(n)$ (or observation sequence). Step 1572 determines if N'(n) has been set to NULL by the joint neighborhood extractor 656'. If yes, then $\hat{P}^*(n)$ or $\hat{E}^*(n)$ (or both) are assigned the value NULL in step 1573 and no predictions are returned for the given observation.

If in step 1572 the set of temperature tuples N'(n) is determined to be non-Null, in process step 1574 a joint table of values is constructed from summary data in the cells of the CIPP relation temperature map 654' and ETD relation temperature map 654". The table of values comprising as rows the values of $T_{ei}$, $T_{ci}$, the mean value of the power parameter from the CIPP temperature map 654' and mean value of ETD from the ETD temperature map 654" for each tuple in N'(n), already determined to be tuples for which the corresponding cells in the respective temperature maps meet the criterion for an "observed" cell above. Both mean values are computed from the summary data in the cells using Equation (14). Assuming there are m' temperature tuples in the temperature map N'(n), the resulting table of values is described by Table 6:

TABLE 6

Table of Joint Extractions from CIPP and ETD Temperature Maps

| Index | $T_{ei}$ | $T_{ci}$ | E | P |
|---|---|---|---|---|
| 1 | $T_{ei1}$ | $T_{ci1}$ | $\overline{E_1}$ | $\overline{P_1}$ |
| 2 | $T_{ei2}$ | $T_{ci2}$ | $\overline{E_2}$ | $\overline{P_2}$ |
| . . . | . . . | . . . | . . . | . . . |
| m' | $T_{eim'}$ | $T_{cim'}$ | $\overline{E_{m'}}$ | $\overline{P_{m'}}$ |

With Table 6 properly populated, in step 1575 the parametric coefficients of parametric CIPP predictor 658' or parametric ETD predictor 658", or both, may be determined. In some embodiments, the form of this parametric model for the parameterized CIPP predictor 658' is a simple hyperplane of the form:

$$\hat{P}^*(n) = g_P(T_{ei}, T_{ci}, E) = P_0 + K_{pei}T_{ei} + K_{pci}T_{ci} + K_eE \quad (45)$$

where $P_0$, $K_{pei}$, $K_{pci}$ and $K_e$ are the parametric coefficients of the predictor function to be determined specifically for the present observation $O_a(n)$, with values computed from the values in Table 6 in some embodiments using an optimization program such as scipy.optimize.lsq_linear developed for the Python programming language, or many equivalent packages in other programming languages.

In some embodiments the form of the parametric model for the Parameterized ETD Predictor 658" is a simple hyperplane of the form:

$$\hat{E}^*(n) = g_E(T_{ei}, T_{ci}, P) = E_0 + K_{eei}T_{ei} + K_{eci}T_{ci} + K_pP \quad (46)$$

where $E_0$, $K_{eei}$, $K_{eci}$ and $K_p$ are the parametric coefficients of the predictor function to be determined specifically for the present observation $O_a(n)$, with coefficient values computed from the values in Table 6 in some embodiments using an optimization program such as scipy.optimize.lsq_linear developed for the Python programming language, or many equivalent packages in other programming languages.

When applied per above, these optimization programs choose the values of the parameters $P_0$, $K_{pei}$, $K_{pci}$ and $K_e$ in Equation (45) or $E_0$, $K_{eei}$, $K_{eci}$ and $K_p$ in Equation (46) that provide a "best fit" to the data in Table 5. Many optimization programs allow the values of select parameters to be constrained as needed to better represent the thermodynamics of the system. An example of this is when predicting the power parameter using Equation (45) above, the parameters $K_{pei}$ and $K_{pci}$ may be constrained to be non-negative to reflect that an increase in either temperature should cause an increase in compressor power.

It should be recognized that in systems for which both $\hat{P}^*(n)$ and $\hat{E}^*(n)$ are desired, the coefficients of both predictors may be computed from the same table constructed in step 1575 and represented symbolically by Table 6 above, and there is no need to construct individual tables.

Once the parametric coefficients of the parametric model for the parameterized CIPP predictor 658' or parameterized ETD predictor 658" (or both) are determined in step 1575, the corresponding prediction can be made by applying the appropriate measured values of the observation $O_a(n)$. To determine $\hat{P}^*(n)$ via the parameterized CIPP predictor 658', in step 1576, Equation (45) with parametric coefficients determined per above is evaluated at the values $T_{ei}(n)$ and $T_{ci}(n)$ of augmented observation $O_a(n)$. Similarly, to determine $\hat{E}^*(n)$ via parameterized ETD predictor 658", in step 1576, Equation (44) with parametric coefficients determined per above is evaluated at the values $T_{ei}(n)$, $T_{ci}(n)$, and P(n) of augmented observation $O_a(n)$.

Referring back to FIG. 13, once the prediction $\hat{P}^*(n)$ is made using the method described above, the prediction can be applied along with the observed value of P(n) as described in FIG. 12A to compute an alternative normalized residual $R_P^*(n)$ by replacing the quantity $\hat{P}(n)$ with $\hat{P}^*(n)$ in Equations (2) and (3) above, and the alternative relative COP "score" $rCOP_P(n)$ for the observation using Equation (42).

Similarly, once the prediction $\hat{E}^*(n)$ is made using the method above, the prediction can be applied along with the observed value of E(n) as described in FIG. 12B to compute an alternative normalized residual $R_E^*(n)$ by replacing the quantity $\hat{E}(n)$ with $\hat{E}^*(n)$ in Equations (7) and (8) above, and the alternative relative COP "score" $rCOP_E(n)$ for the observation using Equation (40).

The power parameter prediction sequence, $\hat{P}^*(n)$, is not, in general, identical to the prediction $\hat{P}(n)$ produced by the CIPP processor 610 described previously. Nonetheless, the sequence of normalized power parameter residuals based on $P^*(n)$, $R_P^*(n)$, may be monitored by the degradation detection processor 614 in a manner identical to that of $R_P(n)$, using a limit detector 690 as described previously and may be monitored in place of or in addition to $R_P(n)$, with the resulting filtered sequence included in the message Msg(n) of FIG. 6H.

Similarly, the evaporator temperature drop sequence, $\hat{E}^*(n)$, is not, in general, identical to the prediction $\hat{E}(n)$ produced by the ETD processor 612 described previously. Nonetheless, the sequence of normalized evaporator temperature drop residuals based on $\hat{E}^*(n)$, $R_E^*(n)$ may be monitored by the degradation detection processor 614 in a manner identical to that of $R_E(n)$, using a limit detector 690 as described previously and may be monitored in place of or in addition to $R_E(n)$, with the resulting filtered sequence included in the message Msg(n) of FIG. 6H.

Also, the sequences $rCOP_P(n)$ and $rCOP_E(n)$ have been used in a manner identical to that of rCOP(n) described above to estimate the cost of observed degradation in the system. In some practical applications of the present disclosure, the sequence $rCOP_P(n)$ has been used to indicate the power wasted and cost of degradation when the normalized power parameter residual $R_P(n)$ is greater than zero, indicating the system is using more power than that of a newly maintained system, whereas $rCOP_E(n)$ has been used when the normalized power parameter residual $R_P(n)$ is less than or equal to zero. Furthermore, the relative COP sequence $rCOP_P(n)$ or $rCOP_E(n)$ or both may be monitored by the degradation detection processor 614 in a manner identical to rCOP(n) using a limit detector for each sequence monitored with appropriate limits to generate alerts and with the resulting filtered sequence included in the message Msg(n) of FIG. 6H.

Figure 16:
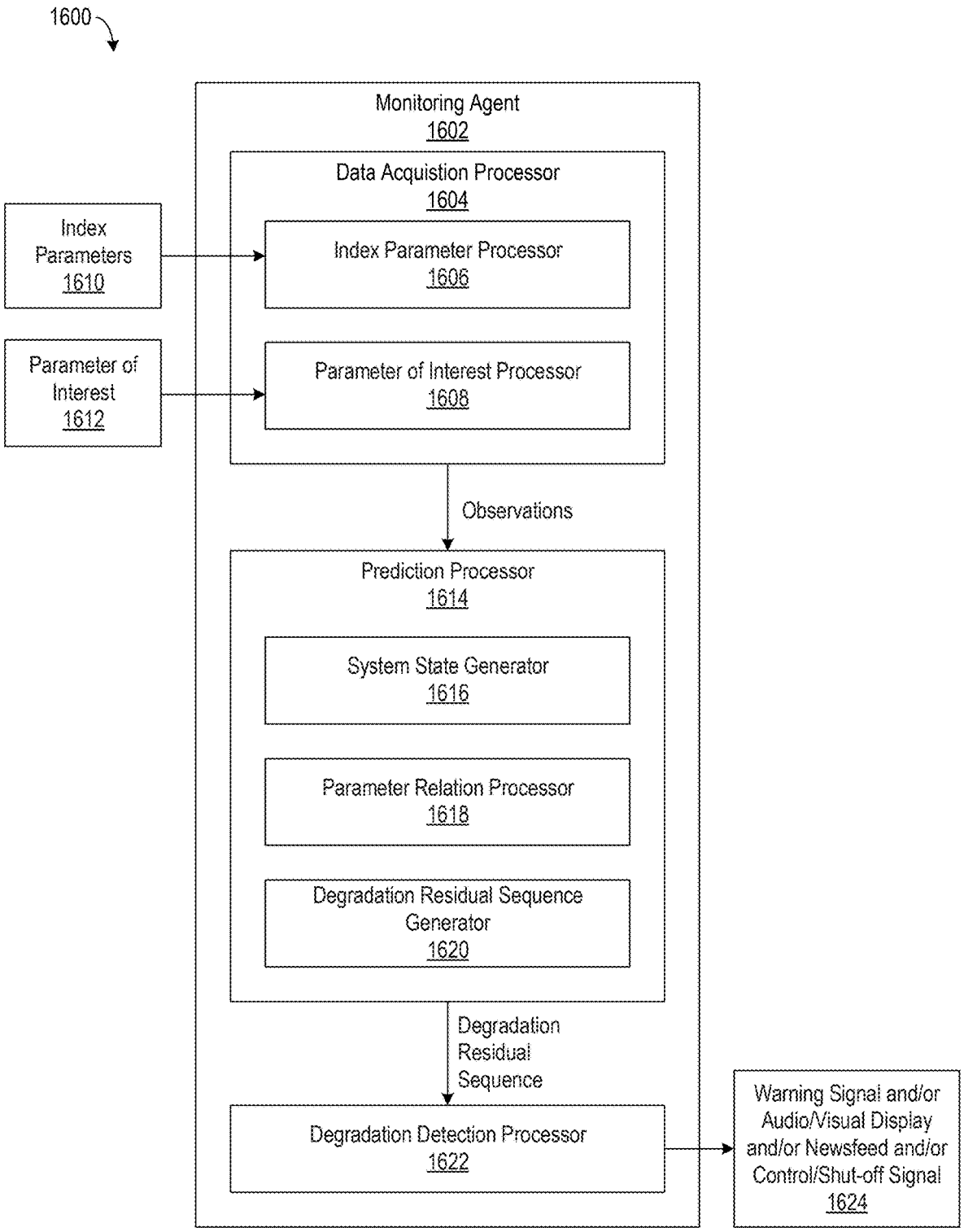
FIG. 16 illustrates an exemplary implementation of a system parameter monitoring agent according to aspects of the disclosed embodiments.

Referring next to FIG. 16, a more general system parameter monitoring agent 1602 is shown that may be used with other types of systems, indicated at 1600, in addition to the HVAC&R systems described herein. As mentioned at the outset, the principles and teachings discussed herein are applicable to any deterministic system or equipment in which a certain parametric outcome or value will consistently result for a given parameter of interest, and thus can be quickly learned and predicted as described herein, given an index parameter or set of index parameters (and the values thereof). Examples of parameters that may be used as the parameter of interest and the index parameters include flow control parameters (e.g., flow rate, viscosity, etc.), power control parameters (e.g., voltage, current, etc.), motion control parameters (e.g., speed, height, etc.) and the like, as well as combinations thereof.

From FIG. 16, the agent 1602 has similar functional components to the agents discussed earlier, including a data acquisition processor 1604, a prediction processor 1614, and a degradation detection processor 1622 (and their respective sub-components). The data acquisition processor 1604 operates to continuously acquire and store observations for the parameters that will be used as the index parameters, indicated at 1610, and the parameter of interest, indicated at 1612. These observations 1610, 1612 may be acquired in real time using appropriate sensors that measure such parameters, or they may be obtained from a database of such observations, or combination of both. Based on these observations 1610, 1612, the data acquisition processor 1604 assembles time sequences of observations that can be used by the prediction processor 1614. The prediction processor 1614 operates to derive certain operational information from the time sequence of observations and selectively uses the observations to learn a relation between the index parameters 1610 and the parameter of interest 1612. Thereafter, the prediction processor 1614 uses the learned relation along with the observations to generate a time sequence of normalized residuals that contain information regarding the physical condition of the system 1600. This sequence of normalized residuals is passed to the degradation detection processor 1622, which interprets the time sequence of normalized residuals, and can issue warning signals or audio-visual displays or sends information via newsfeeds 616 indicating potential problems with the system 1600.

Table 7 below shows an exemplary observation that may be provided by the data acquisition processor 1604 to the prediction processor 1614. In the table, the exemplary observation contains several parameters that may be used as indices 1610, including index parameter 1, index parameter 2, and so forth, up to index parameter i, for the parameter of interest 1612. Consider an example in the HVAC&R context where the compressor input power is a function of the condenser intake temperature, the evaporator intake temperature, and the evaporator discharge temperature. Such an HVAC&R system would have a temperature map with three index parameters, i.e., the three temperatures mentioned, instead of the two index parameters discussed above. These index parameters and parameters of interest, or rather the values therefor, may be obtained from appropriate sensors that are strategically positioned to measure such values. Alternatively, a proxy may be used for one or more of these parameters rather than directly measuring these parameters. An optional time stamp or tag indicating the date and time instant or interval represented by the measured parameters may be included in the observation in some implementations.

TABLE 7

| Exemplary Observation | | | | | |
|---|---|---|---|---|---|
| Time Stamp (optional) | Index Param 1 | Index Param 2 | . . . | Index Param i | Parameter of Interest |
| Date/Time represented by observation | Sensor Reading(s) | Sensor Reading(s) | . . . | Sensor Reading(s) | Sensor Reading(s) |

The time sequence of observations are forwarded from the data acquisition processor 1604 to the prediction processor 1614 either one at a time or in a batch data frame as described above. In accordance with the disclosed embodiments, the prediction processor 1614 is operable to derive or learn a relation between the index parameters and the parameter of interest and use the relation to monitor the system 1600 for performance degradation from the observations provided by data acquisition processor 1604. In some embodiments, the prediction processor 1614 includes a system state generator 1616 that operates to derive certain timing information from the sequence of observations provided by the data acquisition processor 1604 and augment the observations with this information, resulting in a sequence of steady state observations. A parameter relation processor 1618 is provided to learn the relation from the augmented time sequence of steady state observations provided by the system state generator 1616.

Also included is a degradation residual sequence generator 1620, which uses the learned relation and the time sequence of steady state observations to compute a time sequence of normalized residuals, labeled degradation residual sequence, that is indicative of the condition of the system 1600. It will be appreciated that the version of the degradation residual sequence generator 1620 herein is but one embodiment. In general, the degradation residual sequence generator 1620, or the underlying principles and teachings thereof, can be used with any system 1600 where there is a fixed, known, or learnable "form" of relation between a residual and a set of index parameters.

The degradation residual sequence produced by the degradation residual sequence generator 1620 can then be provided to the degradation detection processor 1622. The degradation detection processor 1622 thereafter operates to analyze the degradation residual sequence produced by the degradation residual sequence generator 1620 to detect and report degradation.

As discussed, predictions of the parameter of interest using the embodiments described herein are most accurate after the system has been operational a long enough time that the system has stabilized with respect to the parameter of interest, which time can vary depending on the equipment. To this end, the system state generator 1616 can detect, using appropriate logic or circuitry, whether the system has stabilized with respect to the parameter of interest and is in a steady state and thus likely stable, or in a transient state and likely unstable. The system state generator can then declare whether the system is stable or not stable for purposes of the relation. In some embodiments, the system state generator 1616 can augment an observation obtained from data acquisition processor 1604 with system state information in the form of Boolean variables. The Boolean variables may take the values in the set {TRUE, FALSE} to represent the system state. The VCC state generator 608 can set the Boolean variables to TRUE to indicate that the system is stable and in an On state, respectively per above, and FALSE to indicate otherwise. In some implementations, the agent 1602 may associate system state information such as that referenced above with each observation, resulting in an augmented observation.

The parameter relation processor 1618 is responsible for learning the relation between the values of the index parameters 1610 and the parameter of interest 1612 from the steady state observations described above. This parameter relation processor 1618 includes three main functions that provide capabilities desirable for building a relation that represents the system 1600 in newly maintained condition. In some embodiments, the parameter relation processor 1618 compiles and maintains a parameter map similar to the temperature map discussed above that relates the index parameters 1610 to the parameter of interest 1612. In some embodiments, a bootstrap learning strategy may be used similar to that discussed herein, combined with a reference degradation estimator function to modify in some cases the parameter of interest values of steady state observations prior to using the modified observations to populate the parameter map.

In some implementations, the agent 1602 builds the parameter map using the steady state observations provided by the system state generator 1616, each steady state observation including at least an index parameter or a set of index parameters and a corresponding parameter of interest. Each index parameter or set of index parameters forms an index into the parameter map for the parameter of interest, and the agent 1602 "learns" by updating summary data for the cell from parameter of interest values of steady state observations corresponding to the index parameter values. The agent 1602 updates the summary data for a given cell in this manner until a sufficient number of observations have been applied, as described above. At that point, the agent stops updating the summary data for that cell and the summary data of the cell can be used to make predictions of the parameter of interest value representing the system in newly maintained condition. Parameter value predictions in some cases may derive directly from the summary data of an individual cell indexed by a set of a steady state observations for the index parameters once the requisite number of observations have been made for that cell. In other cases, the agent may derive a power parameter prediction for a set of a steady state observations for the index parameters by performing local regression using summary data from nearby value, as described herein.

With the above approach, the agent can gather data quickly and begin making parameter value predictions almost immediately, provided the system is running and is in newly maintained state. Using the parameter map described herein, the agent can assess whether a prediction of the parameter values corresponding to a given index parameter or set of index parameters is likely to represent the characteristics of a system in newly maintained condition and decide whether or not to issue the prediction. The ability to assess the reliability of a prediction beneficially reduces the possibility of the agent issuing false positives and false negatives. Additionally, because the relation can be assumed to be quasi-independent on the index parameters in some systems, the agent can continue to learn the characteristics of the system in newly maintained condition while the system is degrading, thereby compensating for the degradation so the predictions better represent the system in newly maintained condition.

Further, continued learning of the relation by the agent can be achieved by updating the parameter map as additional observations of the index parameters and corresponding parameter of interest data becomes available. And as discussed, in some embodiments, the parameter map may be updated in batches, whereby a group of observations are assembled into one or more data frames of steady state observations and presented to the prediction processor 1614 of the agent by the data acquisition processor 1604 as a batch of observations. It is of course also possible in some embodiments to provide the observations on an individual observation basis, one at a time as they are received.

A partial example of an exemplary parameter map is shown in Table 8 below, where the cells of the map contain summary values for the parameter of interest observed for each temperature parameter index. Although the table is shown as being mostly filled, in general, only those cells for which the values of $T_{ei}$ and $T_{ci}$ have been observed will contain summary values.

TABLE 8

Exemplary Parameter Map

| | | Index Param 1 | | | | |
|---|---|---|---|---|---|---|
| Index Param 2 | | IV0 | IV1 | IV2 | . . . | X |
| | IV0 | C00 | C10 | C20 | . . . | CX0 |
| | IV1 | C01 | C11 | C21 | . . . | CX1 |
| | IV2 | C02 | C12 | C22 | . . . | CX2 |
| | . . . | . . . | . . . | . . . | . . . | . . . |
| | Y | C0Y | C1Y | C2Y | . . . | CXY |

As discussed earlier, each cell (e.g., C00, C01, CO2, etc.) in the parameter map contains summary values for the observations corresponding to the index values (e.g., IV0, IV1, IV2, etc.) that serves as an index into the cell. These summary values or summary statistics (or sample statistics) provide summary information about the steady state observations represented by the cell. As examples, the summary values may provide information about the data in the data set, such as the sum total, the mean, the median, the average, the variance, the deviation, the distribution, and so forth. The agent may then use these summary values to generate predictions of the parameter of interest as discussed above.

The predictions are then provided to the degradation residual sequence generator 1620 of the agent to create a degradation residual sequence for each steady state observation. This sequence of degradation residual serves as an input to the degradation detection processor 1622 that is configured to analyze the degradation detection sequence in the manner similar to that discussed above. The degradation detection processor 1622 monitors the sequence of degradation residuals and issues a warning signal and/or an audio/visual display or newsfeed, generally indicated at 1624, in response to detection of potential problems via the degradation residual sequence.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the scope of the invention as defined in the appended claims.

What is claimed is:

1. A monitoring system for an HVAC&R system, the monitoring system comprising:

a data acquisition processor operable to acquire observations about the HVAC&R system, the observations including fluid temperature measurements for a condenser and fluid temperature measurements for an evaporator, the observations further including compressor input power parameter measurements corresponding to the fluid temperature measurements;

a compressor input power parameter (CIPP) processor operable to learn a CIPP relation between fluid temperature measurements for an evaporator intake temperature and a condenser intake temperature and the compressor input power parameter measurements, the CIPP processor configured to compute a predicted value for a compressor input power parameter using the CIPP relation;

an evaporator temperature drop (ETD) processor operable to learn an ETD relation between the fluid temperature measurements for the evaporator intake temperature, the condenser intake temperature, and an evaporator temperature drop, the ETD processor configured to compute a predicted value for an evaporator temperature drop using the ETD relation;

a relative coefficient of performance (COP) processor operable to compute a relative coefficient of performance for the HVAC&R system based on the predicted value for the compressor input power parameter and the predicted value for the evaporator temperature drop; and a degradation detection processor operable to receive the relative coefficient of performance from the relative COP processor and shut off power to the HVAC&R system in response to the relative coefficient of performance exceeding one or more predefined thresholds;

wherein one or more of the data acquisition processor, the CIPP processor, the ETD processor, the relative COP processor, or the degradation detection processor is a hardware-based processor.

2. The system of claim 1, wherein the degradation detection processor is further operable to compute a cost factor attributable to the performance degradation using the relative coefficient of performance.

3. The system of claim 1, wherein the degradation detection processor is further operable to determine that air flow occlusion is present in the HVAC&R system and issue a signal indicative of the air flow occlusion in response to the relative coefficient of performance exceeding the one or more predefined thresholds.

4. The system of claim 3, wherein the degradation detection processor is further operable to issue a signal to a user device indicative of a dirty air filter when air flow occlusion is present in the HVAC&R system.

5. The system of claim 1, wherein the relative COP processor computes the relative coefficient of performance at least by:

computing a first ratio comprising the predicted value for the compressor input power parameter over a measured value of the compressor input power parameter;

computing a second ratio comprising a measurement derived value for the evaporator temperature drop over the predicted value for the evaporator temperature drop; and multiplying the first ratio by the second ratio to determine the relative coefficient of performance.

6. The system of claim 1, wherein the observations acquired by the data acquisition processor are stored, at the CIPP processor, via one or more temperature maps, each temperature map containing a plurality of cells, each cell corresponding to a condenser intake temperature and an evaporator intake temperature, each cell including summary statistics for measured values for the compressor input power parameter.

7. The system of claim 1, wherein the observations acquired by the data acquisition processor are stored, at the ETD processor, via one or more temperature maps, each temperature map containing a plurality of cells, each cell corresponding to a condenser intake temperature and an evaporator intake temperature, each cell including summary statistics for measurement derived values of the evaporator temperature drop.

8. The system of claim 1, wherein the data acquisition processor, the CIPP processor, the ETD processor, the relative COP processor, and the degradation detection processor reside within an agent of the monitoring system, the agent executed on one or more of the following: a cloud-based network, a fog-based network, and locally to the HVAC&R system.

9. The system of claim 1, further comprising a vapor-compression cycle (VCC) state generator operable to augment the observations acquired by the data acquisition processor with system state information indicating (i) an ON/OFF state of the HVAC&R system, (ii) a suitability of the observations for learning and predicting compressor input power parameters, and (iii) a suitability of the observations for learning and predicting evaporator temperature drop.

10. The system of claim 1, wherein the CIPP processor and the ETD processor learn the CIPP relation and the ETD relation, respectively, using a machine learning based learning process.

11. A method of monitoring an HVAC&R system, the method comprising:

acquiring, at a data acquisition processor, observations about the HVAC&R system, the observations including fluid temperature measurements for a condenser and fluid temperature measurements for an evaporator, the observations further including compressor input power parameter measurements corresponding to the fluid temperature measurements;

learning, at a compressor input power parameter (CIPP) processor, a CIPP relation between fluid temperature measurements for an evaporator intake temperature and a condenser intake temperature and the compressor input power parameter measurements;

computing, at the CIPP processor, a predicted value for a compressor input power parameter using the CIPP relation;

learning, at an evaporator discharge temperature (EDT) processor, an EDT relation between the fluid temperature measurements for the evaporator intake temperature, the condenser intake temperature, and an evaporator temperature drop;

computing, at the EDT processor, a predicted value for an evaporator temperature drop using the EDT relation;

computing, at a relative coefficient of performance (COP) processor, a relative coefficient of performance for the HVAC&R system based on the predicted value for the compressor input power parameter and the predicted value for the evaporator temperature drop;

receiving, at a degradation detection processor, the relative coefficient of performance from the relative COP processor; and shutting off power to the HVAC&R system in response to the relative coefficient of performance exceeding one or more predefined thresholds.

12. The method of claim 11, further comprising computing, at the degradation detection processor, a cost factor attributable to the performance degradation using the relative coefficient of performance.

13. The method of claim 11, further comprising determining, at the degradation detection processor, that air flow occlusion is present in the HVAC&R system and issuing a signal indicative of the air flow occlusion in response to the relative coefficient of performance exceeding the one or more predefined thresholds.

14. The method of claim 13, further comprising issuing, at the degradation detection processor, a dirty air filter alert when air flow occlusion is present in the HVAC&R system.

15. The method of claim 11, wherein computing the relative coefficient of performance at the relative COP processor comprises:

computing a first ratio comprising the predicted value for the compressor input power parameter over a measured value of the compressor input power parameter;

computing a second ratio comprising a measurement derived value for the evaporator temperature drop over the predicted value for the evaporator temperature drop; and multiplying the first ratio by the second ratio to determine the relative coefficient of performance.

16. The method of claim 11, further comprising storing, at the CIPP processor, the observations acquired by the data acquisition processor, wherein the observations are stored via one or more temperature maps, each temperature map containing a plurality of cells, each cell corresponding to a condenser intake temperature and an evaporator intake temperature, each cell including summary statistics for measured values for the compressor input power parameter.

17. The method of claim 11, further comprising storing, at the EDT processor, the observations acquired by the data acquisition processor, wherein the observations are stored via one or more temperature maps, each temperature map containing a plurality of cells, each cell corresponding to a condenser intake temperature and an evaporator intake temperature, each cell including summary statistics for measurement derived values of the evaporator temperature drop.

18. The method of claim 11, wherein the data acquisition processor, the CIPP processor, the relative COP processor, and the degradation detection processor reside within an agent of a monitoring system, the agent executed on one or more of the following: a cloud-based network, a fog-based network, and locally to the HVAC&R system.

19. The method of claim 11, further comprising augmenting, at a vapor-compression cycle (VCC) state generator, the observations acquired by the data acquisition processor with system state information indicating (i) an ON/OFF state of the HVAC&R system, (ii) a suitability of the observations for learning and predicting compressor input power parameters, and (iii) a suitability of the observations for learning and predicting evaporator temperature drop.

20. The method of claim 11, wherein learning the CIPP relation and the EDT relation by the CIPP processor and the relative COP processor, respectively, is performed using a machine learning based learning process.

21. A non-transitory computer-readable medium containing program logic that, when executed by operation of one or more computer processors, causes the one or more processors to perform a method according to claim 11.

22. A monitoring and detection system, comprising:

a data acquisition processor operable to acquire observations about a first system, the observations including specified system temperature measurements and input power measurements corresponding to the specified temperature measurements;

an input power parameter relation processor operable to learn a power parameter relation between the specified system temperature measurements and the input power measurements, the power parameter relation processor configured to compute a predicted value for an input power parameter using the power parameter relation;

a temperature parameter relation processor operable to learn a temperature parameter relation between the specified system temperature measurements, the temperature parameter relation processor configured to compute a predicted value for a specified system temperature using the temperature parameter relation;

a relative coefficient of performance (COP) processor operable to compute a relative coefficient of performance for the system based on the predicted value for the input power parameter and the predicted value for the specified system temperature; and a degradation detection processor operable to receive the relative coefficient of performance from the relative coefficient of performance processor, the degradation detection processor further operable to shut off power to the first system in response to the relative coefficient of performance exceeding one or more predefined thresholds;

wherein one or more of the data acquisition processor, the input power parameter relation processor, the temperature parameter relation processor, the relative COP processor, or the degradation detection processor is a hardware-based processor.

* * * * *